US008190054B2

(12) United States Patent
Murano

(10) Patent No.: US 8,190,054 B2
(45) Date of Patent: May 29, 2012

(54) IMAGE FORMING APPARATUS FIXING UNIT AND METHOD OF ADJUSTING POSITION OF FIXING UNIT

(75) Inventor: Junichi Murano, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 517 days.

(21) Appl. No.: 12/385,393

(22) Filed: Apr. 7, 2009

(65) Prior Publication Data

US 2009/0263155 A1 Oct. 22, 2009

(30) Foreign Application Priority Data

Apr. 18, 2008 (JP) ..... 2008-108434

(51) Int. Cl.
*G03G 15/00* (2006.01)

(52) U.S. Cl. ..... 399/107; 399/122

(58) Field of Classification Search ..... 399/107, 399/122

See application file for complete search history.

(56) References Cited

U.S. PATENT DOCUMENTS

| | | | | |
|---|---|---|---|---|
| 5,594,539 | A | 1/1997 | Murano et al. | |
| 6,714,750 | B2 * | 3/2004 | Terada et al. | 399/111 |
| 6,725,991 | B2 | 4/2004 | Murano et al. | |
| 6,779,975 | B2 | 8/2004 | Takashima et al. | |
| 7,106,990 | B2 | 9/2006 | Murano et al. | |
| 7,222,471 | B2 | 5/2007 | Matsumoto et al. | |
| 7,409,177 | B2 | 8/2008 | Murano et al. | |
| 2003/0152405 | A1 * | 8/2003 | Takeuchi et al. | 399/328 |
| 2006/0226046 | A1 | 10/2006 | Matsumoto et al. | |
| 2007/0002122 | A1 | 1/2007 | Murano et al. | |
| 2007/0160383 | A1 | 7/2007 | Matsumoto et al. | |
| 2008/0240781 | A1 | 10/2008 | Murano et al. | |

FOREIGN PATENT DOCUMENTS

| | | |
|---|---|---|
| JP | 2000-318888 | 11/2000 |
| JP | 2006-258998 | 9/2006 |
| JP | 3902577 | 1/2007 |
| JP | 2007-079319 | 3/2007 |

OTHER PUBLICATIONS

Computer translation JP2007-079319A, Mar. 2007, to Masahiko
Computer translation of JP2005-292612A, Oct. 2005, to Oohata et al.*
An English language abstract of Japanese Publication No. JP 2004-013167, published Jan. 15, 2004.

* cited by examiner

*Primary Examiner* — Quana M Grainger
(74) *Attorney, Agent, or Firm* — Harness, Dickey & Pierce, P.L.C.

(57) ABSTRACT

In an image forming apparatus, a fixing unit is supported by a unit holder attached to a structure frame. The structure frame includes a first upright panel and a second upright panel. A protrusion is provided on the first upright panel and a guide groove that receives the protrusion is provided on the unit holder. An eccentric cam engages with the unit holder at an engaging position and that is to be operated to move the first unit holder in the first direction relative to the structure frame for position adjustment. The engaging position is located on a vertical line extending through a center of mass of the fixing unit.

14 Claims, 39 Drawing Sheets

IMAGE FORMING APPARATUS FIXING UNIT AND METHOD OF ADJUSTING POSITION OF FIXING UNIT

CROSS-REFERENCE TO RELATED APPLICATIONS

The present application claims priority to and incorporates by reference the entire contents of Japanese priority document 2008-108434 filed in Japan on Apr. 18, 2008.

BACKGROUND OF THE INVENTION

1. Field of the Invention

The present invention relates to a technology related to a structure for supporting a fixing unit in an image forming apparatus.

2. Description of the Related Art

Typical electrophotographic image forming apparatuses include a photosensitive element, which is generally in the form of a belt or a drum, a developing device, an intermediate transfer member, which is generally in the form of a belt, and a fixing unit. As the photosensitive element is rotated, its surface is electrically charged and undergoes an optical writing process to have a latent image formed on the surface. The latent image is developed into a toner image by the developing device, and the toner image is transferred at a transfer position onto a recording medium, such as paper or an overhead projector (OHP) transparency, fed to the transfer position. The toner image is transferred to the recording medium directly or indirectly by way of the intermediate transfer member. The toner image is then fixed onto the recording medium in the fixing unit.

Such an image forming apparatus typically has a structure frame as a skeleton that increases rigidity against deformation and distortion. The structure frame includes a base, a pair of upright panels arranged on the base to face each other, and a stay or a bracket arranged across the upright panels. The structure frame is generally made of steel plates and detachably supports modular units in the structure frame. Examples of the modular units include a photosensitive element device, a charger device, an optical writing device, a developing device, a transfer device, a fixing device, an intermediate transfer device, and a recording-medium feed device each of which is individually formed into a modular unit. Some of these devices are combined together in some cases into a process cartridge that is also detachably supported by the structure frame.

Such an electrophotographic image forming apparatus typically includes a fixing device that causes an image formed on a recording medium to be fixed onto the recording medium while passing through a fixing nip formed between a fixing member and a pressure member. This fixing device is generally formed into a modular unit for ease of maintenance and collectively attached to and detached from the structure frame.

However, when the fixing nip in the fixing unit and a conveying roller that conveys a recording medium to the transfer position are not exactly parallel to each other, recording-medium conveying directions of the fixing unit and the conveying roller can deviate. This can disadvantageously result in skew of the recording medium or an abnormal image such as a trapezoidal image distortion. Techniques to solve these problems are disclosed in, for example, in Japanese Patent Application Laid-open No. 2004-13167, Japanese Patent Application Laid-open No. 2006-258998, and Japanese Patent Application Laid-open No. 2000-318888.

Because an image forming apparatus is constructed of a large number of components, dimensional tolerances of components can accumulate and cause a recording-medium conveying direction of a fixing unit relative to be deviated from that of a recording-medium feed device. To this end, it is conceivable to increase precision of the components; however, increasing the precision generally requires additional cost, making it less feasible. Furthermore, to ensure exact parallelism between the recording-medium conveying directions, it is necessary to reduce not only dimensional variations but also dimensional errors during assembly. However, it is practically impossible to remove dimensional errors that can occur during assembly completely.

The parallelism can be increased by using an assembly jig. However, because a high precision is required of the assembly jig in this approach, it is highly difficult to design and manufacture an assembly jig that can satisfy such a requirement. Even when such an assembly jig is used during assembly, it is practically impossible to achieve complete parallelism.

To meet growing demands for high-quality images, ensuring highly exact parallelism between recording-medium conveying devices in an image forming apparatus is required.

SUMMARY OF THE INVENTION

It is an object of the present invention to at least partially solve the problems in the conventional technology.

According to an aspect of the present invention, there is provided an image forming apparatus that includes a structure frame that includes a first upright panel and a second upright panel, the structure frame forming a skeleton of the image forming apparatus; a first unit holder that is attached to the first upright panel; a first engaging member that extends in a first direction and provided on any one of the first unit holder and the first upright panel; a second engaging member that engages with the first engaging member with substantially no play in a second direction other than the first direction and provided on other one of the first unit holder and the first upright panel; a detachable unit that is positioned and held by the first unit holder between the first upright panel and the second upright panel; and a position adjusting member that engages with the first unit holder at an engaging position and that is to be operated to move the first unit holder in the first direction relative to the structure frame for position adjustment, the engaging position being on a vertical line extending through a center of mass of the detachable unit.

According to another aspect of the present invention, there is provided a method of supporting a fixing unit in an image forming apparatus, the image forming apparatus including a structure frame that forms a skeleton of the image forming apparatus, a unit holder that positions and holds a fixing unit in the structure frame, and a position adjusting member that adjusts a position of the unit holder relative to the structure frame. The method of supporting the fixing unit includes forming a first engaging member on any one of the unit holder and the structure frame, the first engaging member extending in a first direction; forming a second engaging member on other one of the unit holder and the structure frame; bringing the second engaging member into engagement with the first engaging member with substantially no play in a second direction other than the first direction such that the unit holder is movable in the first direction relative to the structure frame for position adjustment; and arranging an eccentric cam, which is the position adjusting member, on a vertical line that extends through a center of mass of the fixing unit, the eccentric cam including a pivot shaft that is to be rotatably fitted into the structure frame into engagement therewith and an eccentric shaft that is to be rotatably fitted into the unit holder into engagement therewith.

According to still another aspect of the present invention, there is provided a method of adjusting the position of the fixing unit in the above method of supporting a fixing unit in an image forming apparatus. The method of adjusting the position of the fixing unit includes pivoting the position adjusting member to move the unit holder in the first direction relative to the structure frame.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
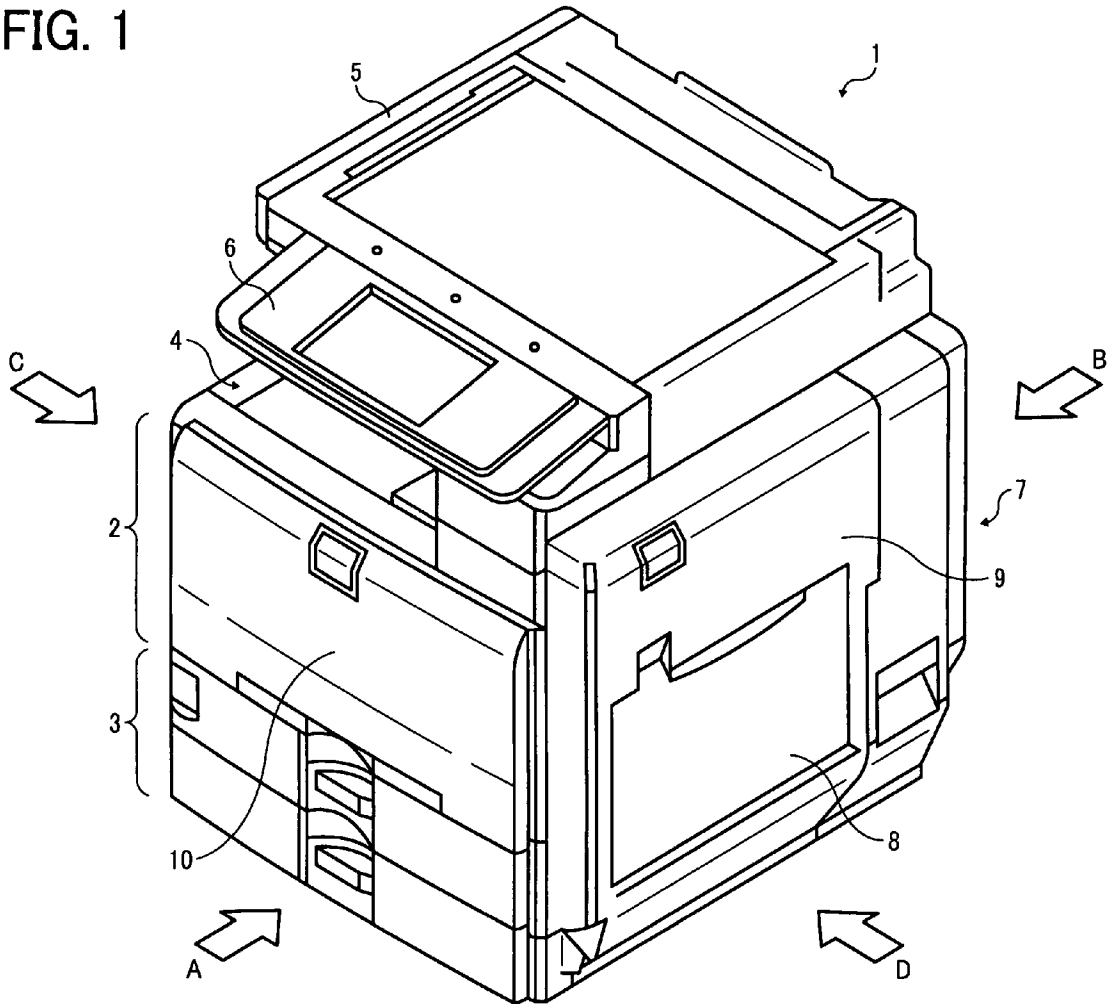
FIG. 1 is an external view depicting a color copier as an exemplary electrophotographic image forming apparatus according to a first embodiment of the present invention.

FIG. 1 is an external view depicting a color copier (hereinafter, "copier") 1 as an exemplary electrophotographic image forming apparatus according to a first embodiment of the present invention.

Although the image forming apparatus depicted in FIG. 1 is referred to as "copier", the copier 1 can be used also as a printer, a scanner, or a facsimile by connecting the copier 1 to another site with a telephone line, a local area network (LAN) cable, or the like.

A structure frame 40, which will be described in detail later, is a skeleton of the copier 1 and externally covered with an outer cover. The copier 1 includes an image forming unit 2, a recording-medium tray unit 3, an internal receiving tray 4, an image reading unit 5, an operation control unit 6, and a duplex unit 7. The image forming unit 2 is at a position below the image reading unit 5 and above the recording-medium tray unit 3. The image forming unit 2 forms an image and transfers the image onto a recording medium. The recording-medium tray unit 3 stores therein recording media and sequentially feeds them toward the image forming unit 2. The internal receiving tray 4 receives a recording medium on which an image has been formed. The image reading unit 5 reads an image of an original. The operation control unit 6 is arranged on a front side, as indicated by an open arrow A in FIG. 1, of the image reading unit 5. The duplex unit 7 is used when double-sided image forming is performed. More specifically, the duplex unit 7 receives a recording medium, one side of which has already been subjected to image forming process, reverses the recording medium, and feeds the recording medium to the image forming unit 2 which then forms an image on the other side of the recording medium.

The operation control unit 6 includes an input unit and a display unit. An operator can input information related to a plurality of functions of the copier 1 from the input unit. The display unit displays various input information, states of various devices, or the like. Examples of the input unit include a start key, a numeric keypad, a function setting key, a reset key, and a clear/stop key. Examples of the output unit include a liquid crystal (LC) panel and an LC touch panel that functions also as the input unit.

The open arrow A in FIG. 1 indicates the front side, which is the side from which an operator operates the copier 1, an open arrow B indicates the rear side, an open arrow C indicates the left side, and an open arrow D indicates the right side. The copier 1 further includes a manual feed table 8, a side door 9, and a front door 10, each of which is hinged relative to the copier 1.

Figure 2:
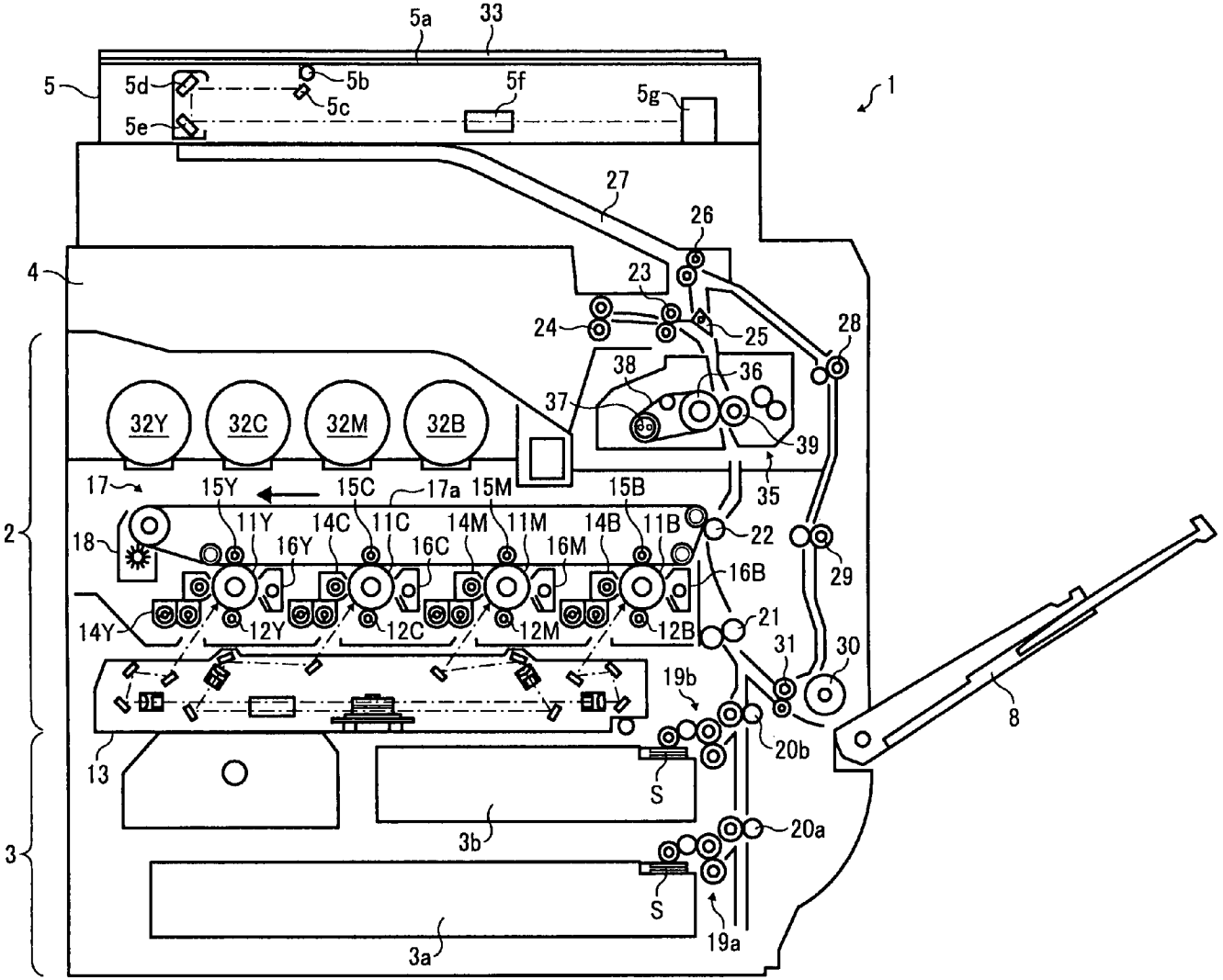
FIG. 2 is a schematic side view of the interior of the copier depicted in FIG. 1.

FIG. 2 is a schematic side view of the interior of the copier 1.

The image forming unit 2 incorporates four image forming stations that form yellow (Y), cyan (C), magenta (M), and black (B) images. The image forming stations are arranged in a tandem arrangement along an intermediate transfer unit 17 that includes an intermediate transfer belt 17*a* which is an endless belt. An optical writing unit 13 is arranged below the four image forming stations.

Meanwhile, units being identical in configuration but different from one another only in toner color will be referred to with a reference symbol indicating the color omitted from its reference numeral in some cases. For example, the term "photosensitive drum 11" will be used below to denote an arbitrary one of photosensitive drums 11Y, 11M, 11C, and 11K. The image forming stations are identical to one another in structure and each has the photosensitive drum 11 (11Y, 11C, 11M, 11B) that is an image carrier, a charging device 12 (12Y, 12C, 12M, 12B), a developing device 14 (14Y, 14C, 14M, 14B), a primary transfer roller 15 (15Y, 15C, 15M, 15B), and a cleaning device 16 (16Y, 16C, 16M, 16B). The charging device 12, the developing device 14, the primary transfer roller 15, and the cleaning device 16 are arranged around the photosensitive drum 11.

The single optical writing unit 13 is arranged for the four image forming stations. The optical writing unit 13 includes a deflector (polygon scanner) at a center portion of the optical writing unit 13, a first optical system, four light sources for the four colors, and a second optical system. The first optical system collimates light emitted from the light sources. A laser diode (LD) is used as the light source. The deflector includes a polygon mirror (rotating polygon mirror) and a polygon motor. The second optical system includes scanning and imaging lenses, such as an fθ lens, arranged on an optical path of each of the light sources, correcting lenses, and mirrors. The optical writing unit 13 performs optical writing as follows. Laser beams are emitted from the LDs based on image data of each color. The light is deflected by the polygon scanner (deflector) so that a latent image of the corresponding color is written on the surface of each of the photosensitive drums 11Y, 11C, 11M, and 11B.

The image forming unit 2 also includes toner bottles 32Y, 32C, 32M, and 32B that are filled with yellow toner, cyan toner, magenta toner, and black toner, respectively. The toner bottles 32Y, 32C, 32M, and 32B are arranged below the internal receiving tray 4. A predetermined amount of toner is supplied from the toner bottles 32Y, 32C, 32M, and 32B to the developing devices 14Y, 14C, 14M, and 14B, respectively, through toner supply paths (not shown).

The intermediate transfer belt 17*a* is supported by and around a drive roller, a driven roller, and the like and rotated counterclockwise in FIG. 2. A secondary transfer roller 22 is arranged on the right of the intermediate transfer belt 17*a* in FIG. 2. An intermediate-transfer-belt cleaning device 18 is arranged on the left of the intermediate transfer belt 17*a* in FIG. 2.

The recording-medium tray unit 3 includes an upper recording-medium feed cassette 3*a* and a lower recording-medium feed cassette 3*b* each of which stores therein one or more sheets of recording medium S. Recording-medium feed devices 19*a* and 19*b* and pairs of feed rollers 20*a* and 20*b* are arranged near the recording-medium feed cassettes 3*a* and 3*b*, respectively. The topmost one sheet of the recording medium S in any one of the recording-medium feed cassettes 3*a* and 3*b* is fed by the corresponding one of the recording-medium feed devices 19*a* and 19*b* to a recording-medium feed device. More specifically, the recording medium S is fed by a corresponding one of the feed rollers 20*a* and 20*b* to a pair of registration rollers 21. The registration rollers 21 then feed the recording medium S to a secondary transfer nip formed between the secondary transfer roller 22 and the intermediate transfer belt 17*a* with given timing.

A fixing unit 35 is arranged above the secondary transfer roller 22. The fixing unit 35 includes, for example, a fixing roller 36, a heating roller 37, a fixing belt 38, and a pressure roller 39. The fixing belt 38 is supported by and around the fixing roller 36 and the heating roller 37. A fixing nip is formed between the fixing belt 38, which is a fixing member, and the pressure roller 39, which is a pressure member.

A pair of conveying rollers 23 that conveys the recording medium S and a pair of delivery rollers 24 that delivers the recording medium S onto the internal receiving tray 4 are arranged above the fixing unit 35. A path-switching flap 25, a pair of reverse conveying rollers 26, and a reverse conveying path 27 are arranged further above the conveying rollers 23 and the delivery rollers 24. When duplex printing is selected, the path-switching flap 25 is operated to guide the recording medium S to the reverse conveying path 27. The recording medium S is temporarily stacked in the reverse conveying path 27, and then fed to the reverse conveying rollers 26 that reverse a traveling direction of the recording medium S in a switchback manner. The recording medium S is then conveyed by the pairs of conveying rollers 28 and 29 through a duplex-printing conveying path to be fed to the registration rollers 21 again.

The image reading unit 5 is arranged in an upper portion of the copier 1. The image reading unit 5 includes an exposure glass 5*a*, a light source 5*b*, a first mirror 5*c*, a second mirror 5*d*, a third mirror 5*e*, an imaging lens 5*f*, and an image sensor 5*g*. An original is placed on the exposure glass 5*a* for image reading. When the light source 5*b* illuminates the original, light reflected from the original is reflected by the first mirror 5*c*, the second mirror 5*d*, and the third mirror 5*e* to enter the imaging lens 5*f*. The image sensor 5*g* such as a charge-coupled device (CCD) is arranged at a position where an image is formed to read an image of the original. The light source 5*b* and the first mirror 5*c* are mounted on a first traveling member. The second mirror 5*d* and the third mirror 5*e* are mounted on a second traveling member.

A platen cover 33 for pressing an original placed on the exposure glass 5*a* is arranged on the image reading unit 5. An automatic document feeder (ADF) can be provided in place of the platen cover 33.

How the copier 1 makes a copy will be described below.

The platen cover 33 or the ADF is lifted up and an original is placed on the exposure glass 5*a*. When using the ADF, the original is placed on a tray of the ADF.

If the original is placed on the exposure glass 5*a*, the image reading unit 5 starts operation immediately after the start key on the operation control unit 6 is pressed. If the original is placed on the tray of the ADF, the image reading unit 5 starts operation after the start key is pressed and the original is fed onto the exposure glass 5*a* by the ADF. Thereafter, each of the first traveling member and the second traveling member is moved so that light emitted from the light source 5*b* is incident on the surface of the original. Light reflected from the original is then reflected by the first mirror 5*c* on the first traveling member, and subsequently reflected by the second mirror 5*d* and the third mirror 5*e* to be incident on the imaging lens 5*f* on the image sensor 5*g*. In this manner, an image of the original is read by the image sensor 5*g*. Then, image forming in any one of a full-color mode or a black-and-white mode is started according to a setting entered on the operation control unit 6. When an automatic mode is selected, the mode is automatically determined based on the acquired image.

In the image forming unit 2, the charging device 12 (12Y, 12C, 12M, 12B) uniformly charges the surface of the photosensitive drum 11 (11Y, 11C, 11M, 11B). The surface of the photosensitive drum 11 is exposed to light emitted from the optical writing unit 13 that includes the four laser light sources, the single deflector, and the four scanning optical systems. As a result, latent images are formed on the surfaces of the photosensitive drums 11Y, 11C, 11M, and 11B.

Toner of corresponding colors are caused to stick onto the latent images in the developing devices 14Y, 14C, 14M, and 14B to form yellow, cyan, magenta, and black toner images on the surfaces of the photosensitive drums 11Y, 11C, 11M, and 11B, respectively.

A primary transfer voltage is applied to the primary transfer rollers 15Y, 15C, 15M, and 15B so that the toner images on the surfaces of the photosensitive drums 11Y, 11C, 11M, and 11B are sequentially transferred onto the intermediate transfer belt 17*a*. The toner images are transferred onto the intermediate transfer belt 17*a* at a single position so that the toner images are superimposed on one another by controlling timing with which each toner image is to be transferred to the intermediate transfer belt 17*a*.

Timed to this primary transfer operation, feeding of the topmost one sheet of the recording medium S in any one of the recording-medium feed cassettes 3*a* and 3*b* by a corresponding one of the recording-medium feed devices 19*a* and 19*b* is performed. In a manual feeding in which the recording medium S is set in the manual feed table 8, the recording medium S is fed from the manual feed table 8 by an external-tray feed roller 30 and into the copier 1 by a pair of recording-medium feed rollers 31. In either case, when a leading end of the recording medium S reaches the registration rollers 21, a sensor (not shown) detects the recording medium S, and outputs a detection signal. The recording medium S is then fed to the secondary transfer nip formed between the secondary transfer roller 22 and the intermediate transfer belt 17*a* with a timing that depends on the detection signal.

The images having been primary-transferred onto the intermediate transfer belt 17*a* in the superimposed manner are conveyed to the secondary transfer nip where the images are collectively secondary-transferred onto the recording medium S. The recording medium S is then conveyed to the fixing unit 35 where the recording medium S passes through the fixing nip in which heat and pressure are applied to the recording medium S to fix the secondary-transferred images onto the recording medium S. The recording medium S is discharged onto the internal receiving tray 4 by the delivery rollers 24. The copier 1 forms a color image on the recording medium S in this manner.

If the duplex mode is selected on the operation control unit 6, the path-switching flap 25 is operated to guide the recording medium S, onto one side of which an image is fixed, to the reverse conveying path 27. The recording medium S is temporarily stacked in the reverse conveying path 27, and then fed to the reverse conveying rollers 26 that reverse the traveling direction of the recording medium S in the switchback manner. The recording medium S is then conveyed by the conveying rollers 28 and 29 through the duplex-printing conveying path to be fed to the registration rollers 21 again timed to the image forming process.

The registration rollers 21 feed the recording medium S again to the secondary transfer nip. At the secondary transfer nip, images formed on the intermediate transfer belt 17*a* are transferred onto the other side of the recording medium S. The recording medium S is then conveyed to the fixing unit 35 where the image is fixed by application of heat and pressure. The copier 1 forms color images on two sides of the recording medium S in this manner.

After residual toner on the surface of the photosensitive drum 11 (11Y, 11M, 11C, 11K) is cleaned by the cleaning device 16 (16Y, 16M, 16C, 16K), the charging device 12 (12Y, 12C, 12M, 12B) applies an alternating current (AC) superimposed on a direct current (DC) bias to the surface to discharge and charge the surface concurrently so that a new image can be formed on the surface. Residual toner on the intermediate transfer belt 17*a* is also cleaned by the intermediate-transfer-belt cleaning device 18.

Figure 3:
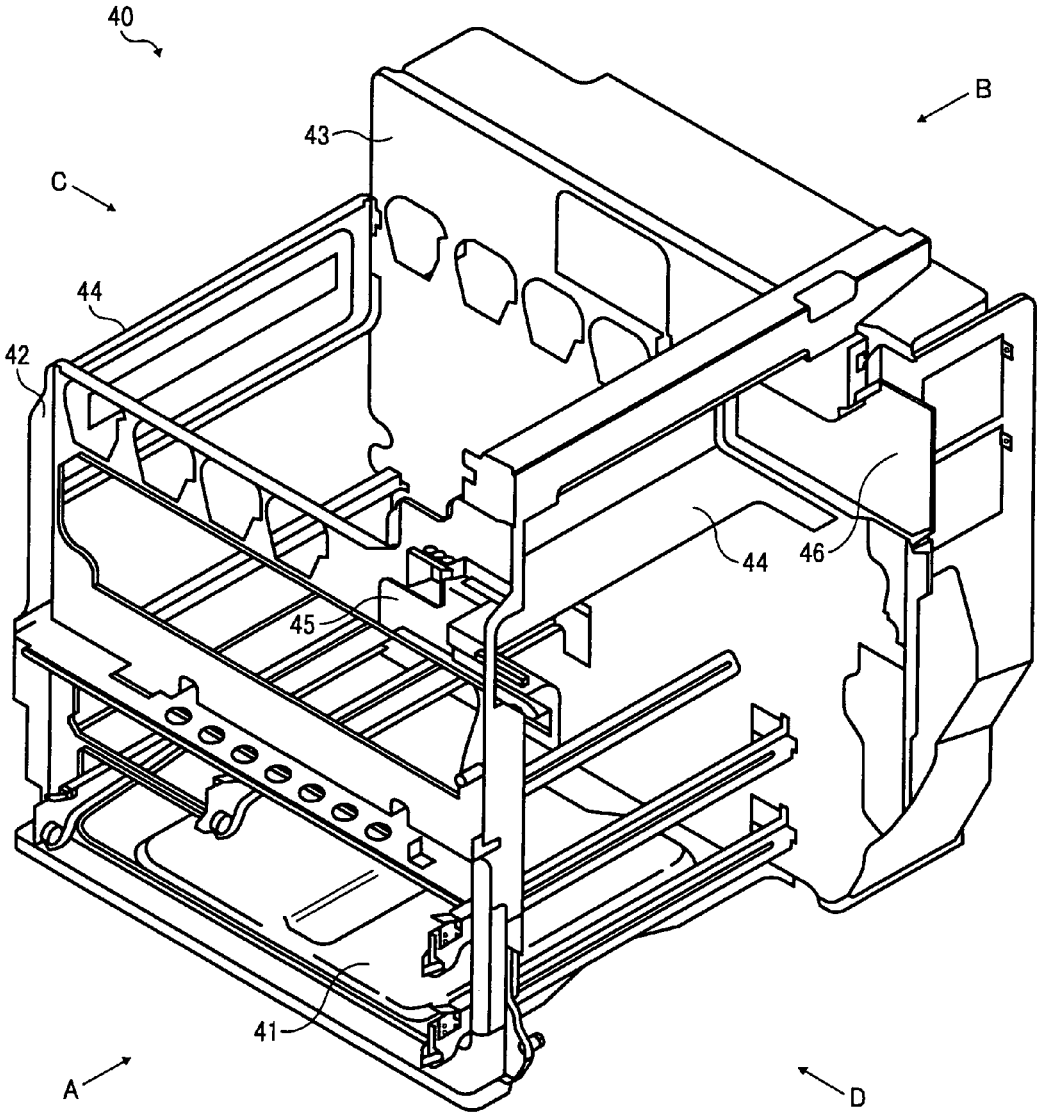
FIG. 3 is a schematic perspective view of a structure frame that is a skeleton of the copier depicted in FIG. 1.

FIG. 3 is a schematic perspective view of the structure frame 40 of the copier 1.

The structure frame 40 is generally made of steel plates and includes a base 41, a first upright panel 42, a second upright panel 43, and stays (brackets) 44. The first upright panel 42 and the second upright panel 43 are arranged on the base 41 to face each other. The stays 44 are arranged across the first and second upright panels 42 and 43. The first upright panel 42 is arranged on the side, indicated by an arrow A in FIG. 3, from which an operator operates the copier 1. The first upright panel 42 is referred to as "the front upright panel 42" in some cases. The second upright panel 43 is referred to as "the rear upright panel 43" in some cases. The fixing unit 35 and the like receive a drive force on the side of the rear upright panel 43.

The structure frame 40 detachably supports various modular units in the structure frame 40. Examples of the modular units include the photosensitive drums 11Y, 11C, 11M, and 11B, the charging devices 12Y, 12C, 12M, and 12B, the optical writing unit 13, the developing devices 14Y, 14C, 14M, and 14B, the primary transfer rollers 15Y, 15C, 15M, and 15B, the cleaning devices 16Y, 16C, 16M, and 16B, the secondary transfer roller 22, the fixing unit 35, the intermediate transfer unit 17, and the recording-medium feed device each of which is individually formed into a modular unit. Some of these units are in some cases combined together into a process cartridge that is also detachably supported by the structure frame 40.

The fixing unit 35 is positioned and held by a first unit holder 45 on the front side and a second unit holder 46 on the rear side. Because the first unit holder (hereinafter, "front unit holder") 45 is attached to the first upright panel 42 and the second unit holder (hereinafter, "rear unit holder") 46 is attached to the second upright panel 43, the fixing unit 35 is supported by and between the first upright panel 42 and the second upright panel 43. The arrow A in FIG. 3 indicates the front side, which is the side from which an operator operates the copier 1, an arrow B indicates the rear side, an arrow C indicates the left side, and an arrow D indicates the right side.

Figure 4:
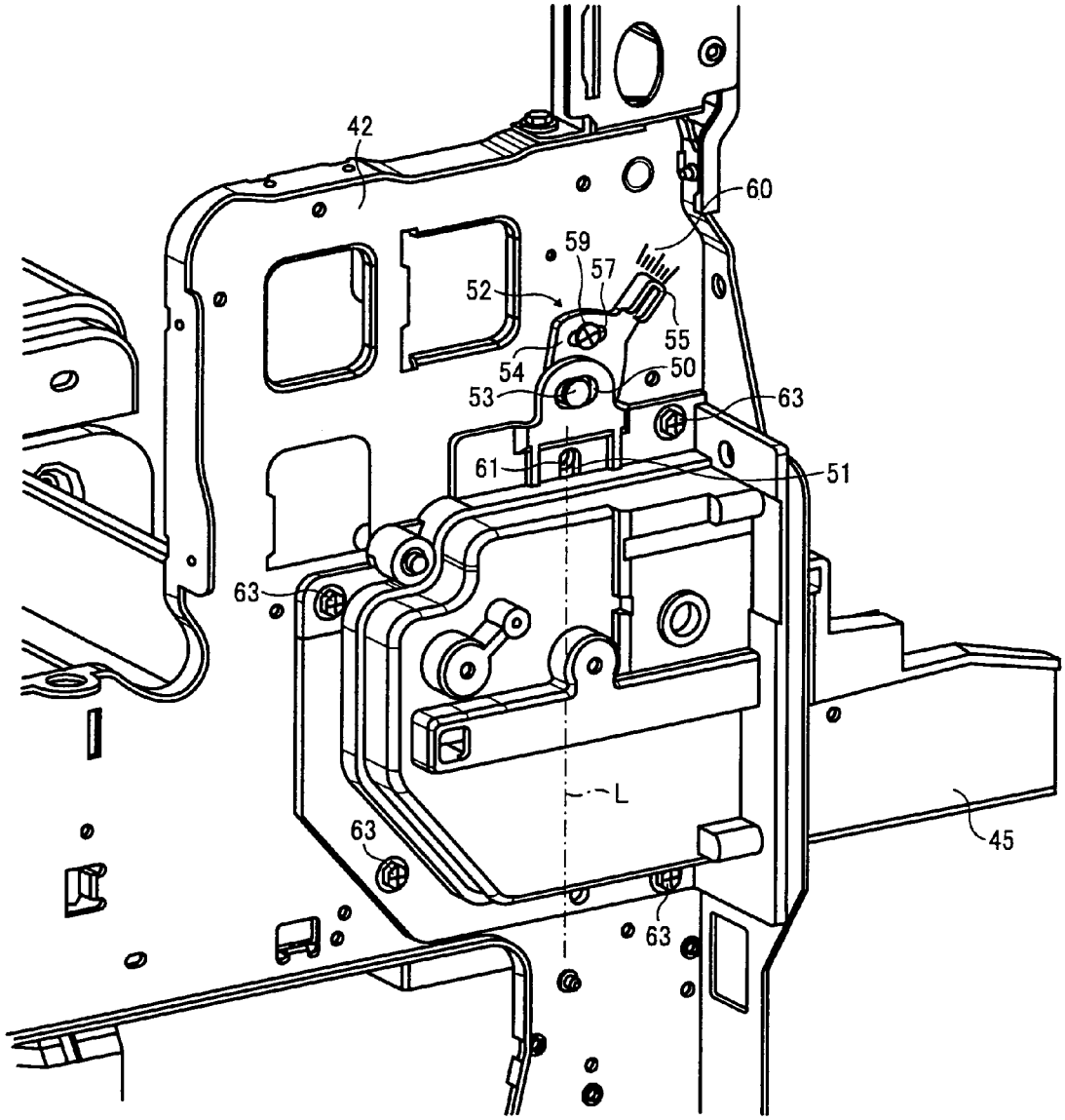
FIG. 4 is a schematic enlarged perspective view of a portion of the structure frame depicted in FIG. 3 where a front unit holder is attached to a first upright panel as viewed from outside of the structure frame.
Figure 5:
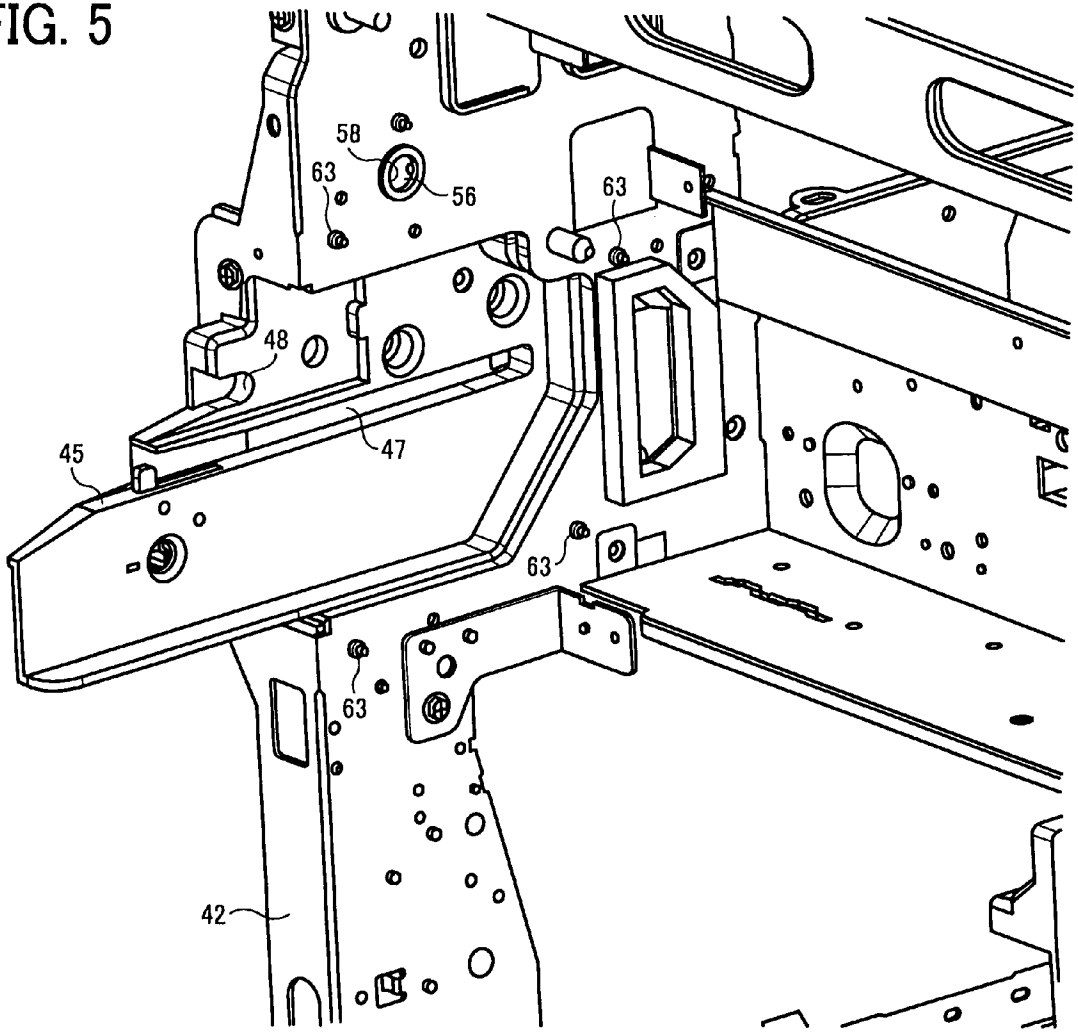
FIG. 5 is a schematic enlarged perspective view of the same portion as that of FIG. 4 as viewed from inside of the structure frame.

FIG. 4 is a schematic enlarged perspective view of a portion of the structure frame 40 where the front unit holder 45 is attached to the first upright panel 42 as viewed from outside of the structure frame 40. FIG. 5 is a schematic enlarged perspective view of the same portion as that of FIG. 4 as viewed from inside of the structure frame 40.

As depicted in FIG. 5, a primary reference engaging groove (hereinafter, "primary groove") 47 and a secondary reference engaging groove (hereinafter, "secondary groove") 48 are defined in the front unit holder 45. The primary groove 47 extends linearly, or in a curved manner, in a second direction parallel to the secondary groove 48. The secondary groove 48 is shorter than the primary groove 47. As depicted in FIG. 4, an elongated hole 50, which is elongated in the second direction, is defined in an upper portion of the front unit holder 45. A guide groove 51 is defined in each of the upper portion and a lower portion of the front unit holder 45. The guide grooves 51 extend linearly, or in a curved manner, in a first direction orthogonal to the second direction. Note that a lower one of the guide grooves 51 is behind other components in FIG. 4.

Figure 6A:
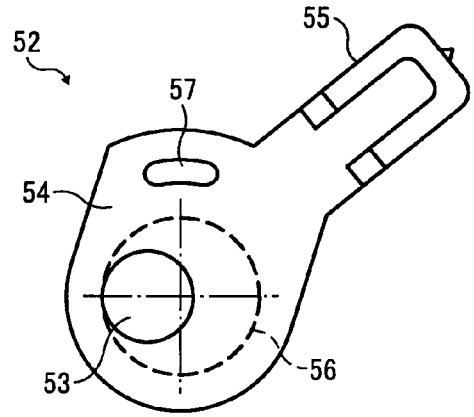
FIGS. 6A to 6C are schematic views of an eccentric cam that pivots to move the front unit holder depicted in FIG. 3 for position adjustment.
Figure 6B:
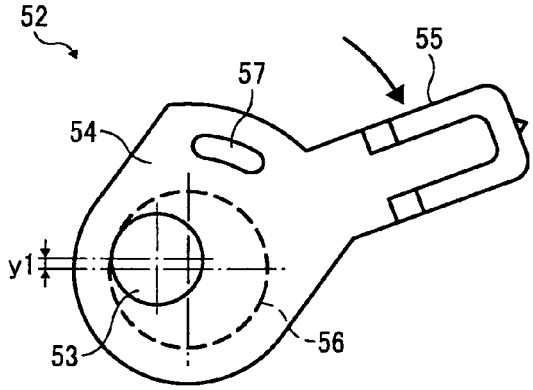
Figure 6C:
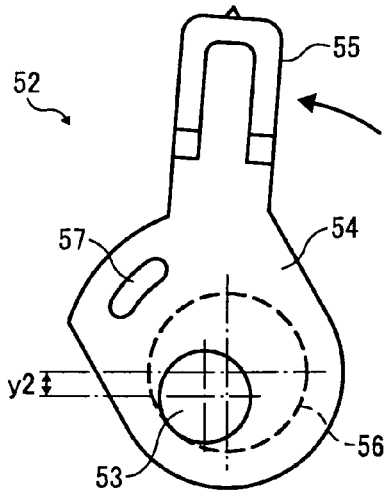

The elongated hole 50 receives an eccentric shaft 53 of an eccentric cam 52 which is a position adjusting member. As depicted in FIGS. 6A to 6C, the eccentric cam 52 includes a disk cam 54, a lever portion 55 that radially extends from the exterior peripheral surface of the disk cam 54, a pivot shaft 56 arranged on one side of the disk cam 54, and an arc-shaped hole 57 that is arc-shaped about the pivot shaft 56. The diameter of the eccentric shaft 53 is substantially equal to the width of the elongated hole 50 so that the eccentric shaft 53 is fit into the elongated hole 50 with substantially no play in the first direction (width direction of the elongated hole 50) to prevent rattling.

As depicted in FIG. 5, the pivot shaft 56 is rotatably fitted into a lever receptacle 58 in the first upright panel (front upright panel) 42 into engagement therewith. As depicted in FIG. 4, the disk cam 54 of the eccentric cam 52 is overlaid on the first upright panel 42 from the external side. The eccentric cam 52 is fixed onto the first upright panel 42 by fastening a fixing screw 59 inserted into the arc-shaped hole 57. At this time, the eccentric cam 52 is positioned such that a leading end of the lever portion 55 indicates a mark labeled with 60 among marks on the first upright panel 42.

The eccentric shaft 53 is fitted into the elongated hole 50 into engagement therewith. A guide protrusion 61 is formed on each of an upper portion and a lower portion of the first upright panel 42. The guide protrusions 61 of the first upright panel 42 are inserted into the corresponding guide grooves 51 until the first upright panel 42 contacts the front unit holder 45. Four mount screws 63 are screwed into four screw holes defined in the first upright panel 42 through four elongated screw holes 62 (hidden in the drawings) defined in the front unit holder 45 to fix the front unit holder 45 onto the first upright panel 42.

Figure 10:
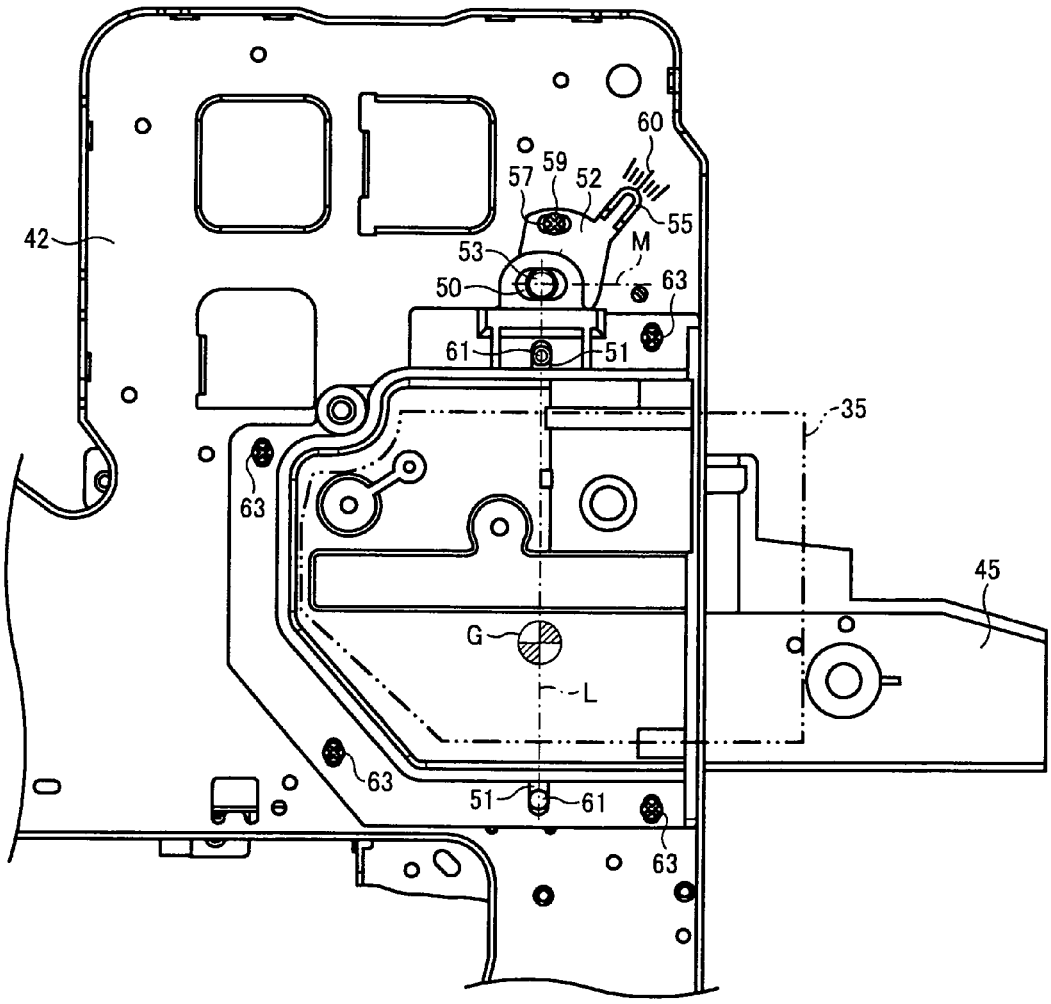
FIG. 10 is a schematic enlarged side view for explaining how the fixing unit depicted in FIG. 9 is supported by the structure frame via the front unit holder.

In the first embodiment, each of the guide protrusions 61 is formed integrally with the first upright panel 42 by drawing process such as flanging. The guide protrusions 61 are positioned on a vertical line L that is parallel to a direction in which the recording medium S passes through the fixing nip. Therefore, the two guide grooves 51 of the front unit holder 45 extend in the first direction parallel to the vertical line L while the primary groove 47, the secondary groove 48, and the elongated hole 50 extend in the second direction orthogonal to the vertical line L. The elongated screw holes 62 also extend in the first direction. A line extending through the center of the pivot shaft 56 and the center of the eccentric shaft 53 is orthogonal to the vertical line L and extends in the second direction as depicted in FIG. 10, which will be explained later.

When the lever portion 55 is operated to cause eccentric cam 52 to pivot, the two guide protrusions 61 guide the front unit holder 45 to move in the first direction, in which the recording medium S passes through the fixing nip. The width of the guide grooves 51 is substantially identical with the diameter of the guide protrusions 61 so that each of the guide protrusions 61 is fit into a corresponding one of the guide grooves 51 with substantially no play in the second direction. This configuration prevents rattling of the guide protrusion 61 in the second direction.

It has been mentioned above that the guide grooves 51 are defined in the front unit holder 45 while the guide protrusions 61 that engage with the guide grooves 51 with no play in the second direction are formed on the first upright panel 42. Alternatively, the guide protrusions 61 can be formed on the front unit holder 45 while the guide grooves 51 are defined in the first upright panel 42. An elongated hole can be defined in place of the guide groove 51 in the first upright panel 42 or the front unit holder 45.

Figure 7:
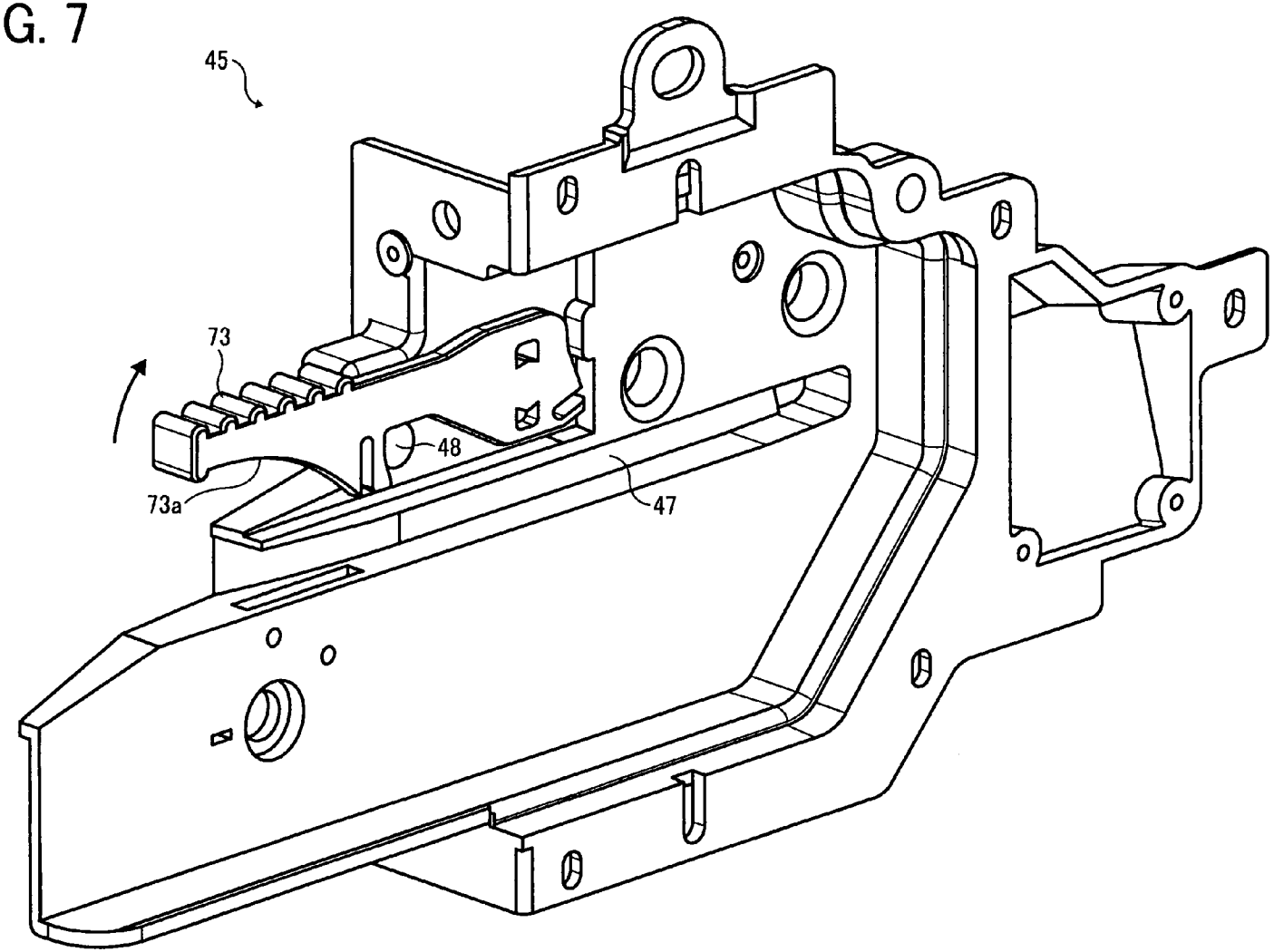
FIG. 7 is a schematic enlarged perspective view of the front unit holder depicted in FIG. 4 as viewed from inside of the structure frame.

FIG. 7 is a schematic enlarged perspective view of the front unit holder 45 as viewed from inside of the structure frame 40.

A fixing-unit locking lever (hereinafter, "locking lever") 73, which has a first end and a second end, is pivotally attached at the first end to the front unit holder 45 at a position of the secondary groove 48. When the locking lever 73 is operated, the second end is moved upward as indicated by an arrow in FIG. 7. Note that the locking lever 73 is omitted from FIG. 5 for clarity.

Figure 8:
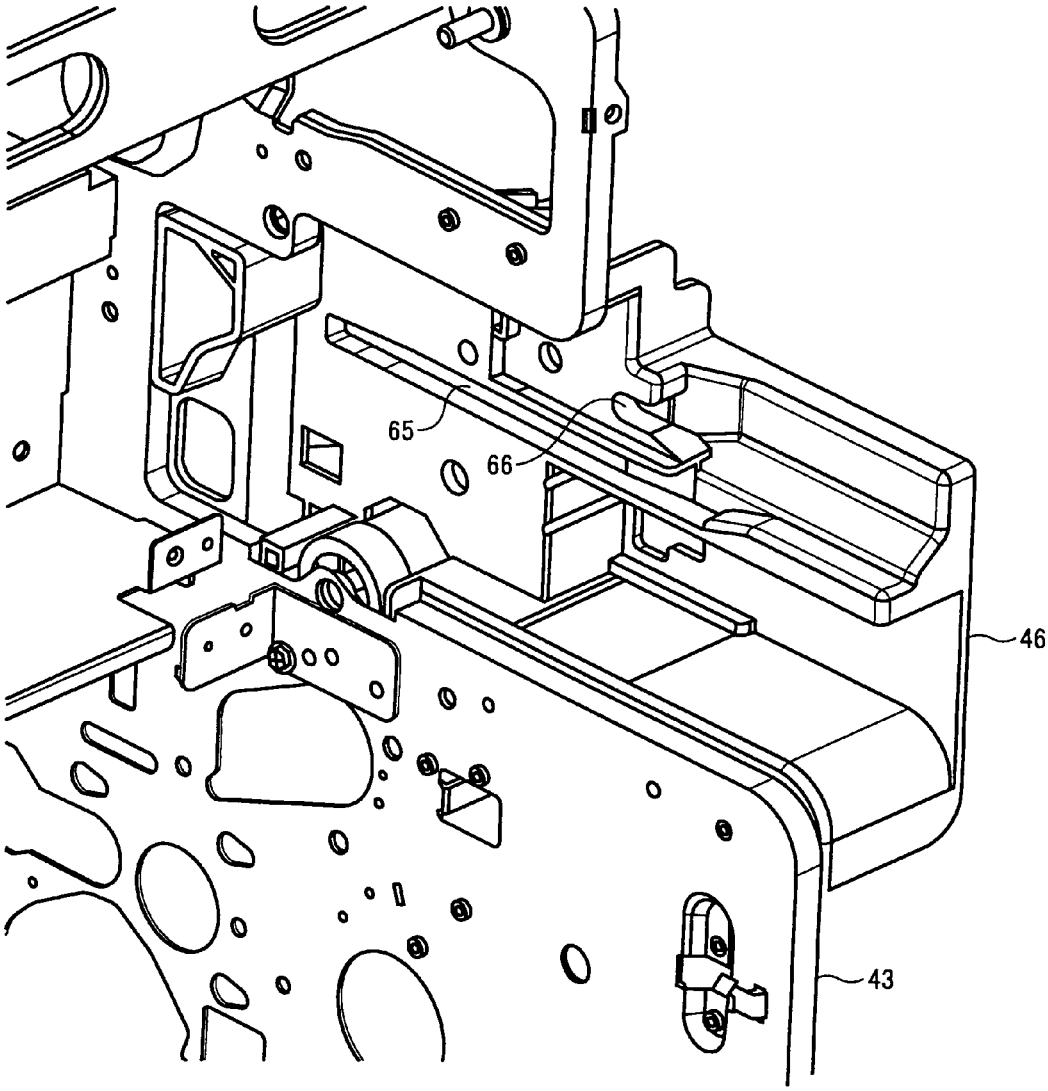
FIG. 8 is a schematic enlarged perspective view of a portion where a rear unit holder is attached to a second upright panel of the structure frame depicted in FIG. 3 as viewed from inside of the structure frame.

FIG. 8 is a schematic enlarged perspective view of a portion where the rear unit holder 46 is attached to the second upright panel 43 as viewed from inside of the structure frame 40.

The rear unit holder 46 has a similar configuration to that of the front unit holder 45, and includes a primary groove 65 and a secondary groove 66. The primary groove 65 extends linearly, or in a curved manner, parallel to the secondary groove 66 that is shorter than the primary groove 65. The rear unit holder 46 is overlaid on the second upright panel 43 from the external side. A plurality of mount screws are screwed into threaded holes in the second upright panel 43 through a plurality of screw-receiving elongated holes defined in the rear unit holder 46 to fix the rear unit holder 46 onto the second upright panel 43. When the rear unit holder 46 has been fixed onto the second upright panel 43 in this manner, the primary groove 65 of the rear unit holder 46 opposes the primary groove 47 of the front unit holder 45, and the secondary groove 66 opposes the secondary groove 48. The locking lever 73 is pivotally attached at the first end to the rear unit holder 46 at a position of the secondary groove 66 such that when the locking lever 73 is operated, the second end of the locking lever 73 is moved upward. Note that this locking lever 73 is omitted from FIG. 8 for clarity.

Figure 9:
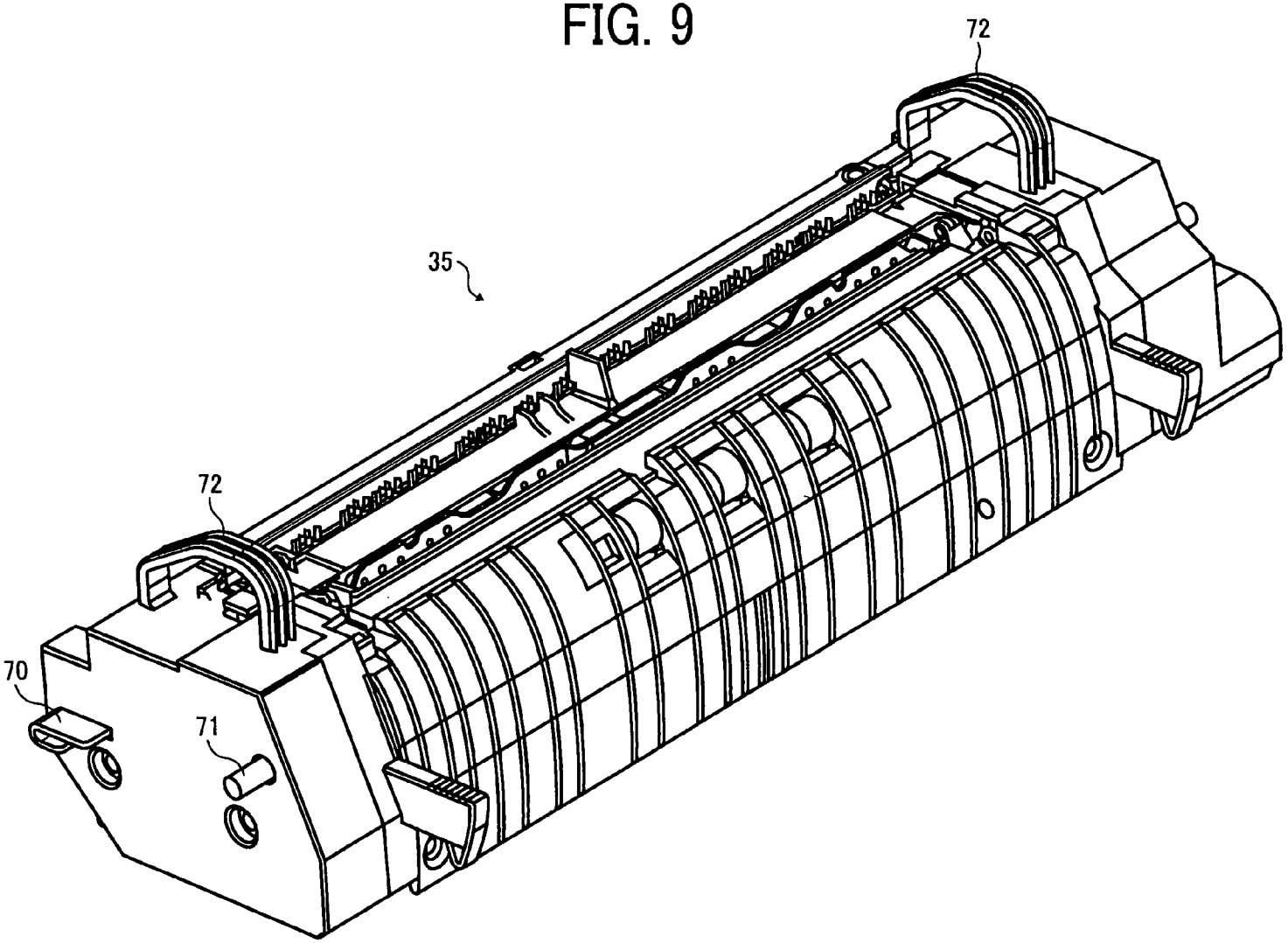
FIG. 9 is a schematic perspective view of the appearance of a fixing unit depicted in FIG. 2.

FIG. 9 is a schematic perspective view of the appearance of the fixing unit 35.

A set of a primary reference protrusion (hereinafter, "primary protrusion") 70 and a boss-like secondary reference protrusion (hereinafter, "secondary protrusion") 71 protruding frontward and rearward, respectively, is formed on each of a front surface and a rear surface of the fixing unit 35. The primary protrusion 70 and the secondary protrusion 71 are spaced from each other. A grip 72 projecting upward is formed on each of a front portion and a rear portion of the top surface of the fixing unit 35. How to attach the fixing unit 35 to the copier 1 will be briefly described. The fixing unit 35 is held by the grips 72 and inserted into the copier 1 through the side door 9 on the right surface of the copier 1. By fitting the primary protrusions 70 into the primary groove 47 of the front unit holder 45 and the primary groove 65 of the rear unit holder 46 and fitting the secondary protrusions 71 into the secondary groove 48 of the front unit holder 45 and the secondary groove 66 of the rear unit holder 46, the fixing unit 35 is interposed between the front unit holder 45 and the rear unit holder 46.

When the fixing unit 35 is further inserted, the secondary protrusions 71 abut on curved surfaces 73*a* (see FIG. 7) of the locking levers 73. The fixing unit 35 is inserted deeper, causing the secondary protrusions 71 to push the locking levers 73 upward against the pull of the gravity on the locking levers 73. When the primary protrusions 70 abut on the deep ends of the primary grooves 47 and 65, the locking levers 73 is returned to their initial orientations by the pull of the gravity. When the locking levers 73 return to their initial orientations, the locking levers 73 latch the secondary protrusions 71 to prevent the secondary protrusions 71 from returning. Thus, the fixing unit 35 is attached to the copier 1 in a state of being supported by the first upright panel 42 and the second upright panel 43 of the structure frame 40. The fixing unit 35 attached to the copier 1 is driven on a drive force that the fixing unit 35 receives at the rear side.

To detach the fixing unit 35 from the copier 1, the locking levers 73 are manually pivoted to unlatch the locking levers 73 from the secondary protrusions 71. Subsequently, the fixing unit 35 is held with hands by the grips 72 and pulled frontward. While the fixing unit 35 is being pulled, the primary grooves 47 and 65 guide the primary protrusions 70 and the secondary grooves 48 and 66 guide the secondary protrusions 71.

FIG. 10 is a schematic enlarged side view for explaining how the fixing unit 35 is supported by the first upright panel 42 via the front unit holder 45.

A center (hereinafter, "gravity center") G of the mass of the fixing unit 35 is between the upper one and the lower one of the guide protrusions 61 of the first upright panel 42. Each of the guide grooves 51 and the guide protrusions 61 are on the vertical line L that extends through the gravity center G. An engagement position between the eccentric cam 52 and the front unit holder 45, which is the position of the eccentric shaft 53, is also on the vertical line L. A line M that extends through the center of the pivot shaft 56 and the eccentric shaft 53 is orthogonal to the vertical line L.

To adjust the orientation of the fixing unit 35, the mount screws 63 and the fixing screw 59 are loosened to permit operation of the eccentric cam 52. Thereafter, the lever portion 55 is operated to cause the eccentric cam 52 to pivot about the pivot shaft 56. The orientation of the fixing unit 35 is typically adjusted such that the leading end of the lever portion 55 indicates the mark labeled with 60. More specifically, when the eccentric cam 52 is pivoted clockwise from the state depicted in FIG. 6A, the eccentric shaft 53 is moved upward by a distance y1 in the first direction, i.e., along the vertical line L, as depicted in FIG. 6B. As a result, the eccentric shaft 53 pushes up the front unit holder 45 in the first direction. In contrast, when the eccentric cam 52 is pivoted counterclockwise as depicted in FIG. 6C, the eccentric shaft 53 is moved downward by a distance y2 in the first direction. As a result, the eccentric shaft 53 pulls down the front unit holder 45 in the first direction. After the fixing screw 59 and thereafter the mount screws 63 are fastened again, image forming is performed to determine whether the fixing unit 35 is sufficiently parallel to the registration rollers 21. Thus, the rear unit holder 46 is attached to the second upright panel 43 such that the rear unit holder 46 is movable in the first direction relative to the structure frame 40 for positional adjustment in a manner similar to that of the front unit holder 45.

When it is determined that the fixing unit 35 is insufficiently parallel to the registration rollers 21, the fixing screw 59 and the mount screws 63 are loosened again, and the eccentric cam 52 is pivoted to adjust the position of the front unit holder 45. After the fixing screw 59 and thereafter the mount screws 63 are fastened, image forming is performed again to determine whether the fixing unit 35 is sufficiently parallel to the registration rollers 21. By repeating this procedure, vertical position adjustment of the front portion of the fixing unit 35 is performed to achieve sufficient parallelism between the fixing unit 35 and the registration rollers 21. Moving the eccentric shaft 53 in the first direction permits smooth moving of the front unit holder 45 in the first direction.

Figure 11:
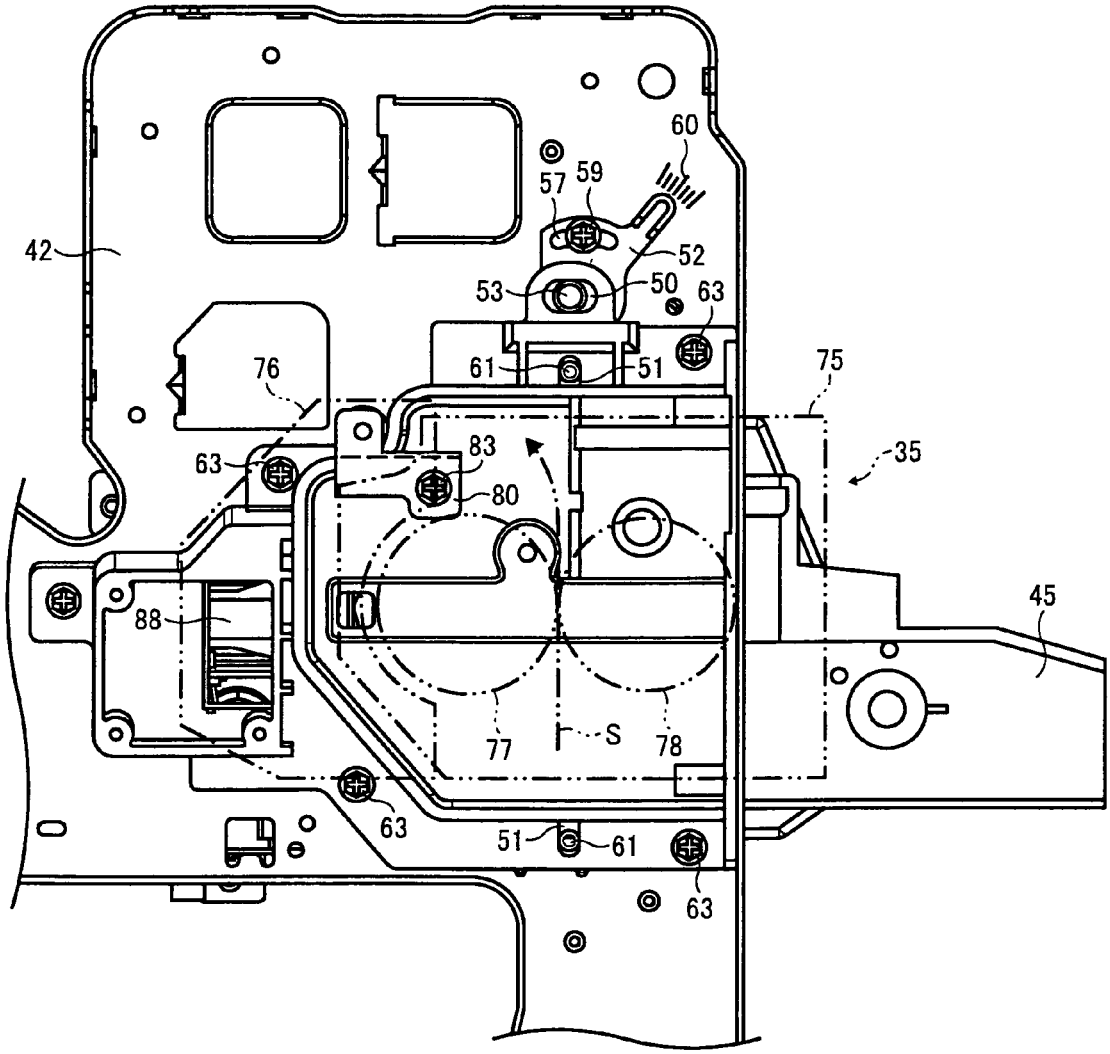
FIG. 11 is a schematic enlarged side view of an IH-type fixing unit that employs an electromagnetic induction heating (IH) method and is supported by the structure frame.

FIG. 11 is a schematic enlarged side view of a fixing unit that employs an electromagnetic induction heating (IH) method and is supported by the structure frame 40. This fixing unit is denoted by the same reference number as that of the fixing unit 35 described above and referred to as "IH-type fixing unit 35".

The IH-type fixing unit 35 includes a unit body 75 and an IH device 76. The IH device 76 includes a casing 84. A fixing nip is formed between a fixing roller 77, which is a fixing member, and a pressure roller 78, which is a pressure member, in the unit body 75. While a sheet of the recording medium S passes through the fixing nip, heat and pressure is applied to the recording medium S, causing an image on the recording medium S to be fixed onto the recording medium S. An IH layer is arranged on an external peripheral surface of the fixing roller 77. In this example, the fixing roller 77 is used as the fixing member; however, the fixing belt 38 as depicted in FIG. 2 that has an IH layer on its surface can be used in placed of the fixing roller 77. A non-rotational pressure pad can be used as the pressure member in place of the pressure roller 78. Note that components depicted in FIG. 11 corresponding to those depicted in FIG. 10 are denoted by the same reference numbers as those of FIG. 10.

The IH-type fixing unit 35 is similarly attached to the copier 1 such that the gravity center G of the IH-type fixing unit 35 inclusive of a heating coil 93 (magnetic-flux generating unit) is between the upper one and the lower one of the guide protrusions 61 of the first upright panel 42. Each of the guide grooves 51 and each of the guide protrusions 61 are on the vertical line L that extends through the gravity center G.

Figure 12:
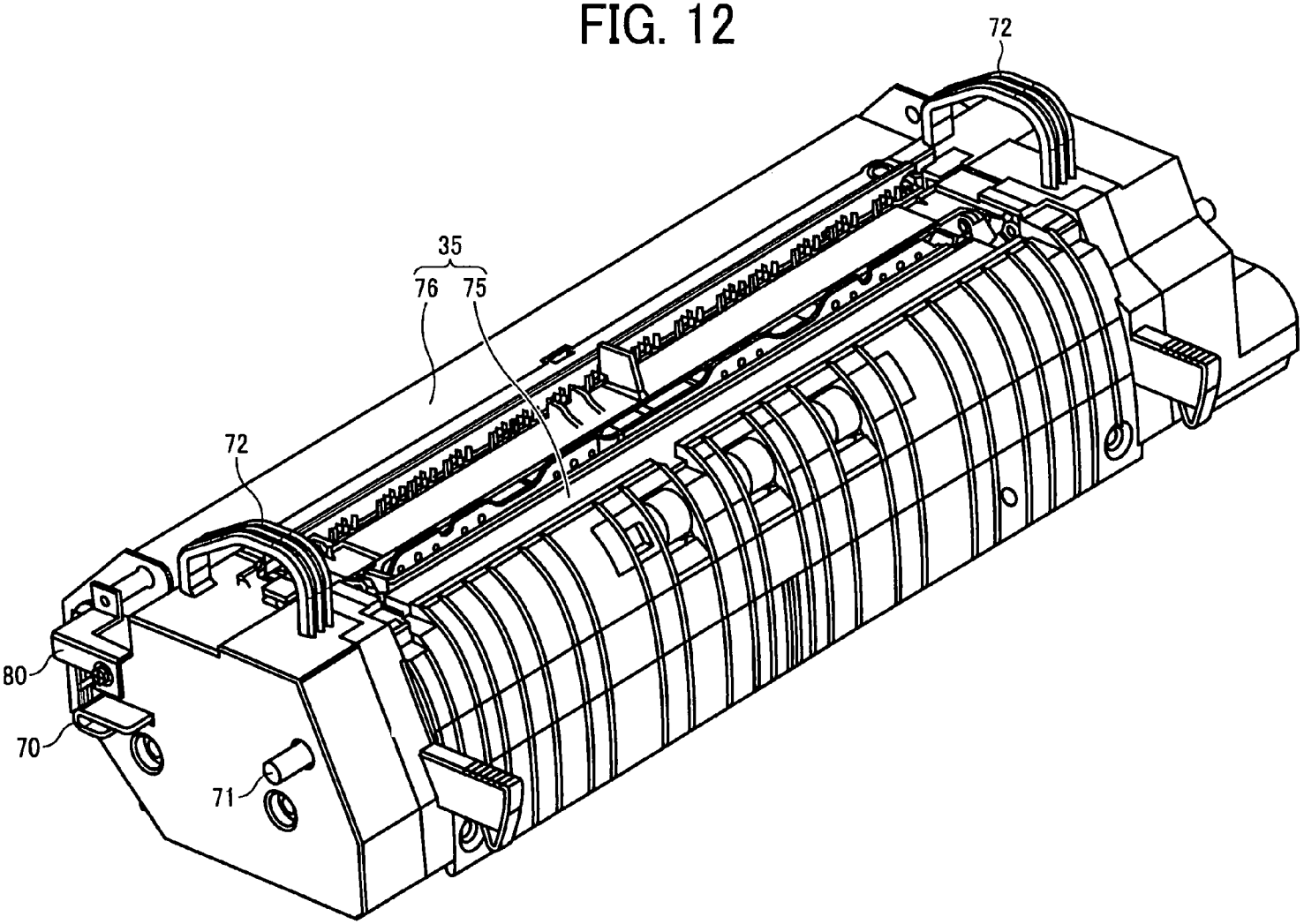
FIG. 12 is a schematic perspective view of the appearance of the IH-type fixing unit depicted in FIG. 11.

FIG. 12 is a schematic perspective view of the appearance of the IH-type fixing unit 35.

The primary protrusion 70 and the boss-like secondary protrusion 71 that are spaced from each other are formed on each of a front surface and a rear surface of the IH-type fixing unit 35. Ones of the primary protrusions 70 and the secondary protrusions 71 protrude frontward from the front surface while the other ones of the primary protrusions 70 and the secondary protrusions 71 protrude rearward from the rear surface. The grip 72 projecting upward is formed on each of the front portion and the rear portion of the top surface of the IH-type fixing unit 35. In a similar manner to that described above, to attach the IH-type fixing unit 35 to the copier 1, the IH-type fixing unit 35 is held by the grips 72 and inserted into the copier 1. The IH-type fixing unit 35 is interposed between the front unit holder 45 and the rear unit holder 46 and attached to the copier 1 in the state of being supported by the first upright panel 42 and the second upright panel 43 of the structure frame 40.

The IH-type fixing unit 35 includes a joint member 80 with which the unit body 75 and the IH device 76 are joined together.

Figure 13:
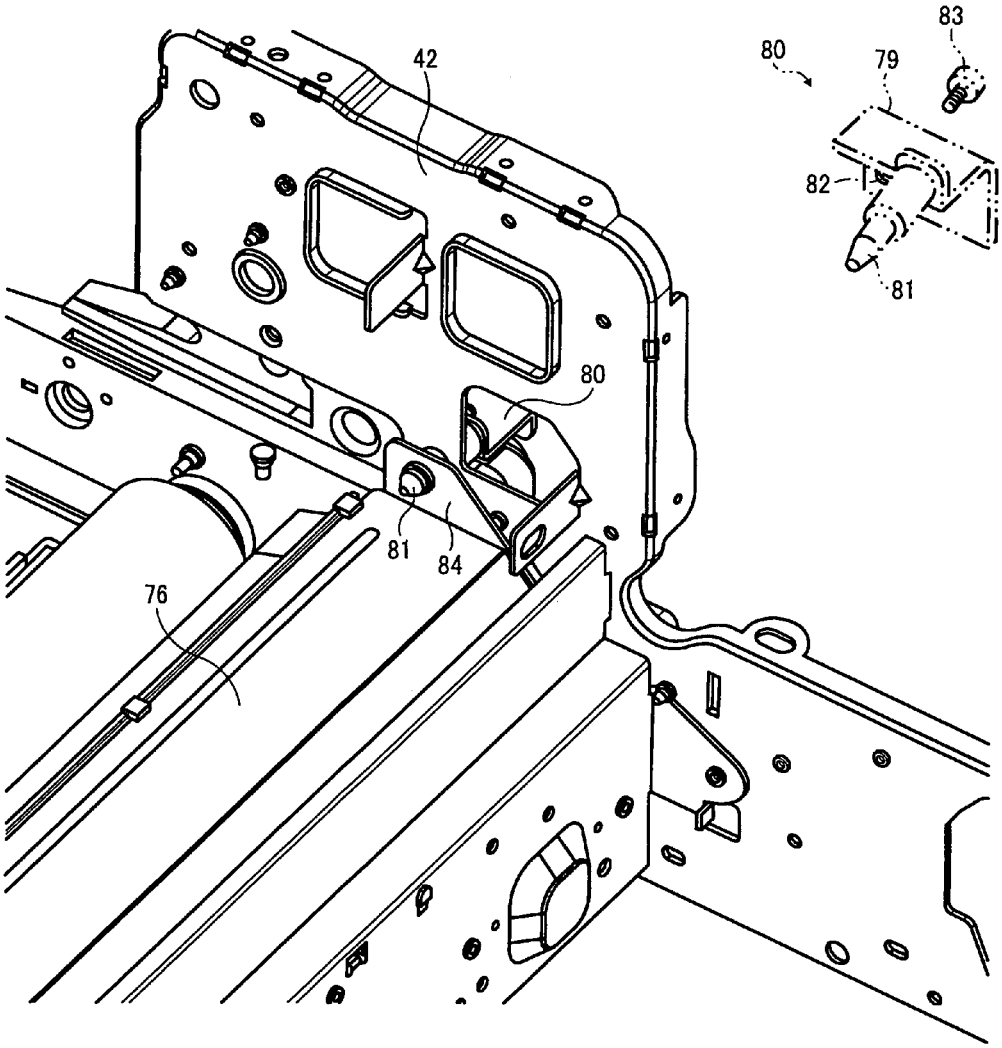
FIG. 13 is a schematic perspective view depicting a joint member and how the joint member is attached to the first upright panel.

FIG. 13 is a schematic perspective view depicting the joint member 80 and how the joint member 80 is attached to the first upright panel 42.

The joint member 80 includes a bent plate 79, a positioning pin 81 that extends from the bent plate 79, and a screw receiving hole 82 defined in the bent plate 79. The joint member 80 is fixed to the unit body 75 by fastening a mount screw 83 through the screw receiving hole 82 to the unit body 75. A leading end of the positioning pin 81 is inserted into a positioning hole 85 (see FIG. 14) defined in the casing 84 of the IH device 76 to attach the IH device 76 to the unit body 75 such that the IH device 76 is rotatable about the positioning pin 81. An urging member (not shown) urges the IH device 76 toward the unit body 75. This configuration permits maintaining a positional relation between the unit body 75 and the IH device 76 without fail when attaching the unit body 75 that has been pulled out of the copier 1 to clear a jammed recording medium or the like to the copier 1 again.

Figure 14:
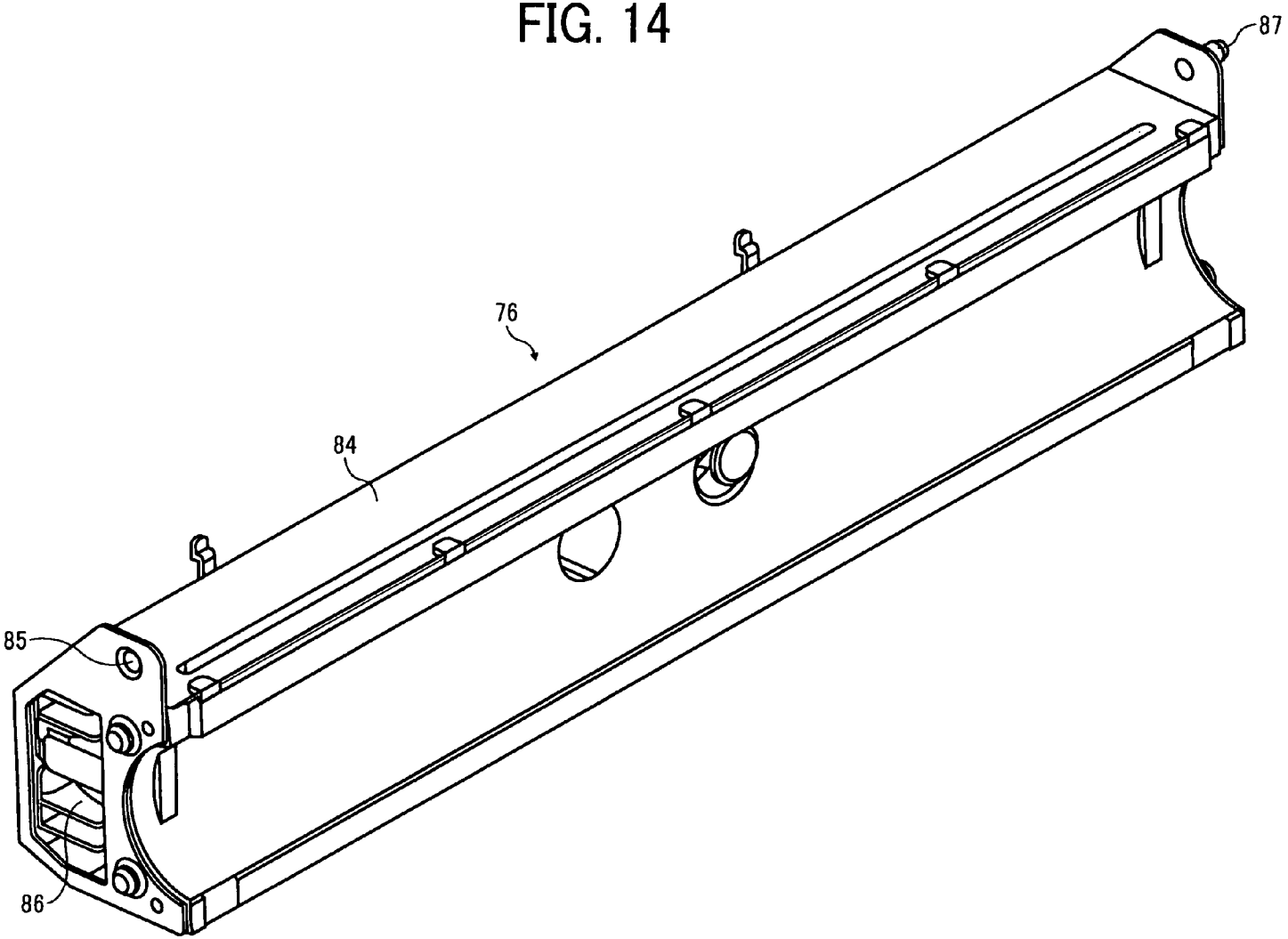
FIG. 14 is a schematic perspective view of the appearance of an IH device depicted in FIG. 12.

FIG. 14 is a schematic perspective view of the appearance of the IH device 76.

The IH device 76 has, in the casing 84, the heating coil 93 (see FIG. 19) that is generates heat by electromagnetic induction when being energized. More specifically, a current that flows within the heating coil 93 generates a magnetic field that, in turn, induces an electric current flowing within the IH layer of the fixing roller 77 and generates heat. The IH device 76 includes an air inlet 86 in a front surface of the IH device 76, the positioning hole 85 above the air inlet 86, and a positioning pin 87 at a position corresponding to the positioning hole 85. The positioning pin 87 is inserted into a positioning hole of the rear unit holder 46 to support the IH device 76 such that the IH device 76 can pivot about the positioning pin 81 and the positioning pin 87.

Figure 15:
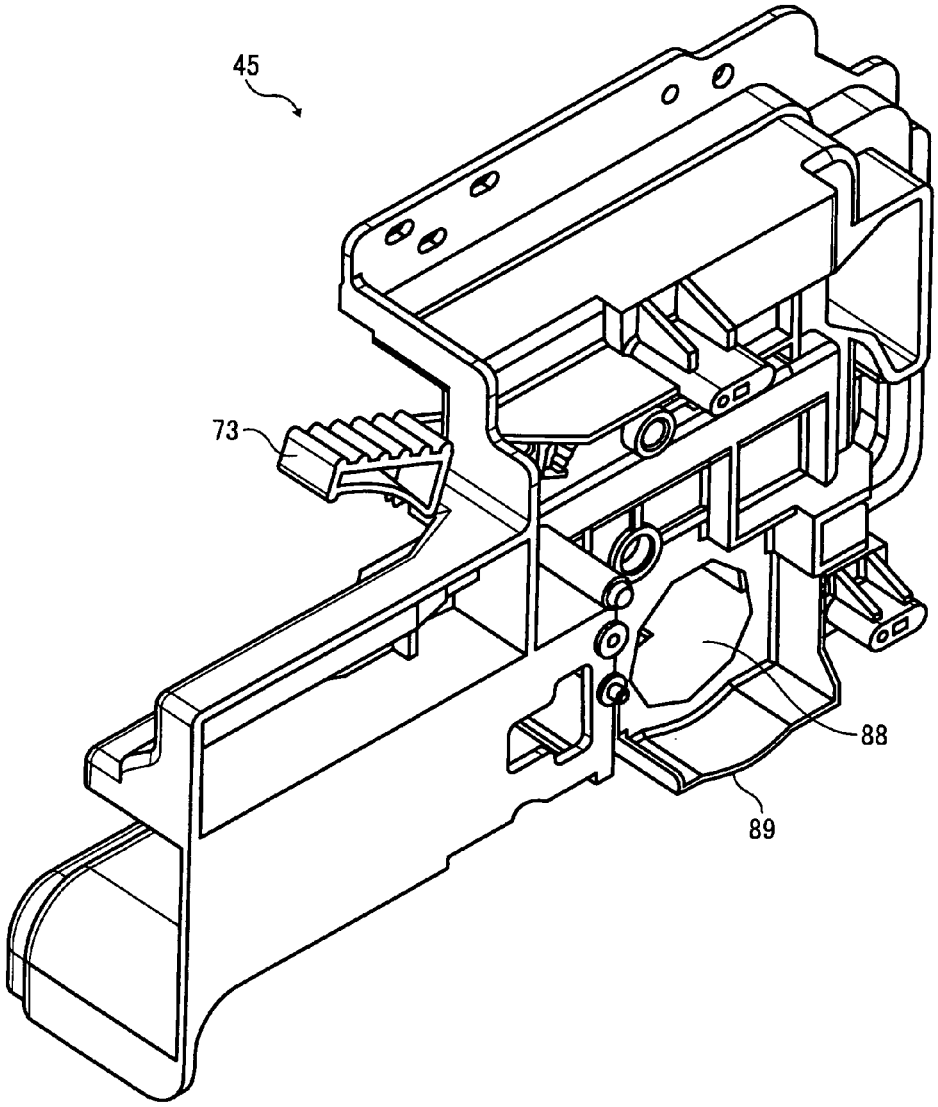
FIG. 15 is a schematic perspective view of the front unit holder depicted in FIG. 11 as viewed from inside of the structure frame.
Figure 16:
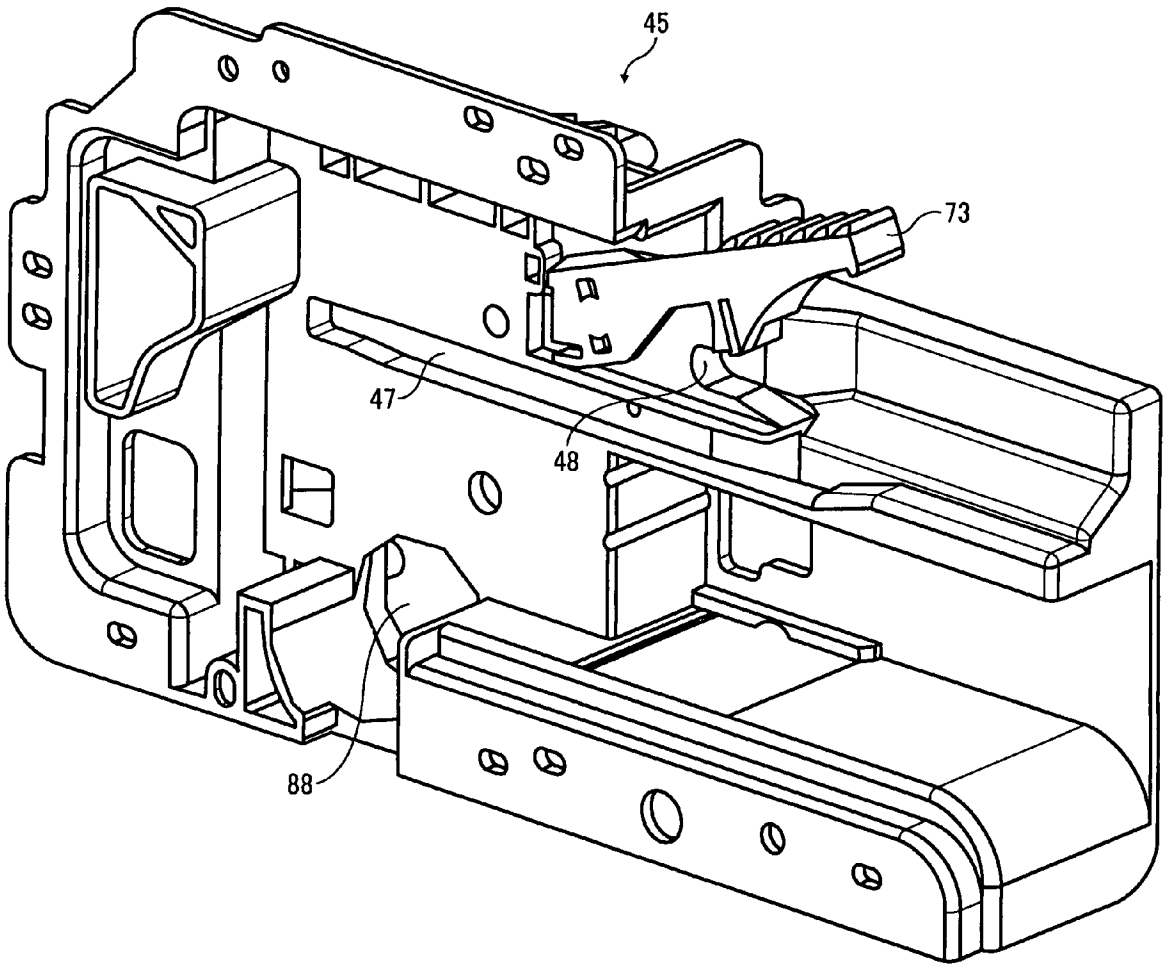
FIG. 16 is a schematic perspective view of the front unit holder depicted in FIG. 15 as viewed from outside of the structure frame.

FIG. 15 is a schematic perspective view of the front unit holder 45 as viewed from inside of the structure frame 40. FIG. 16 is a schematic perspective view of the front unit holder 45 as viewed from outside of the structure frame 40.

Similar to the front unit holder 45 depicted in FIGS. 4 and 5, the front unit holder 45 that supports the IH-type fixing unit 35 includes the primary groove 47 and the secondary groove 48 that are parallel to each other. The primary groove 47 and the secondary groove 48 extend linearly, or in a curved manner, in the second direction. The secondary groove 48 is shorter than the primary groove 47. The locking lever 73 is pivotally attached at the first end to the front unit holder 45 at the position of the secondary groove 48. When the locking lever 73 is operated, the second end is moved upward against the pull of the gravity on the locking lever 73 as depicted in FIG. 16. An air intake opening 88 is defined in the front unit holder 45. A fan receptacle 89 is formed near the air intake opening 88.

Figure 17:
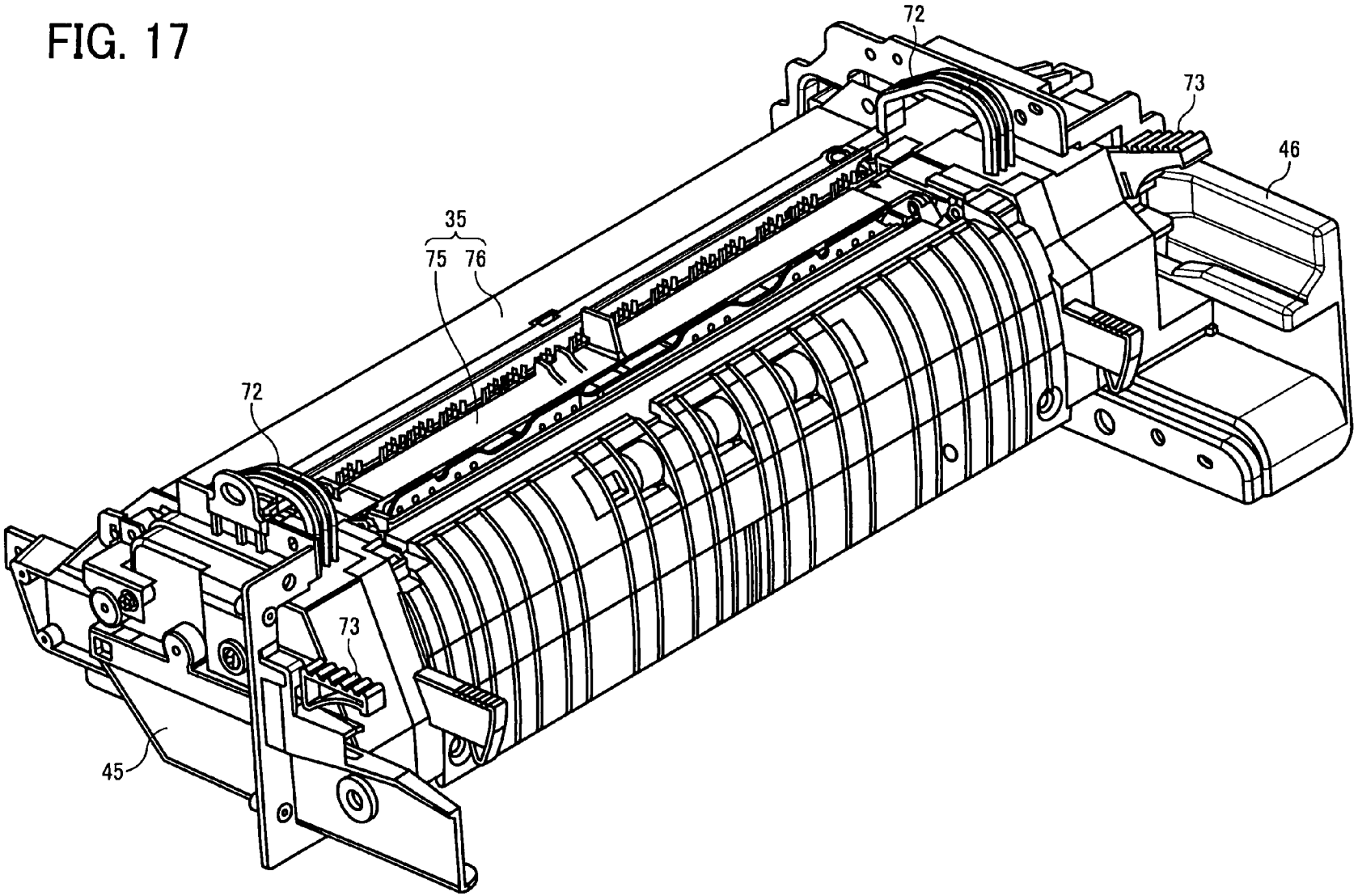
FIG. 17 is a schematic perspective view of the IH-type fixing unit depicted in FIG. 12 that is attached between the front unit holder and the rear unit holder.

FIG. 17 is a schematic perspective view of the IH-type fixing unit 35 that is attached between the front unit holder 45 and the rear unit holder 46.

Figure 18:
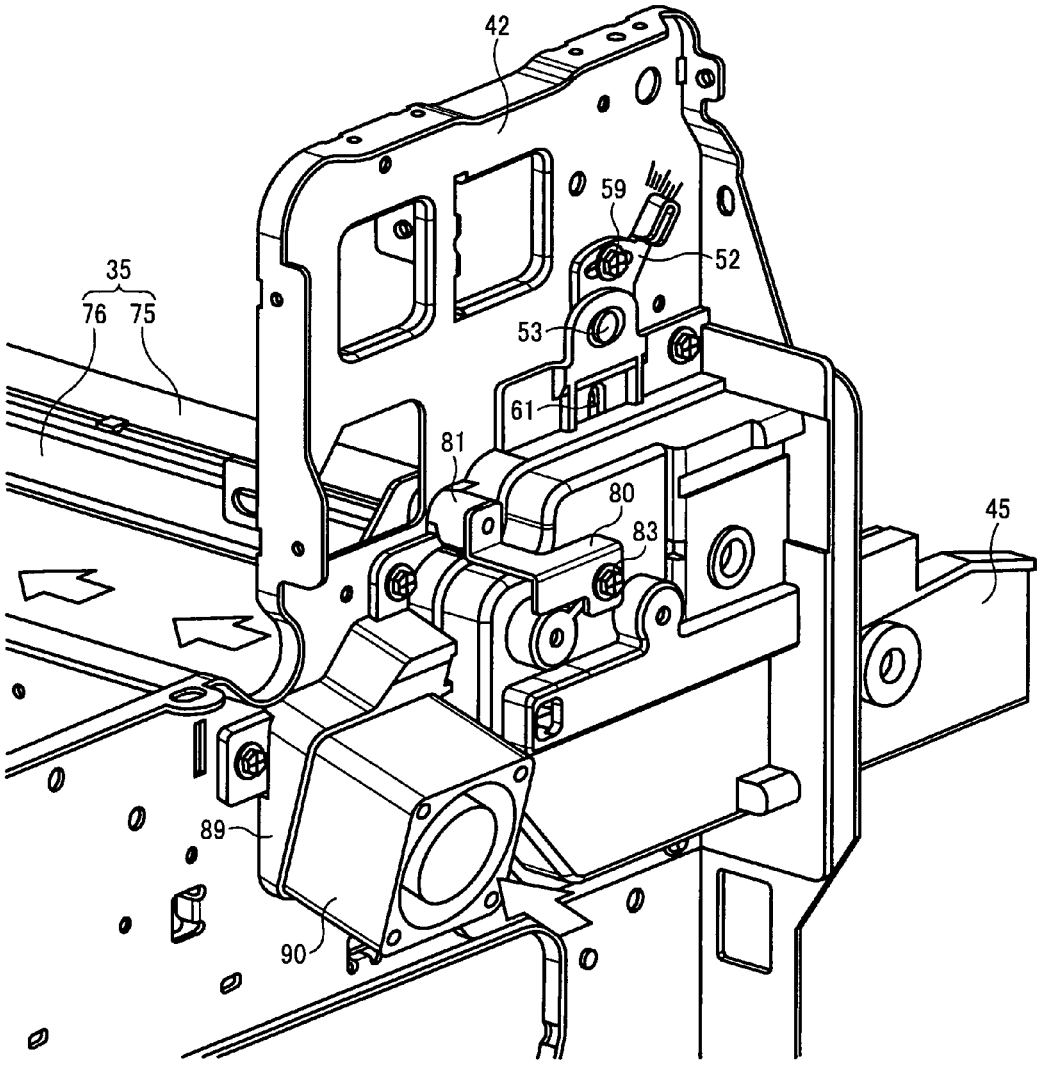
FIG. 18 is a schematic enlarged perspective view for explaining how a cooling fan is fitted into a fan receptacle in the front unit holder depicted in FIG. 17.

FIG. 18 is a schematic enlarged perspective view for explaining how a cooling fan 90 is fitted into the fan receptacle 89 of the front unit holder 45.

Figure 19:
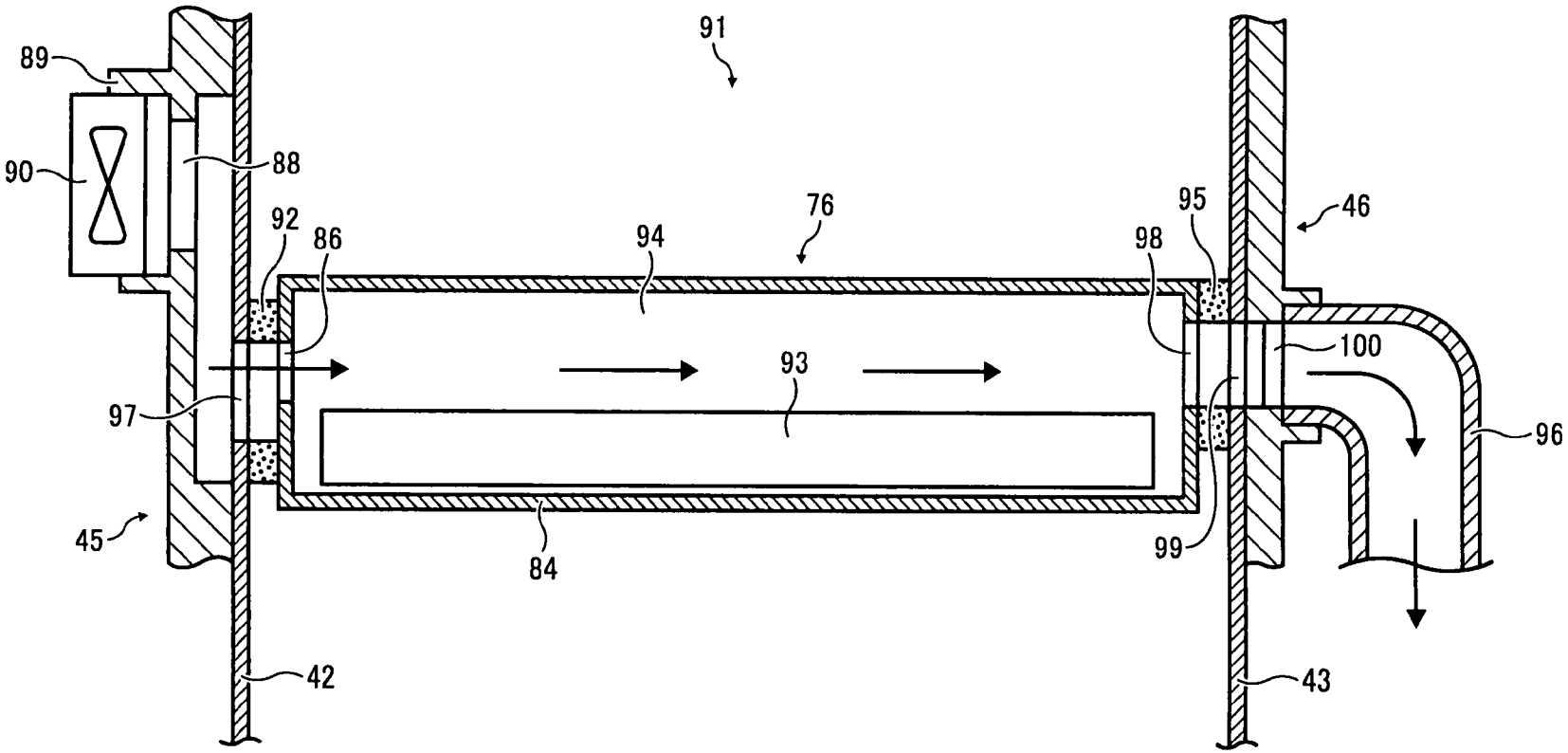
FIG. 19 is a schematic side view of a cooling device that performs cooling by using a cooling fan depicted in FIG. 18.

FIG. 19 is a schematic side view of a cooling device 91 that performs cooling by using the cooling fan 90.

The front unit holder 45 is attached to the first upright panel 42 from the front side. The cooling fan 90 is fitted into the fan receptacle 89 of the front unit holder 45. The front surface of the IH device 76 is urged to abut on the interior surface of the first upright panel 42 via a sealing member 92. The heating coil 93 is housed in the IH device 76. An air passage 94 is also defined in the IH device 76. The rear surface of the IH device 76 is urged to abut on the interior surface of the second upright panel 43 via a sealing member 95. The rear unit holder 46 is attached to the second upright panel 43 from the rear side. An air outlet duct 96 is connected to the rear unit holder 46.

To improve efficiency of heat generation by the fixing roller 77, the heating coil 93 is cooled while the IH device 76 is operated. More specifically, the cooling fan 90 is driven to introduce outside air through the air intake opening 88 of the front unit holder 45 into a space between the front unit holder 45 and the rear unit holder 46. This air then enters the air passage 94 through an air inlet port 97 and the through the air inlet 86 to cool the heating coil 93 in the IH device 76, and exits the air passage 94 through an air outlet 98. Subsequently, the air enters the air outlet duct 96 through an air outlet port 99 and then through an air exit port 100 in the rear unit holder 46.

Figure 20:
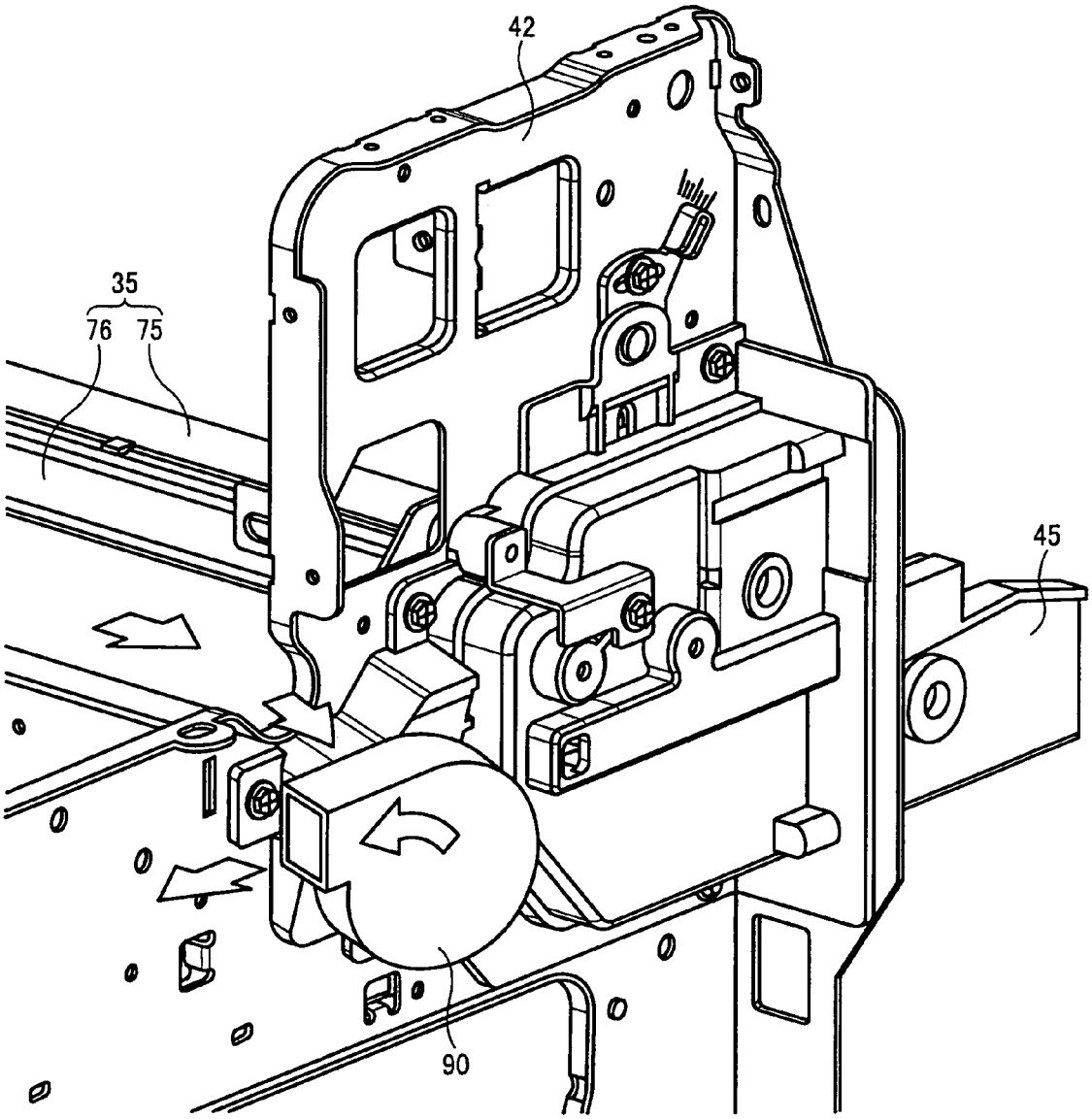
FIGS. 20 and 21 depict examples in each of which a sirocco fan is used as the cooling fan depicted in FIG. 18.
Figure 21:
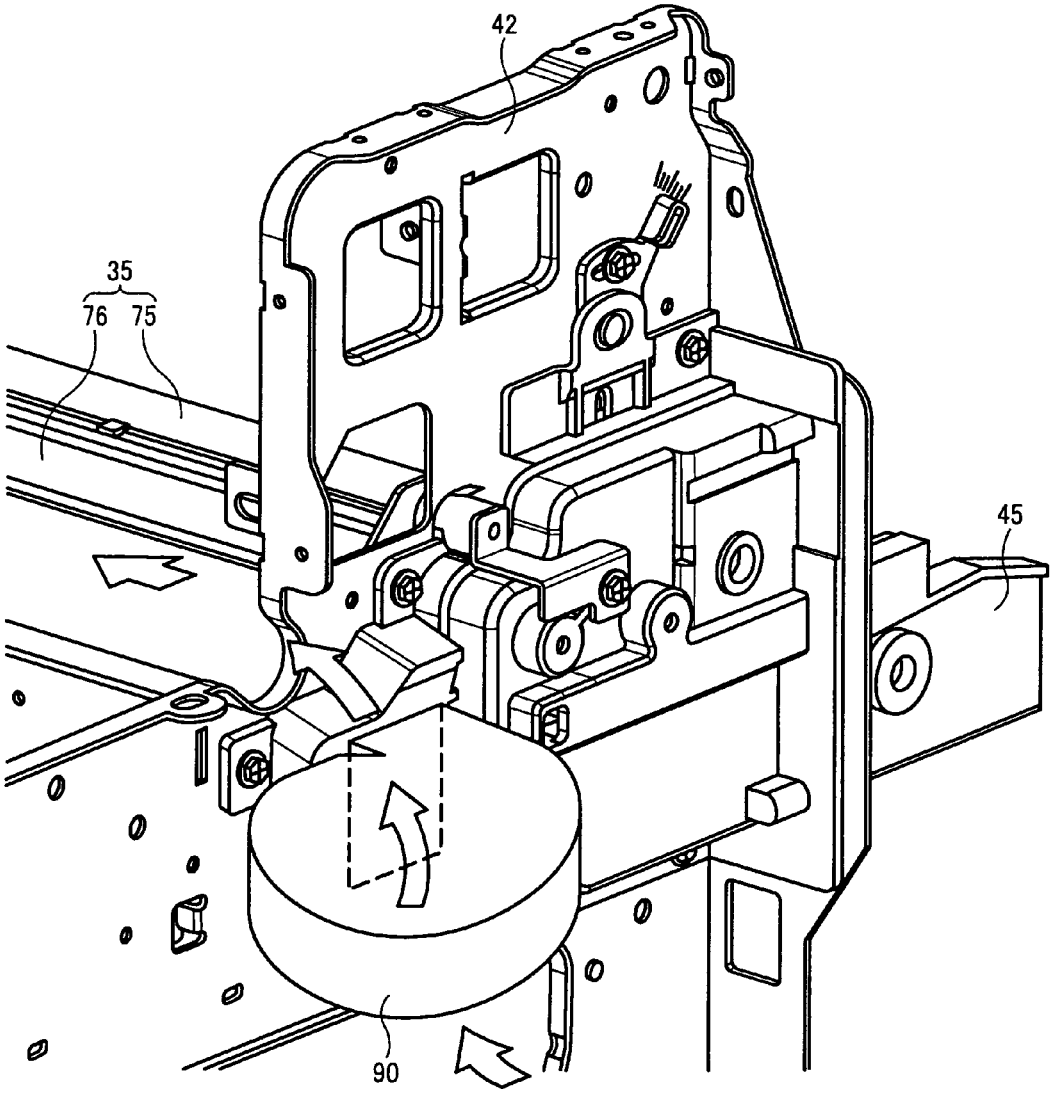

In this example, a suction fan that introduces outside air into the air passage 94 of the IH device 76 is used as the cooling fan 90. Alternatively, an exhaust fan that expels air from inside the air passage 94 can be used in place of the air suction fan. Further alternatively, both the suction fan and the exhaust fan can be used. Although the cooling fan 90 in the depicted example is an axial fan, a sirocco fan can be used. FIGS. 20 and 21 depict examples in each of which a sirocco fan is used as the cooling fan 90.

Figure 22:
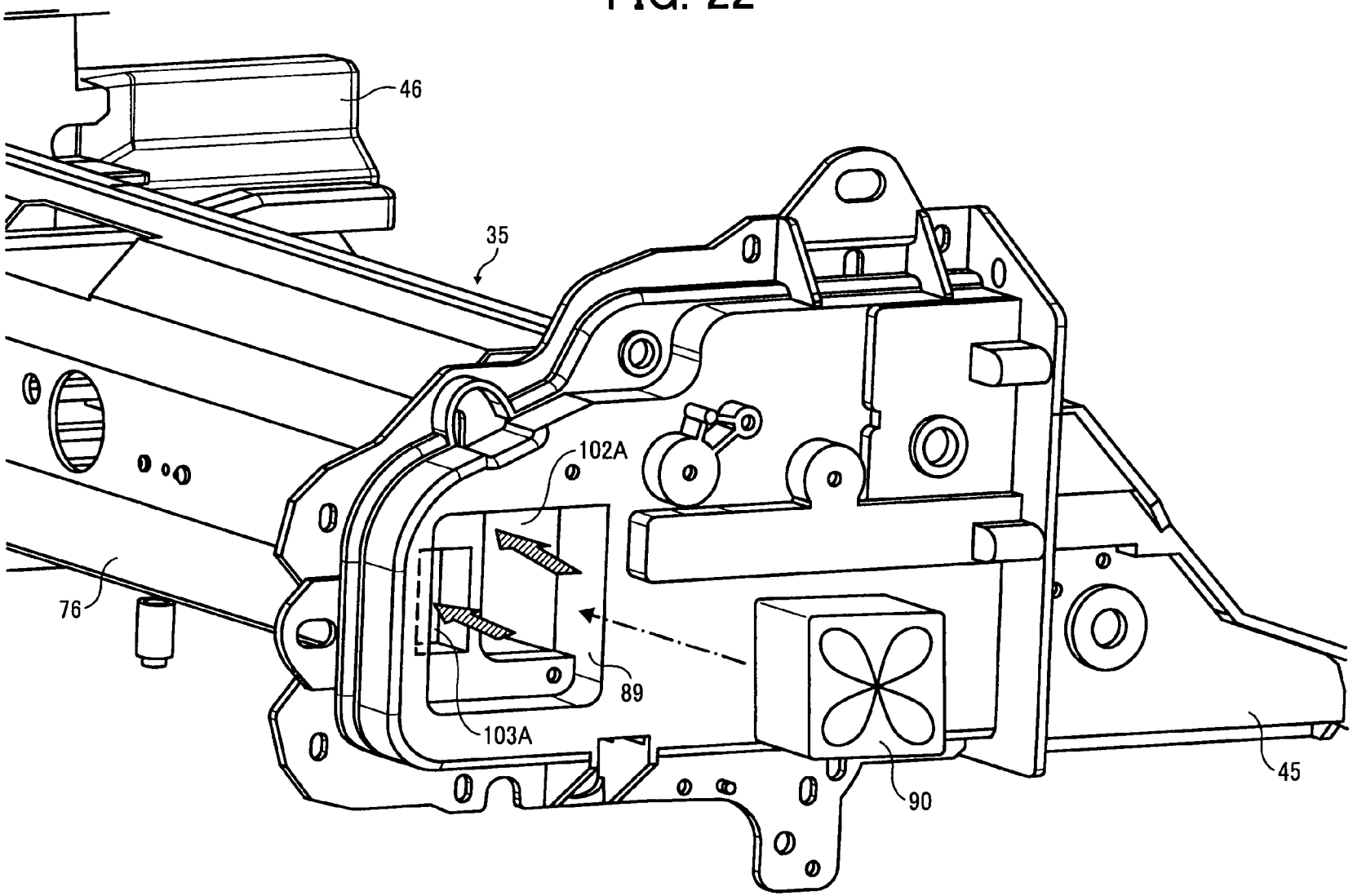
FIG. 22 is a schematic enlarged perspective view of a second IH-type fixing unit, which is a modification of the IH-type fixing unit depicted in FIG. 17.

FIG. 22 is a schematic enlarged perspective view of a second IH-type fixing unit that is a modification of the IH-type fixing unit 35. The second IH-type fixing unit is denoted by the same reference number as that of the IH-type fixing unit 35 described above, and referred to as "second IH-type fixing unit 35".

The second IH-type fixing unit 35 that includes the IH device 76 is supported by the front unit holder 45 and the rear unit holder 46. With this configuration, when any one of the front unit holder 45 and the rear unit holder 46 is moved for position adjustment, the IH device 76 is moved together with the unit body 75. The fan receptacle 89 for holding the cooling fan 90 therein is formed on the front unit holder 45. A first air passage 102 (see FIG. 25), which will be described later, is formed in the casing 84 of the IH device 76, and a second air passage 103 (see FIG. 25), which will be described later, is formed outside the casing 84. A first duct portion 102A that is connected to the first air passage 102 and a second duct portion 103A that is connected to the second air passage 103 are also formed in the front unit holder 45 for efficient air flow.

Figure 23:
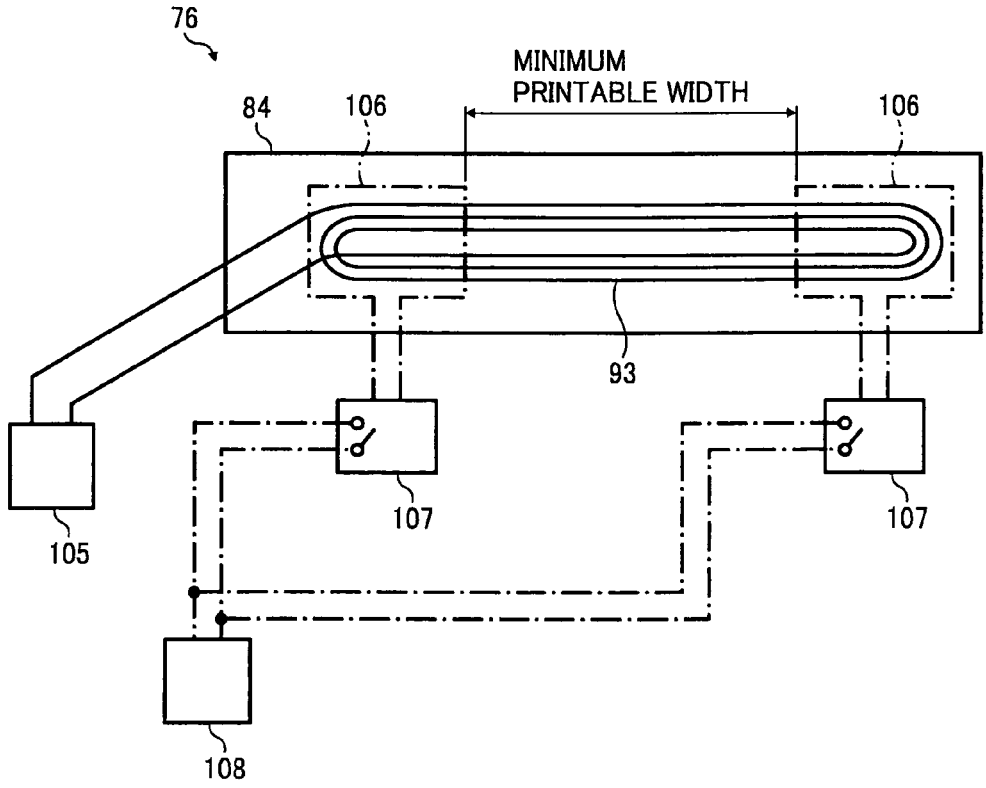
FIG. 23 is a schematic circuit diagram of an IH device of the second IH-type fixing unit depicted in FIG. 22.

FIG. 23 is a schematic circuit diagram of the IH device 76 of the second IH-type fixing unit 35.

The heating coil 93 is wound inside the IH device 76 such that a coiling direction of the heating coil 93 is parallel to a width direction of a recording medium S. Opposite ends of the heating coil 93 are connected to a power supply 105 that is dedicated to the heating coil 93 and arranged outside the casing 84. When a high-frequency AC voltage is applied from the power supply 105 across the heating coil 93, the heating coil 93 in turn generates a magnetic field that causes the IH layer of the fixing roller 77 to generate heat by electromagnetic induction.

Two demagnetizing coils 106 are arranged in the casing 84 outside an area through which a sheet of the recording medium S of a minimum printable width will pass through. Note that the number of the demagnetizing coils 106 is not limited to two, and the number of the demagnetizing coils 106 arranged in the casing 84 outside the area can be three or more. The demagnetizing coils 106 are connected to an input/output (I/O) board 108 via relays 107 at positions outside the casing 84. When the recording medium S to be subjected to fixing has the minimum printable width, the I/O board 108 turns on the relays 107 to cause the heating coil 93 to generate a magnetic field and simultaneously cause the magnetic field to induce an electric current in the demagnetizing coils 106 by electromagnetic induction. The induced electric current decreases the magnetic flux generated by the heating coil 93, which reduces an electric-current-flowing area of the IH layer. Hence, a heated area on the fixing roller 77 is narrowed to meet the size of the recording medium.

When the recording medium S to be subjected to fixing has a large printable width, the I/O board 108 turns off the relays 107. In this case, because an electric current is not induced in the demagnetizing coils 106, a heated area on the fixing roller 77 is not narrowed to meet the size of the recording medium S.

Figure 24:
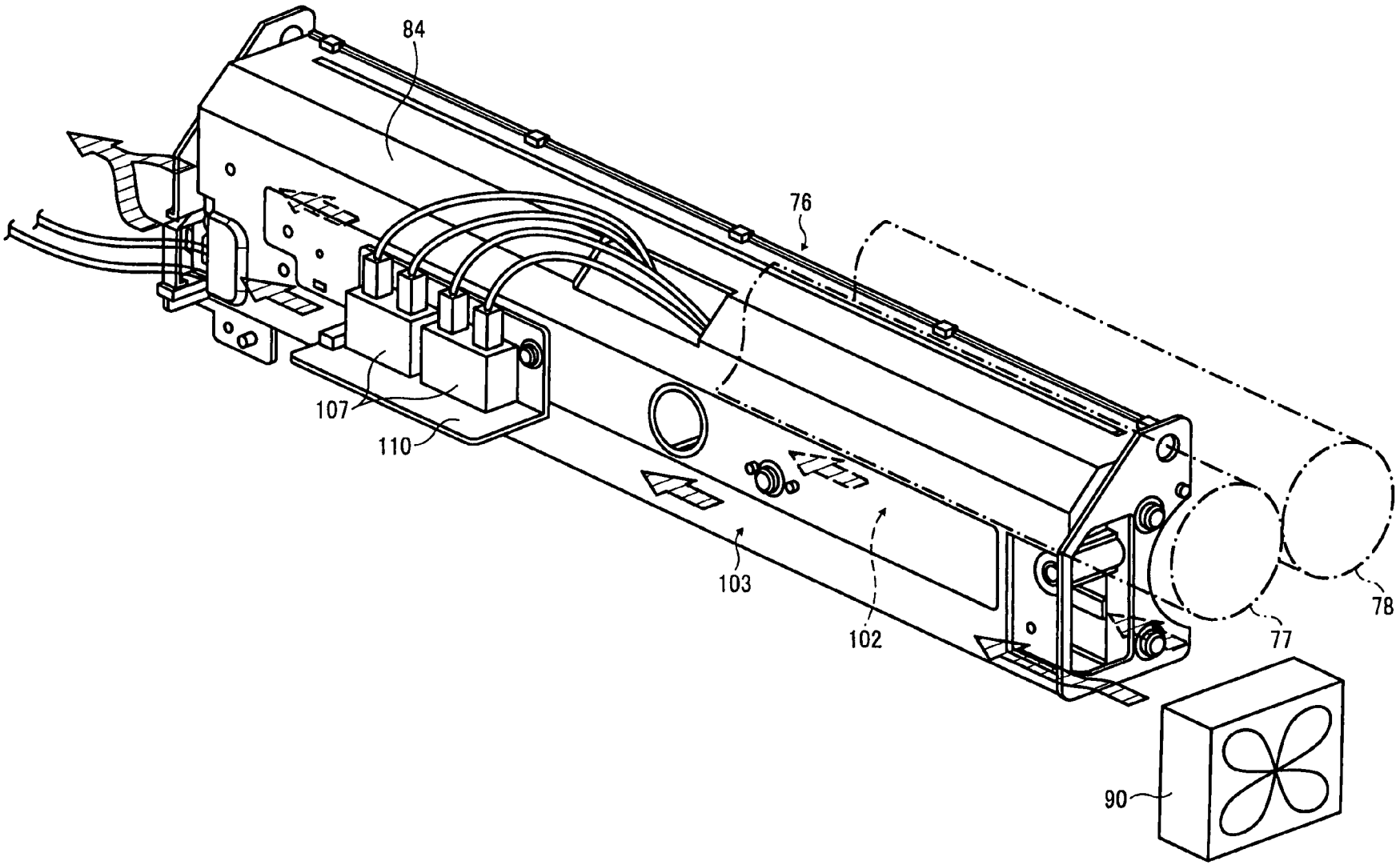
FIG. 24 is a schematic perspective view of the appearance of the IH device depicted in FIG. 23.

FIG. 24 is a schematic perspective view of the appearance the IH device 76.

The IH device 76 includes the heating coil 93 and the demagnetizing coils 106 in the casing 84. The relays 107 are mounted on a bracket 110 that is arranged outside the casing 84. Air inside the casing 84 flows in the first air passage 102 in a direction indicated by inside-hatched dotted arrows to cool the heating coil 93 and the demagnetizing coils 106. Air outside the casing 84 flows in the second air passage 103 in a direction indicated by inside-hatched solid arrows to cool the relays 107 to prevent malfunctioning of the relays 107.

Figure 25:
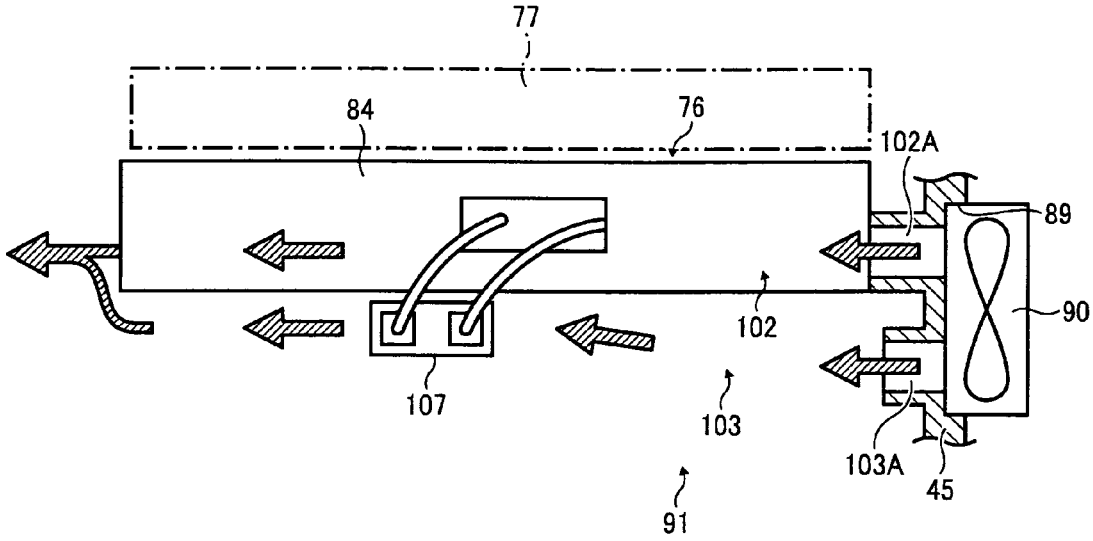
FIG. 25 is a schematic side view of a cooling device that includes the cooling fan depicted in FIG. 24.

FIG. 25 is a schematic side view of the cooling device 91.

When the cooling fan 90 attached in the fan receptacle 89 of the front unit holder 45 is driven, outside air is brought into the casing 84 through the first duct portion 102A. This air then collides against the heating coil 93 and the demagnetizing coils 106 to cool them while flowing through the first air passage 102, and exits the first air passage 102 on the side opposite from the first duct portion 102A. The cooling fan 90 also brings outside into the second air passage 103 through the second duct portion 103A. This air collides against the relays 107 while flowing through the second air passage 103 to cool the relays 107, and then exits the second air passage 103 on the side opposite from the second duct portion 103A.

Figure 26:
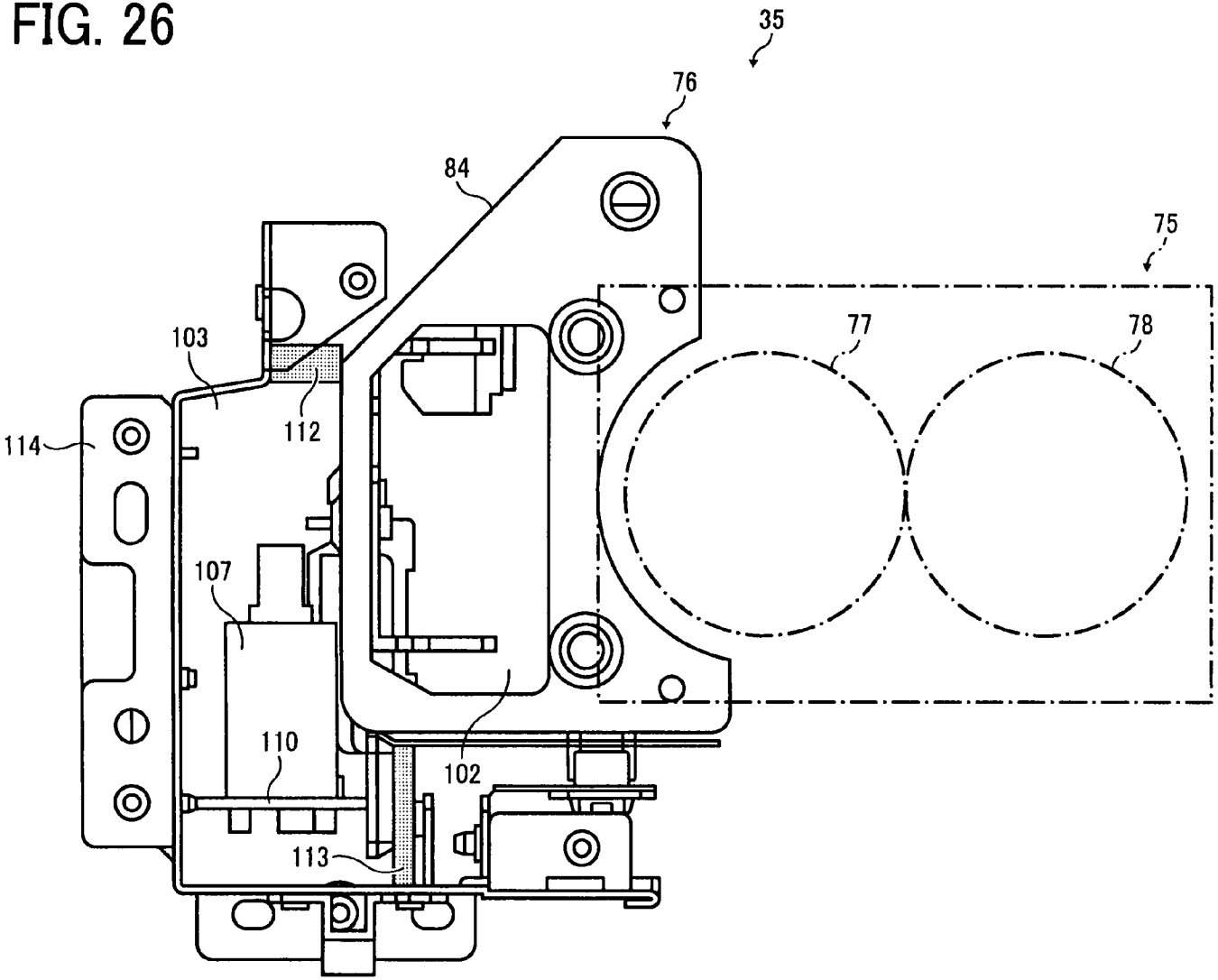
FIG. 26 is a schematic view for explaining how the second IH-type fixing unit depicted in FIG. 22 is attached to the copier.

FIG. 26 is a schematic view for explaining how the second IH-type fixing unit 35 is attached to the copier 1.

In the state of being attached to the copier 1, the second IH-type fixing unit 35 is pressed against a stay 114 via sealing members 112 and 113. The stay 114 extends across the first upright panel 42 and the second upright panel 43. The second air passage 103 is a space enclosed by the casing 84 and the stay 114, with gaps between the casing 84 and the stay 114 sealed with the sealing members 112 and 113.

Also in the modification depicted in FIGS. 22 to 26, similar to the example described above, an exhaust fan can be arranged as the cooling fan 90 on an air-exhaust side in place of arranging the suction fan on the air-suction side depending on a thermal condition inside the casing 84 or the copier 1. Further alternatively, both the suction fan and the exhaust fan can be used by arranging the suction fan on the air-suction side and the exhaust fan on the air-exhaust side.

Demands for less-space-consuming image forming apparatuses that fit in recent space-saving offices have increased. To meet these demands, image forming apparatuses that convey a recording medium in a portrait orientation (short edge feed) as described above have become dominant. In such an image forming apparatus, jam of a recording medium S generally occurs at a position between the registration rollers 21 and the fixing unit 35 depicted in FIG. 2. The jammed recording medium S is typically removed by pulling an upper portion of the duplex unit 7 to open. The copier 1 is configured such that when the duplex unit 7 is opened, the fixing roller 36 is released from pressure contact with the pressure roller 39, causing the jammed recording medium S to jut above the fixing unit 35 to be removed by being pulled upward.

Meanwhile, because the fixing unit 35 contains the heating roller 37, heat is generally trapped in the fixing unit 35. The heat also heats a portion of the structure frame 40 near the fixing unit 35 and the conveying rollers 23 above the fixing unit 35. Accordingly, when removing the jammed recording medium S caught in the fixing unit 35, an operator can touch a hot surface that can result in a burn.

Figure 27:
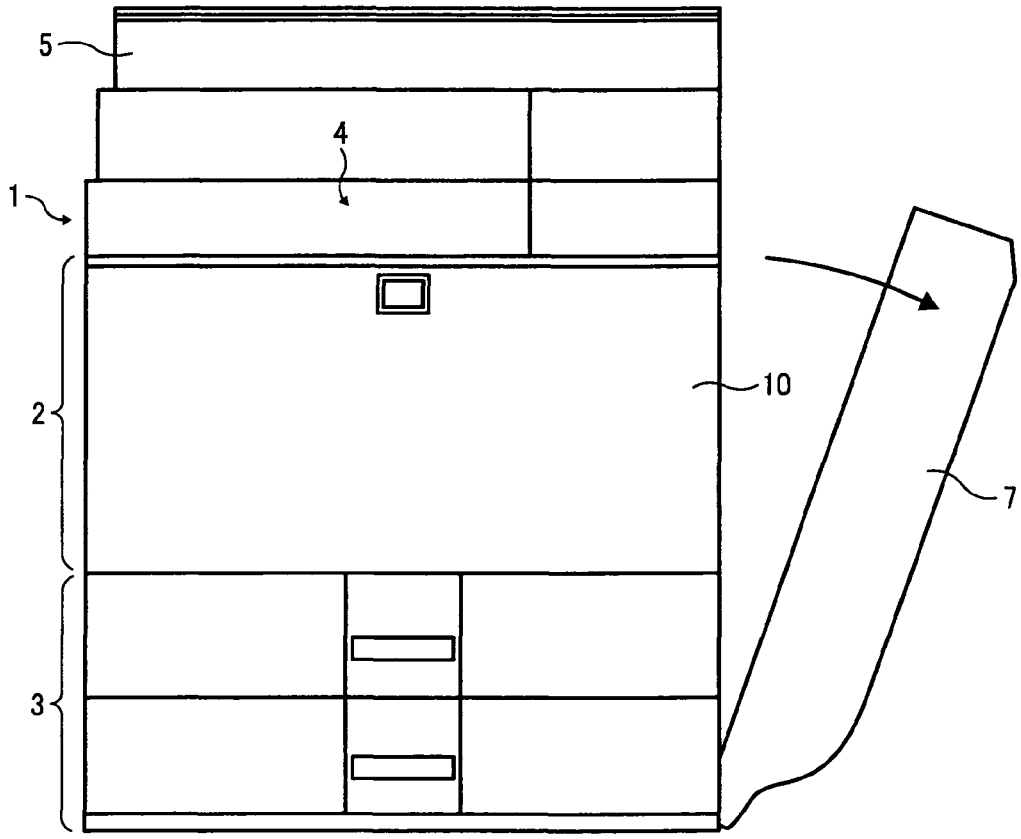
FIG. 27 is a schematic front view of the copier depicted in FIG. 1 with a duplex unit open relative to the copier.

To this end, such a short-edge-feeding type copier as described above is typically configured as follows. The duplex unit 7 which also functions as an outer cover can be opened to permit pulling out the fixing unit 35 from the copier 1. FIG. 27 is a schematic front view of the copier 1 with the duplex unit 7 open relative to the copier 1.

Figure 28:
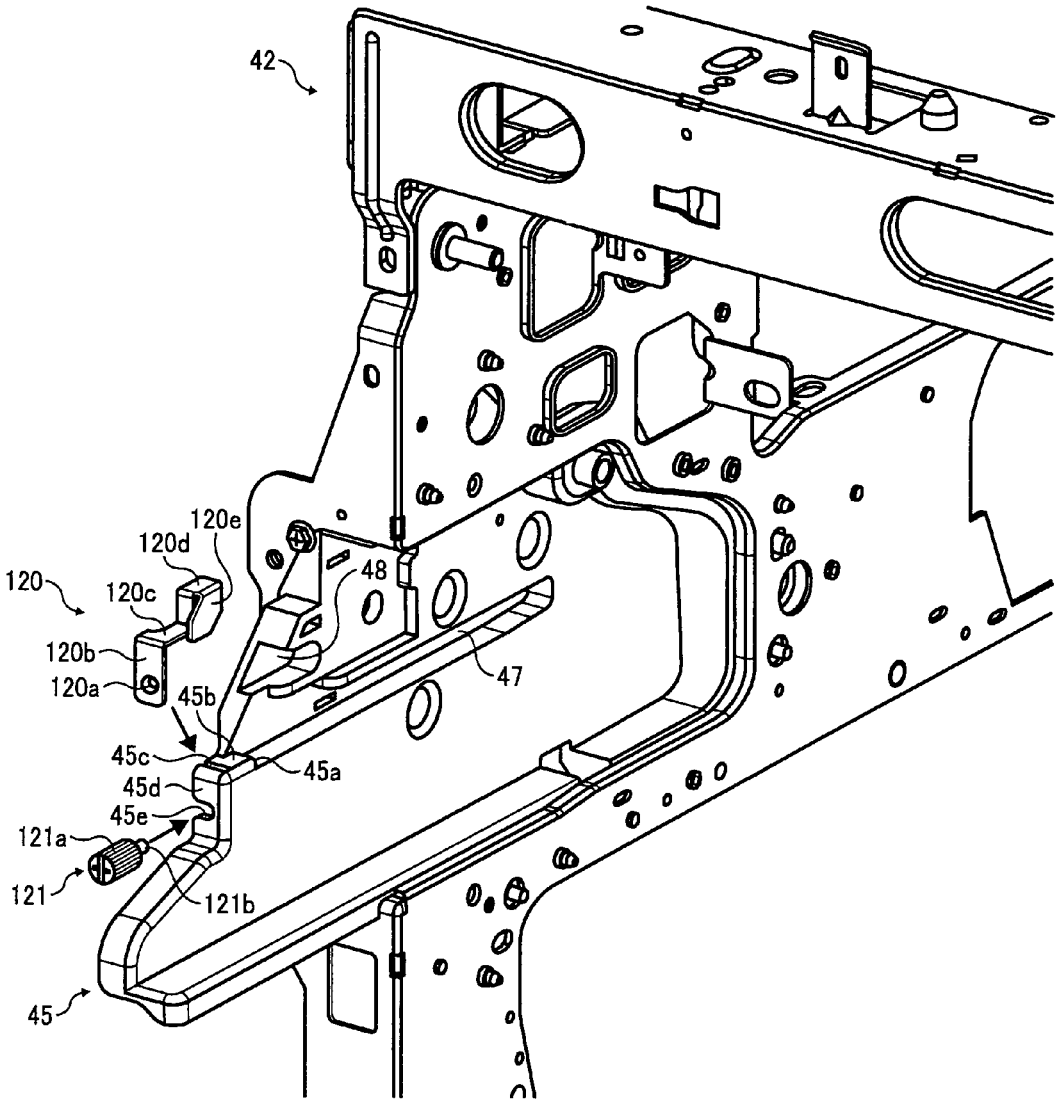
FIG. 28 is a schematic enlarged perspective view of a portion of an exemplary structure of a structure frame with which the fixing unit can be pulled out of the copier and retained at a jam-removing position.

A structure frame with which the fixing unit 35 can be pulled out of the copier 1 and retained at a jam-removing position will be described. This structure frame is denoted by the same reference number as that of the structure frame 40 described above. FIG. 28 is a schematic enlarged perspective view of a portion where the front unit holder 45 is attached to the first upright panel 42 of the structure frame 40.

Similar to the structure frame 40 described above, the primary groove 47 and the secondary groove 48 that are defined in the front unit holder 45 as guides and extend linearly, or in a curved manner, to be parallel to each other. The primary groove 47 and the secondary groove 48 guide sliding motion of the fixing unit 35 into and out of the copier 1. The secondary groove 48 is shorter than the primary groove 47.

On the front unit holder 45 of this configuration, a small step portion 45*a* is arranged on a lower internal surface of the primary groove 47 at an entrance of the primary groove 47. The top surface of the step portion 45*a* slopes downward by a small distance toward a deep (left) end of the lower internal surface. A mount base portion 45*b* is arranged so as to receive a stopper 120 on a top surface of the mount base portion 45*b*. An insertion groove 45*c* that is open toward the front is arranged between an outer (right) edge of the mount base portion 45*b* and an edge member portion 45*d*. The edge member portion 45*d* is arranged at a further front position relative to the mount base portion 45*b*. A retainer-receiving groove 45*e* is defined in the edge member portion 45*d*. The retainer-receiving groove 45*e*, into which a retainer 121 is to be fit, is also open toward the front.

The stopper 120 is formed by bending an elongated plate into a staircase shape. The stopper 120 includes an attaching plate portion 120*b* in which a threaded hole 120*a* is defined, a mount plate portion 120*c*, and a stopper plate portion 120*d*. The mount plate portion 120*c* extends from an end of the attaching plate portion 120*b* to form the right angle therewith. The stopper plate portion 120*d*, which is L-shaped, extends from the mount plate portion 120*c* to form the right angle therewith and then extends parallel to the mount plate portion 120*c*. A side plate portion 120*e* extends downward from one side of the stopper plate portion 120*d*. The retainer 121 includes a knob portion 121*a* and a threaded portion 121*b*.

Figure 29:
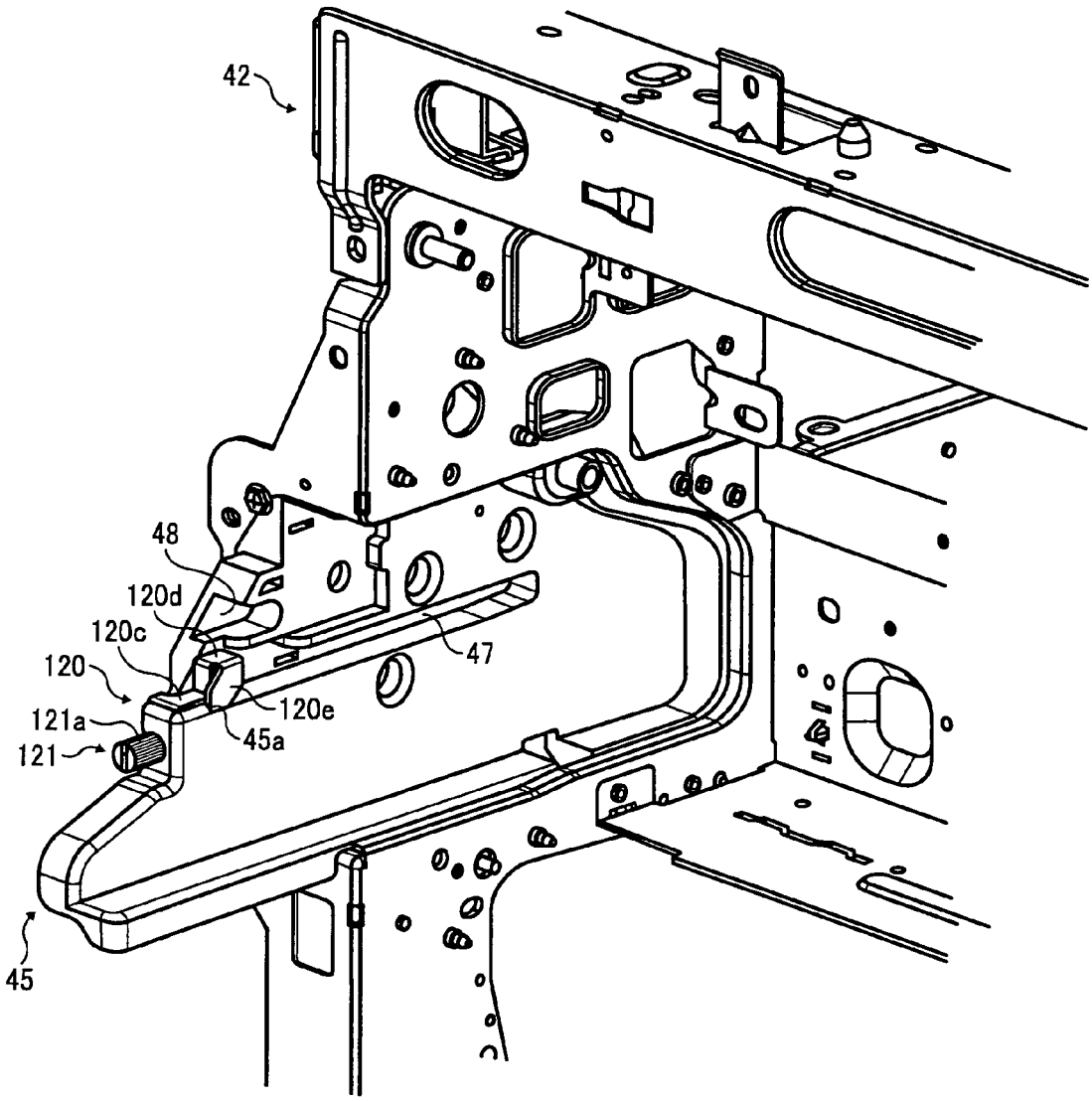
FIG. 29 is a schematic enlarged perspective view of the same portion as that depicted in FIG. 28 in a state in which a stopper has been attached to the front unit holder with a retainer.

FIG. 29 is a schematic enlarged perspective view of the same portion as that depicted in FIG. 28 in a state in which the stopper 120 has been attached to the front unit holder 45 by using the retainer 121.

The stopper 120 is attached to the front unit holder 45 as follows. The attaching plate portion 120*b* is inserted from the front side into the insertion groove 45*c* such that the attaching plate portion 120*b* is positioned on an interior side relative to the edge member portion 45*d*. At this time, the mount plate portion 120*c* is placed on the mount base portion 45*b*, the stopper plate portion 120*d* is positioned at the entrance of the primary groove 47, and the side plate portion 120*e* abuts, at one side surface of its lower end portion, on the step portion 45*a*. By inserting the threaded portion 121*b* into the retainer-receiving groove 45*e* through the threaded hole 120*a*, the stopper 120 can be securely fixed to the front unit holder 45 with the retainer 121.

Figure 30:
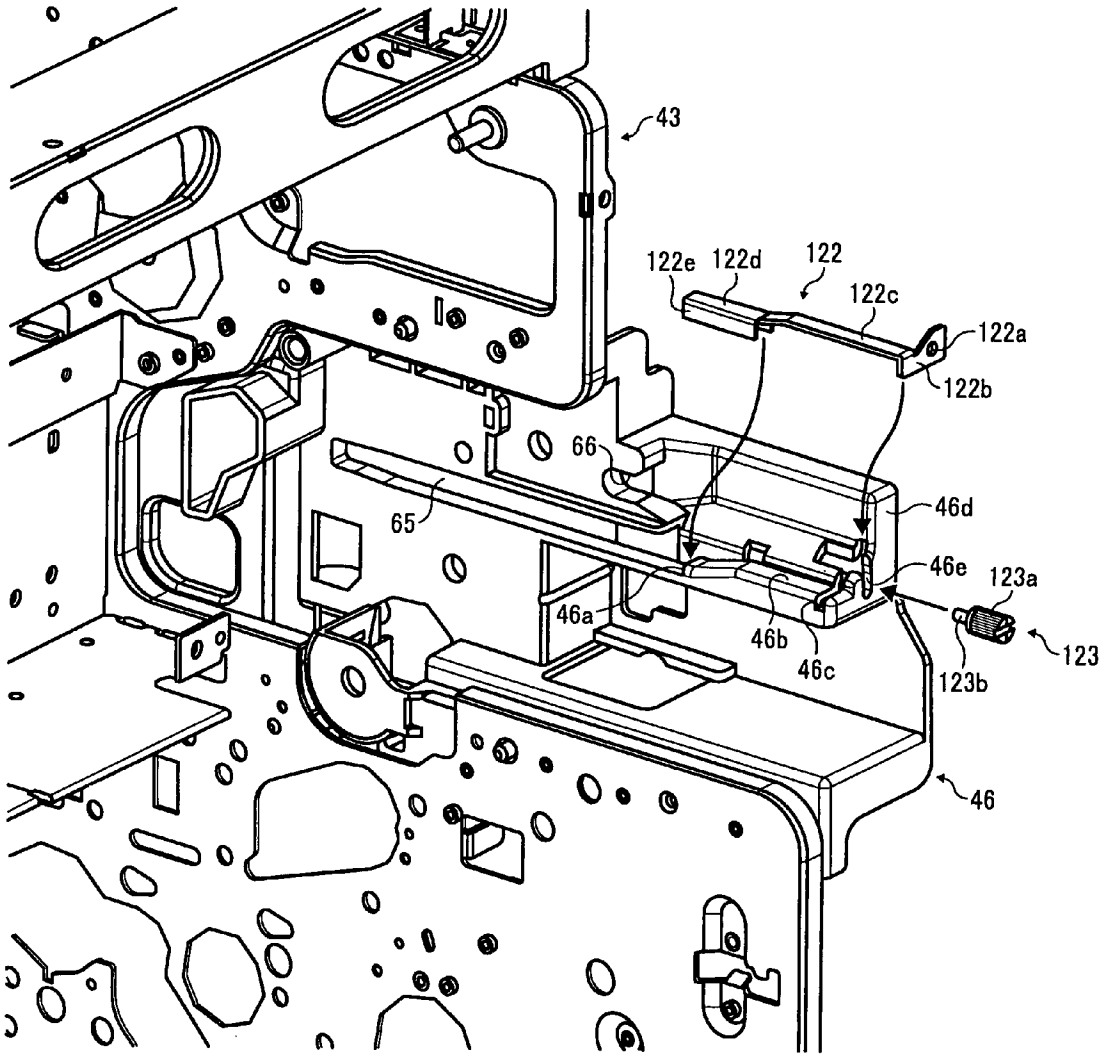
FIG. 30 is a schematic enlarged perspective view of a portion of the structure frame where the rear unit holder is attached to the second upright panel.

FIG. 30 is a schematic enlarged perspective view of a portion of the structure frame 40 where the rear unit holder 46 is attached to the second upright panel 43.

Similar to the configuration described above, the rear unit holder 46 is attached to the second upright panel 43. The primary groove 65 and the secondary groove 66 corresponding to the primary groove 47 and the secondary groove 48 in the above description, respectively, are defined in the rear unit holder 46. The primary groove 65 extends linearly, or in a curved manner, parallel to the secondary groove 66 that is shorter than the primary groove 65.

A small step portion 46*a*, which is similar but not identical with the step portion 45*a*, is formed on a lower internal surface of the primary groove 65 at an entrance of the primary groove 65. The top surface of the step portion 46*a* slopes downward by a small distance toward a deep (left) end of the lower internal surface. A mount base portion 46*b* is arranged so as to receive a stopper 122 on a top surface of the mount base portion 46*b*. An insertion groove 46*c* that is open toward the front is arranged between an outer (right) edge of the mount base portion 46*b* and an edge member portion 46*d*. The edge member portion 46*d* is arranged at a further front position relative to the mount base portion 46*b*. A retainer-receiving groove 46*e* is defined in the edge member portion 46*d*. The retainer-receiving groove 46*e*, into which a retainer 123 is to be fit, is also open toward the front.

The stopper 122, which is similar but not identical with the stopper 120, is formed by bending an elongated plate into a staircase shape. The stopper 122 includes an attaching plate portion 122*b* in which a threaded hole 122*a* is defined, a mount plate portion 122*c*, and a stopper plate portion 122*d*. The mount plate portion 122*c* extends from an end of the attaching plate portion 122*b* to form the right angle therewith. The stopper plate portion 122*d* extends at a small angle relative to the mount plate portion 122*c* and then extends parallel to the mount plate portion 122*c*. Side plate portions 122*e* extend downward from two sides, parallel to the primary groove 65, of the stopper plate portion 122*d*. The retainer 123 includes a knob portion 123*a* and a threaded portion 123*b* in the same manner as the retainer 121 does.

Figure 31:
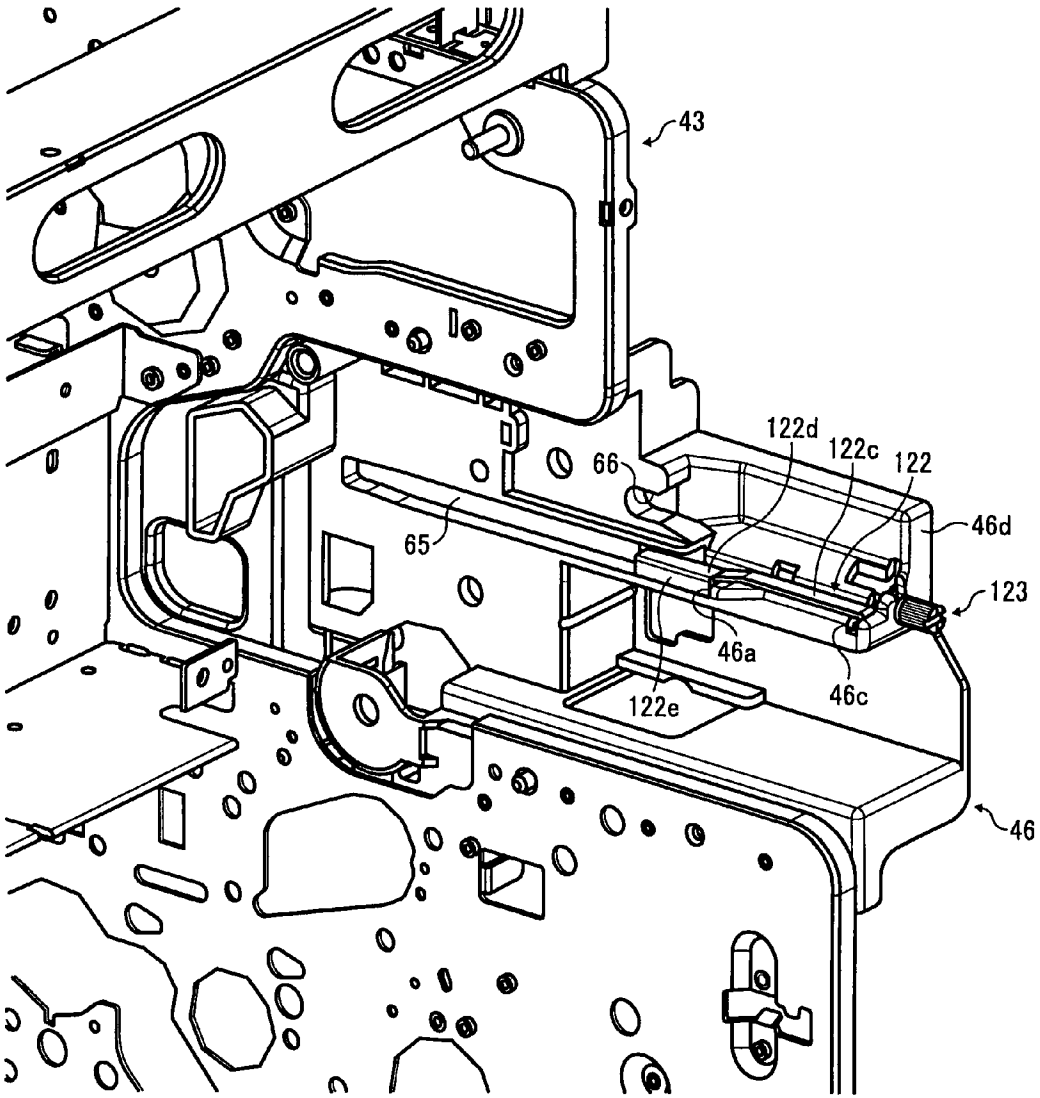
FIG. 31 is a schematic enlarged perspective view of the same portion as that depicted in FIG. 30 in a state in which a stopper has been attached to the rear unit holder with a retainer.

FIG. 31 is a schematic enlarged perspective view of the same portion as that depicted in FIG. 30 in a state in which the stopper 122 has been attached to the rear unit holder 46 with the retainer 123.

The stopper 122 is attached to the rear unit holder 46 as follows. The attaching plate portion 122*b* is inserted from the front side into the insertion groove 46*c* such that the attaching plate portion 122*b* is positioned on an interior side relative to the edge member portion 46*d*. At this time, the mount plate portion 122*c* is placed on the mount base portion 46*b*, the stopper plate portion 122*d* is positioned at the entrance of the primary groove 65, and the side plate portion 122*e* abuts, at one side surface of its lower end portion, on the step portion 46*a*. By inserting the threaded portion 123*b* into the retainer-receiving groove 46*e* through the threaded hole 122*a*, the stopper 122 can be fixed securely to the rear unit holder 46 with the retainer 123.

Figure 32:
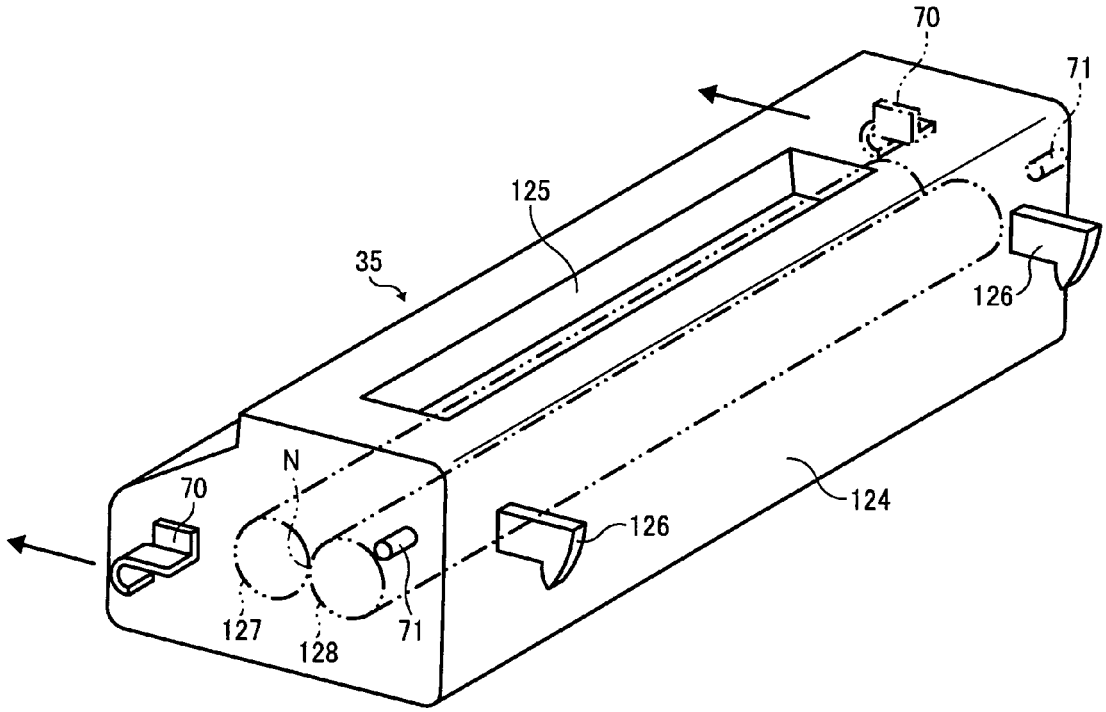
FIG. 32 is a schematic perspective view of a fixing unit to be attached to the structure frame that includes the front unit holder depicted in FIG. 28.

FIG. 32 is a schematic perspective view of a fixing unit to be attached to the structure frame 40 that includes the front unit holder 45 depicted in FIG. 28. The fixing unit will be denoted by the same reference number as that of the fixing unit 35 described above.

The fixing unit 35 includes an elongated casing 124, a recording-medium receiving port defined in a bottom surface of the elongated casing 124 (not shown), a recording-medium discharging port 125 defined in a top surface of the elongated casing 124, and grips 126. The fixing unit 35 receives a recording medium S onto which an image has been transferred through the recording-medium receiving port. One of the grips 126, which are spaced from each other, is formed on a front portion and the other is formed on a rear portion of a right surface of the elongated casing 124. As in the fixing unit 35 depicted in FIG. 9, the primary protrusion 70 and the secondary protrusion 71 are formed on each of a front surface and a rear surface of the elongated casing 124 as guides that guide sliding motion of the fixing unit 35 into and out of the copier 1. A fixing roller 127 and a pressure roller 128 are arranged inside the elongated casing 124. The fixing roller 127 includes a heat source inside the fixing roller 127 or near the fixing roller 127. The fixing roller 127 comes into pressure contact with the pressure roller 128 to form a fixing nip N.

Figure 33:
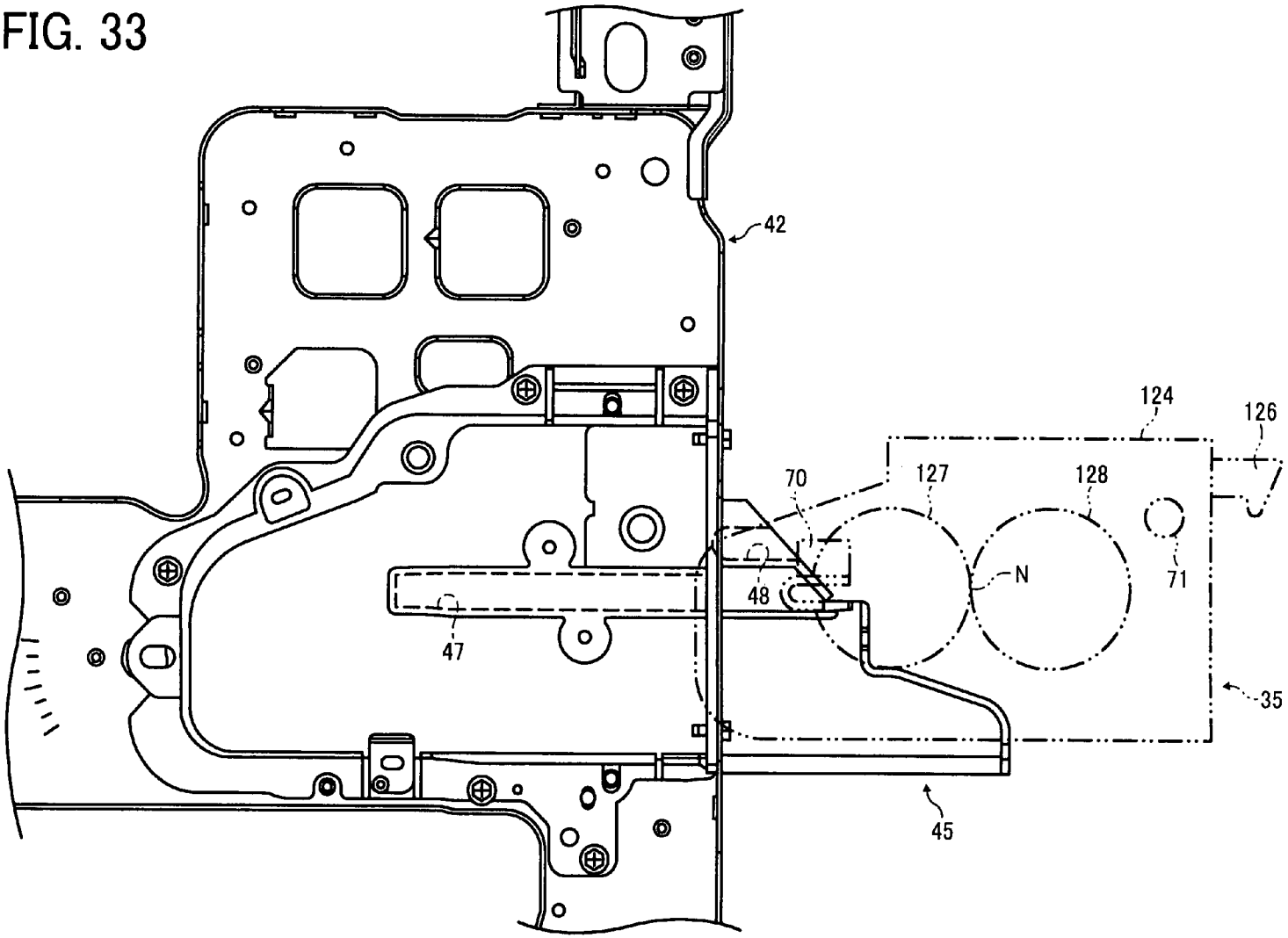
FIG. 33 is a schematic front view of the fixing unit that is being inserted to an installed position between the front unit holder and the rear unit holder.

FIG. 33 is a schematic front view of the fixing unit 35 that is being inserted to an installed position between the front unit holder 45 and the rear unit holder 46.

The fixing unit 35 is held by the grips 126 with two hands and inserted into the copier 1 so that corresponding engaging members engage with each other. More specifically, the fixing unit 35 is inserted into the copier 1 so that the primary protrusion 70 and the secondary protrusion 71 on the front surface of the fixing unit 35 are fitted into the primary groove 47 and the secondary groove 48 in the front unit holder 45, respectively, and the primary protrusion 70 and the secondary protrusion 71 on the rear surface of the fixing unit 35 are fitted into the primary groove 65 and the secondary groove 66 in the rear unit holder 46, respectively.

Figure 34:
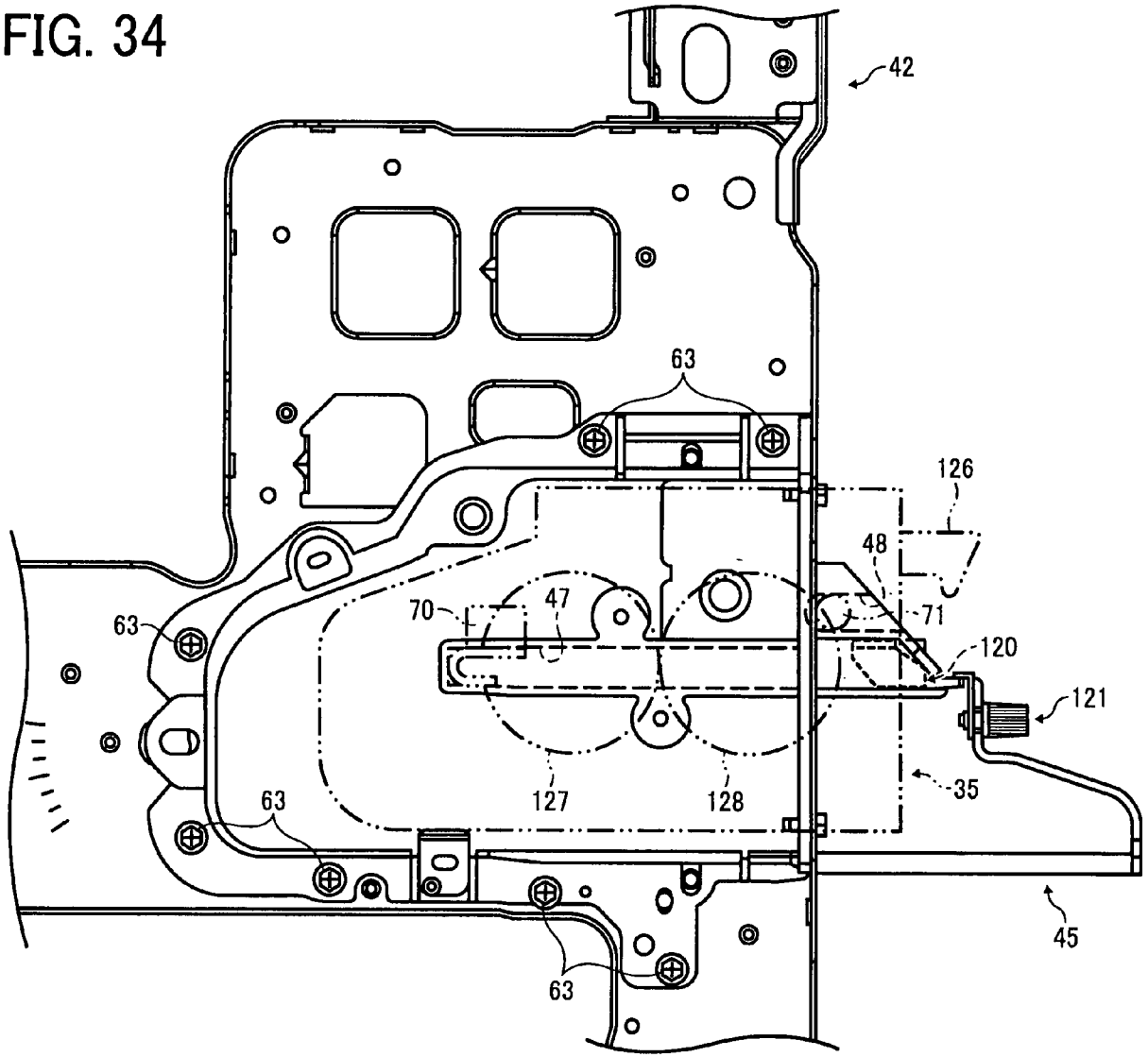
FIG. 34 is a schematic front view of the fixing unit at the installed position.

FIG. 34 is a schematic front view of the fixing unit 35 that is at the installed position between the front unit holder 45 and the rear unit holder 46.

As depicted in FIG. 33, the fixing unit 35 that is inserted into the primary grooves 47 and 65 and the secondary grooves 48 and 66 is moved in a sliding manner until the primary protrusions 70 abut on deep (left) ends of the primary grooves 47 and 65 and the secondary protrusions 71 abut on deep (left) ends of the secondary grooves 48 and 66. Hence, the fixing unit 35 is positioned to the installed position depicted in FIG. 34.

After the fixing unit 35 is positioned in this manner, the stopper 120 is attached to the entrance of the primary groove 47 with the retainer 121 as depicted in FIG. 29, and the stopper 122 is attached to the entrance of the primary groove 65 with the retainer 123 as depicted in FIG. 31. Fastening torques of the retainers 121 and 123 are desirably set such that the retainers 121 and 123 can be fastened easily by turning the knob portions 121*a* and 123*a* with fingers.

Figure 35:
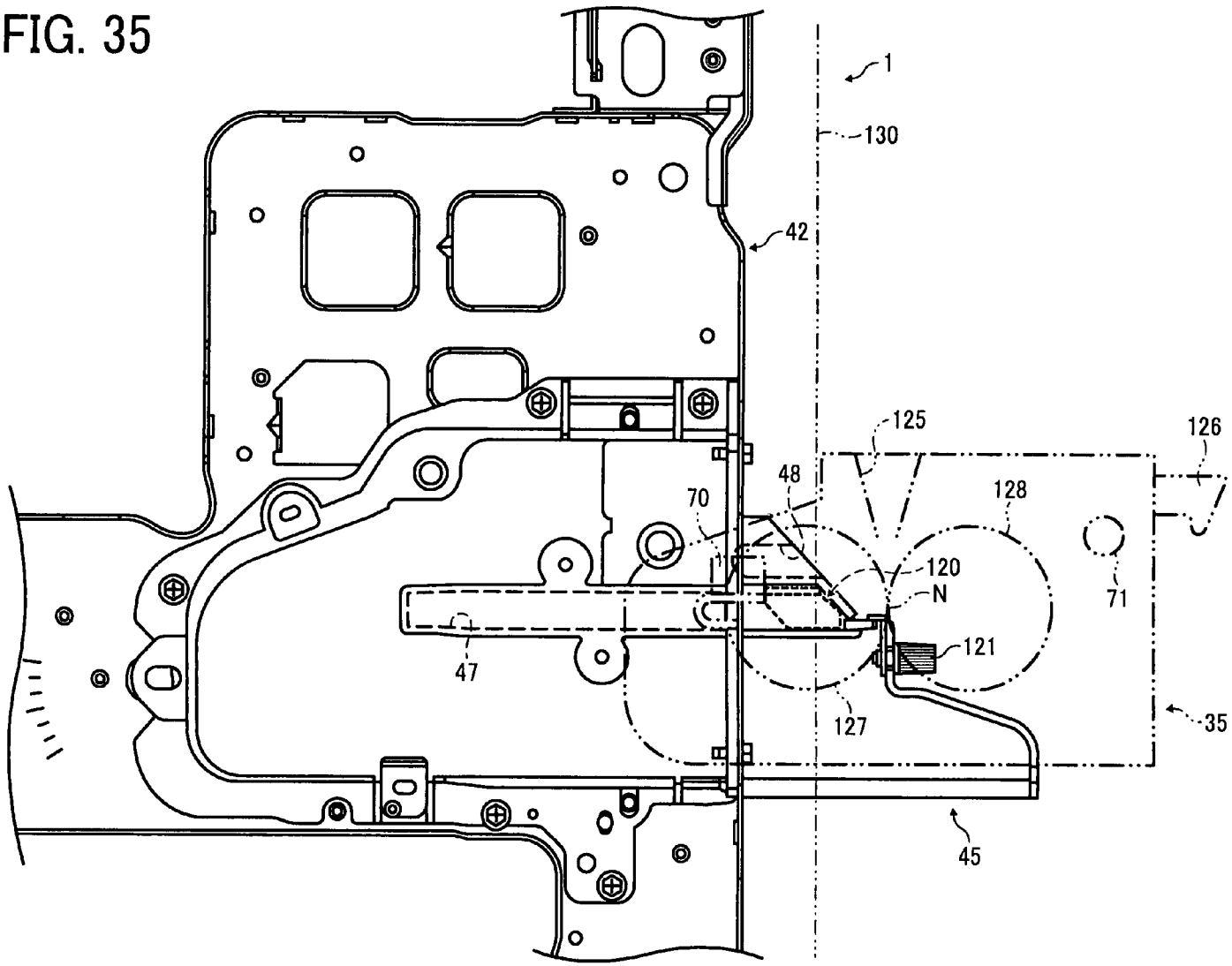
FIG. 35 is a schematic front view of the fixing unit that is pulled out to the jam-removing position for removal of a jammed recording medium.

FIG. 35 is a schematic front view of the fixing unit 35 that is pulled out of the copier 1 to the jam-removing position for removal of a jammed sheet of the recording medium S.

When the recording medium S is jammed during the course of being fed, first, the duplex unit 7 is opened as depicted in FIG. 27. More specifically, an upper portion of the duplex unit 7 is pulled outward by pivoting the duplex unit 7 about its pivot axis arranged at its lower portion. Second, the fixing unit 35 is held by the grips 126 and pulled outward in the second direction that is orthogonal to the longitudinal direction of the fixing unit 35 as depicted in FIG. 35. When the fixing unit 35 is being pulled out, the primary grooves 47 and 65 and the secondary grooves 48 and 66 guide the sliding motion of the fixing unit 35.

Figure 36A:
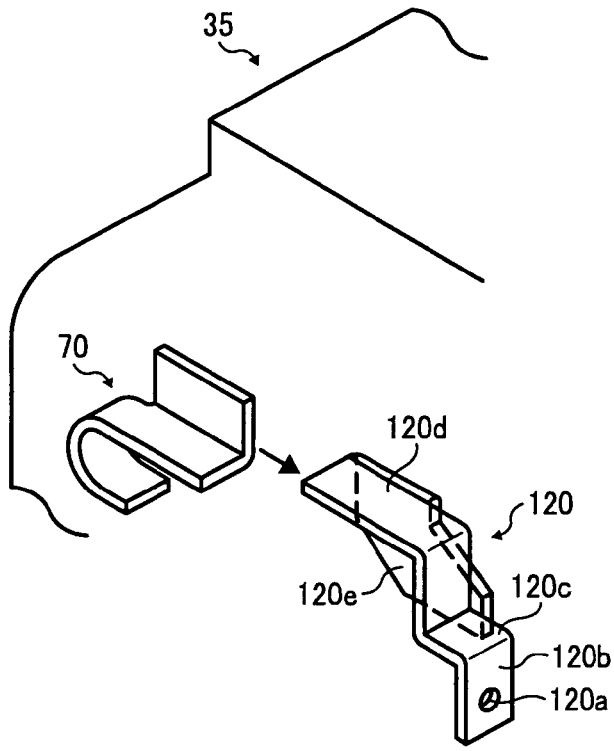
FIG. 36A is a schematic perspective view for explaining a positional relationship between a primary protrusion and a stopper on the front side in a state where the fixing unit depicted in FIG. 35 is not pulled out yet.
Figure 36B:
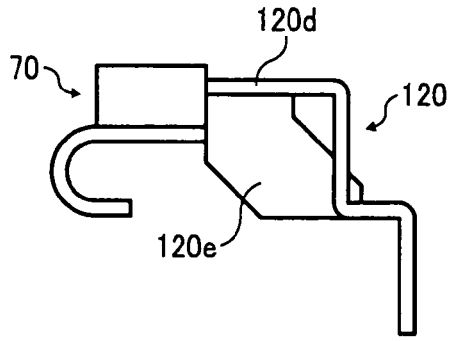
FIG. 36B is a schematic side view for explaining a positional relationship between the same components as depicted in FIG. 36A in a state where the fixing unit has been pulled out.

FIG. 36A is a schematic perspective view for explaining a positional relationship between the primary protrusion 70 on the front side and the stopper 120 in a state where the fixing unit 35 is not pulled out yet. FIG. 36B is a schematic side view for explaining a positional relationship between the same in a state where the fixing unit 35 is pulled out to the jam-removing position.

The primary protrusion 70 on the front side is away from the stopper 120 when the fixing unit 35 is not pulled out yet (hereinafter, "stopper-away state"). On the other hand, the primary protrusion 70 on the front side abuts on the stopper plate portion 120*d* and the side plate portion 120*e* of the stopper 120 when the fixing unit 35 has been pulled out to the jam-removing position (hereinafter, "stopper-abutting state"). Although not shown, similarly, the primary protrusion 70 on the rear side of the fixing unit 35 and the stopper 122 are away from each other when the fixing unit 35 is not pulled out yet, while the primary protrusion 70 abuts on the stopper plate portion 122*d* and the side plate portion 122*e* of the stopper 122 when the fixing unit 35 has been pulled out.

In the stopper-abutting state, as depicted in FIGS. 29 and 31, the one side surfaces of the lower end portions of the side plate portions 120*e* and 122*e* abut on the step portions 45*a* and 46*a*, respectively, and simultaneously the end surfaces of the primary protrusions 70 abut on the stoppers 120 and 122 so as to exert forces on the stoppers 120 and 122 in a shear direction. This configuration makes the stoppers 120 and 122 and the primary protrusions 70 to be less easily deformed by this abutting. Accordingly, the stoppers 120 and 122 and the primary protrusions 70 are relatively resistant to impacts that can be imparted on the stoppers 120 and 122 and the primary protrusions 70 when the fixing unit 35 is pulled out with a relatively large force.

As depicted in FIG. 35, when the fixing unit 35 has been pulled out to the jam-removing position where the primary protrusions 70 abut on the stoppers 120 and 122, the fixing nip N is desirably positioned on an external side relative to an external surface 130 of the copier 1. In place of this configuration, the recording-medium discharging port 125 of the fixing unit 35 can be positioned on the external side relative to the external surface 130. This positioning is advantageous in permitting a jammed sheet of the recording medium S to be removed safely and easily. More specifically, it is possible to remove the jammed recording medium S without being partially obstructed by the external surface 130 and without fear of touching hot surfaces of the fixing unit 35 and a portion of the structure frame 40, units related to conveying of the recording-medium, and the conveying rollers 28 and 29 that are heated with heat from the fixing unit 35.

When the fixing unit 35 is pulled out to the stopper-abutting state where the primary protrusions 70 abut on the stoppers 120 and 122, pulling the fixing unit 35 further outward is prevented. In other words, pulling the fixing unit 35 to be detached from the copier 1 is prevented. To detach the fixing unit 35 from the copier 1, it is necessary to perform the following operation. The retainers 121 and 123 that are visible when the duplex unit 7 is open are removed to permit pulling the fixing unit 35 further outward and disengage the primary protrusions 70 and the secondary protrusions 71 from the primary grooves 47 and 65 and the secondary grooves 48 and 66, respectively.

In this example, fixation of the stoppers 120 and 122 is performed by screwing the threaded portions 121*b* and 123*b* of the retainers 121 and 123; however, fixation of the stoppers 120 and 122 can be performed by using snap-in type retainers in place of the retainers 121 and 123. It is desirable that attaching and detaching of the stoppers 120 and 122 can be performed easily without a tool.

Figure 37:
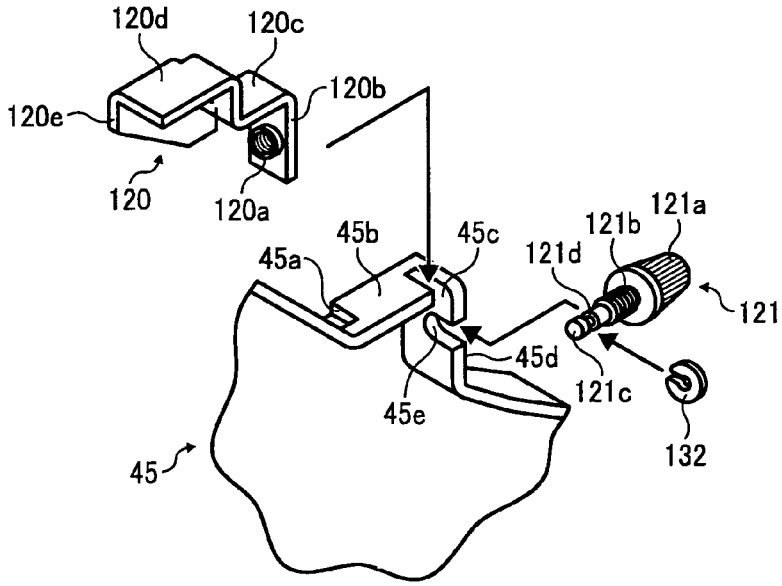
FIG. 37 is a schematic perspective view of the stopper depicted in FIGS. 36A and 36B that is not attached with a retainer according to a modification to the front unit holder yet.
Figure 38:
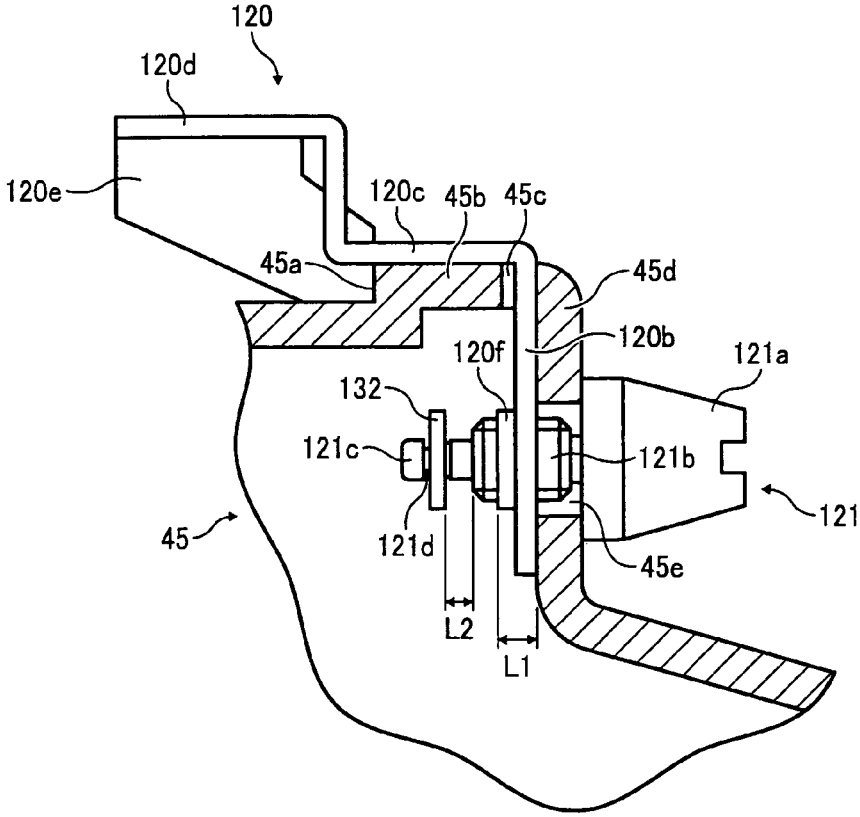
FIG. 38 is a schematic side view of the stopper that has been attached with the retainer depicted in FIG. 37 to the front unit holder.

FIGS. 37 and 38 are schematic views for explaining fixation of the stopper 120 with a retainer according to a modification. The retainer according to the modification is also referred to as "retainer 121". FIG. 37 depicts the stopper 120 that is not attached to the front unit holder 45 yet. FIG. 38 depicts the stopper 120 that has been attached to the front unit holder 45.

As in the above-described example, the small step portion 45*a* is formed on the front unit holder 45. The mount base portion 45*b* that receives, on its top surface, the stopper 120 is formed. The insertion groove 45*c* that is open toward the front is arranged between the outer (right) edge of the mount base portion 45*b* and the edge member portion 45*d*. The edge member portion 45*d* is arranged at a further front position relative to the mount base portion 45*b*. The retainer-receiving groove 45*e* is defined in the edge member portion 45*d*. The retainer-receiving groove 45*e*, into which the retainer 121 is to be fit, is also open toward the front. The stopper 120 is formed by bending a metal plate in the similar manner as that of the above-described example. More specifically, the stopper 120 includes the attaching plate portion 120*b* in which the threaded hole 120*a* is defined, the mount plate portion 120*c*, and the stopper plate portion 120*d*. The mount plate portion 120*c* extends from an end of the attaching plate portion 120*b* to form the right angle therewith. The stopper plate portion

120*d*, which is L-shaped, extends from the mount plate portion 120*c* to form the right angle therewith and then extends parallel to the mount plate portion 120*c*. The side plate portion 120*e* extends downward from one side of the stopper plate portion 120*d*.

When it is premised that replacement of the fixing unit 35 is performed by a user, a thumb screw is used as the retainer 121. The retainer 121 includes the truncated-cone-shaped knob portion 121*a*, the threaded portion 121*b*, and an unthreaded shaft portion 121*c*. The threaded portion 121*b* axially extends from the radial center of a larger-diameter end surface of the knob portion 121*a*. The unthreaded shaft portion 121*c* coaxially extends from an end of the threaded portion 121*b* opposite from the knob portion 121*a*. The diameter of the unthreaded shaft portion 121*c* is smaller than the diameter of the threaded hole 120*a* of the stopper 120. A ring groove 121*d* is defined in an external surface of the unthreaded shaft portion 121*c* at a position close to the leading end, on the side opposite from the knob portion 121*a*, of the unthreaded shaft portion 121*c*.

As in the above-described example, the stopper 120 is attached to the front unit holder 45 as follows. The attaching plate portion 120*b* is inserted from the front side into the insertion groove 45*c* of the front unit holder 45 such that the attaching plate portion 120*b* is positioned on the interior side relative to the edge member portion 45*d*. At this time, the mount plate portion 120*c* is placed on the mount base portion 45*b*, the stopper plate portion 120*d* is positioned at the entrance of the primary groove 47, and the side plate portion 120*e* abuts, at the one side surface of its lower end portion, on the step portion 45*a*.

The unthreaded shaft portion 121*c* is inserted into the retainer-receiving groove 45*e*. Subsequently, the unthreaded shaft portion 121*c* and thereafter the threaded portion 121*b* are inserted into the threaded hole 120*a* and fastened. Hence, the front unit holder 45 is securely fixed by the retainer 121 in a state of being pinched between the stopper 120 and the retainer 121. Thereafter, a retaining member 132 such as a C-type or E-type retaining ring is fitted in the ring groove 121*d* to prevent accidental detaching of the retainer 121 from the stopper 120.

As depicted in FIG. 38, a length L2 of the unthreaded shaft portion 121*c* between the threaded portion 121*b* and the retaining member 132 is desirably larger than a thickness L1 of the stopper 120 at a hole base portion 120*f* where the threaded hole 120*a* is defined.

This configuration is advantageous in that even when the retainer 121 fastened to the threaded hole 120*a* is loosened, the unthreaded shaft portion 121*c* is caught by the hole base portion 120*f* of the attaching plate portion 120*b*. Put another way, the retaining member 132 prevents accidental detaching of the retainer 121 from the threaded hole 120*a*. In this state, it is possible to detach the stopper 120 together with the retainer 121 from the retainer-receiving groove 45*e* of the front unit holder 45.

This configuration is also advantageous in that the front unit holder 45 can be formed from only resin. Furthermore, the need of inserting a metal member, into which the threaded portion 121*b* of the retainer 121 is to be screwed, into the front unit holder 45 is eliminated. By virtue of this simple structure, the front unit holder 45 can be manufactured relatively easily and inexpensively. Eliminating the need of removing the inserted metal member from the front unit holder 45 also facilitates recycling of the front unit holder 45.

This configuration is further disadvantageous in that it is possible to select a type of the retainer 121 depending on whether replacement of the fixing unit 35 is performed by a user or a service person. When it is premised that the replacement is performed by a user, a thumb screw that is more expensive but facilitates the replacement can be used as the retainer 121. When it is premised that the replacement is performed by a service person, a relatively-inexpensive general-purpose screw can be used to avoid unnecessary additional cost.

Because the retaining member 132 prevents accidental detaching of the retainer 121 from the threaded hole 120*a* in the stopper 120, the retainer 121 is prevented from being lost due to carelessness of a user.

Coloring, for example, the knob portion 121*a* of the retainer 121, for example, green or blue as indication of a user-operable component helps a user to recognize that the user can replace the fixing unit 35 by himself/herself.

Figure 39:
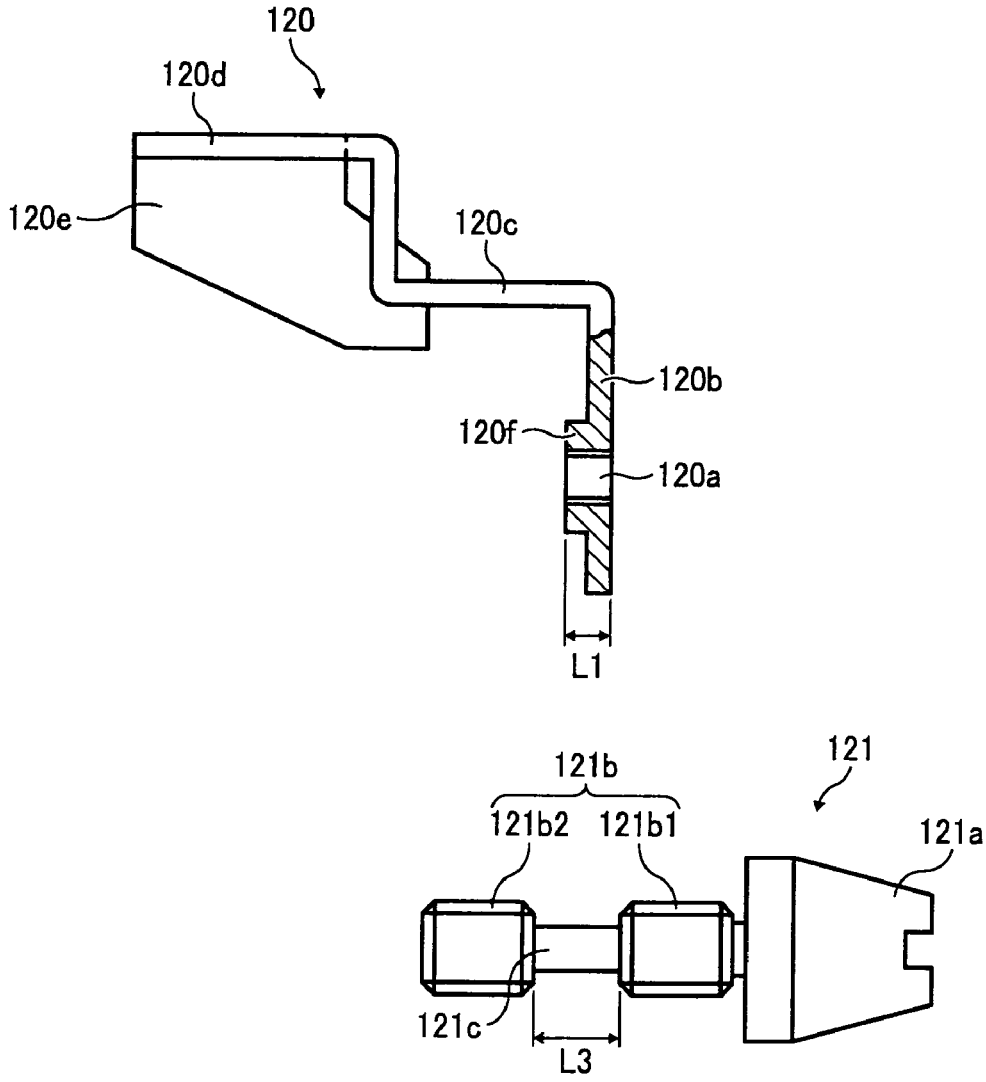
FIG. 39 is a schematic side view of a stopper and a retainer according to another modification.
Figure 40:
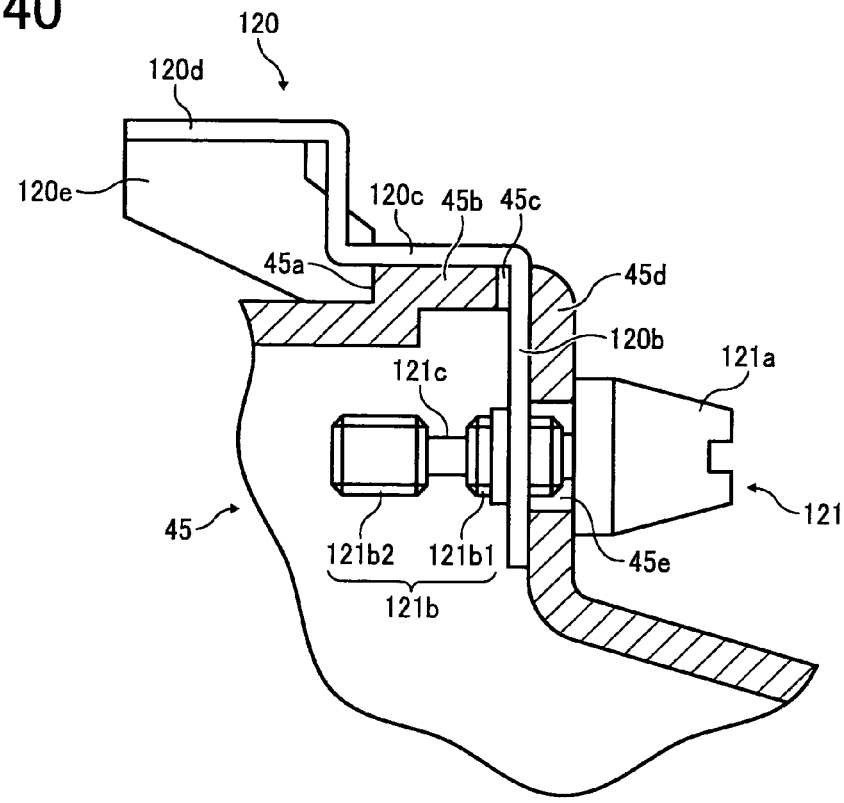
FIG. 40 is a schematic perspective view of the stopper depicted in FIG. 39 attached to the front unit holder with the retainer depicted in FIG. 39 fastened.
Figure 41:
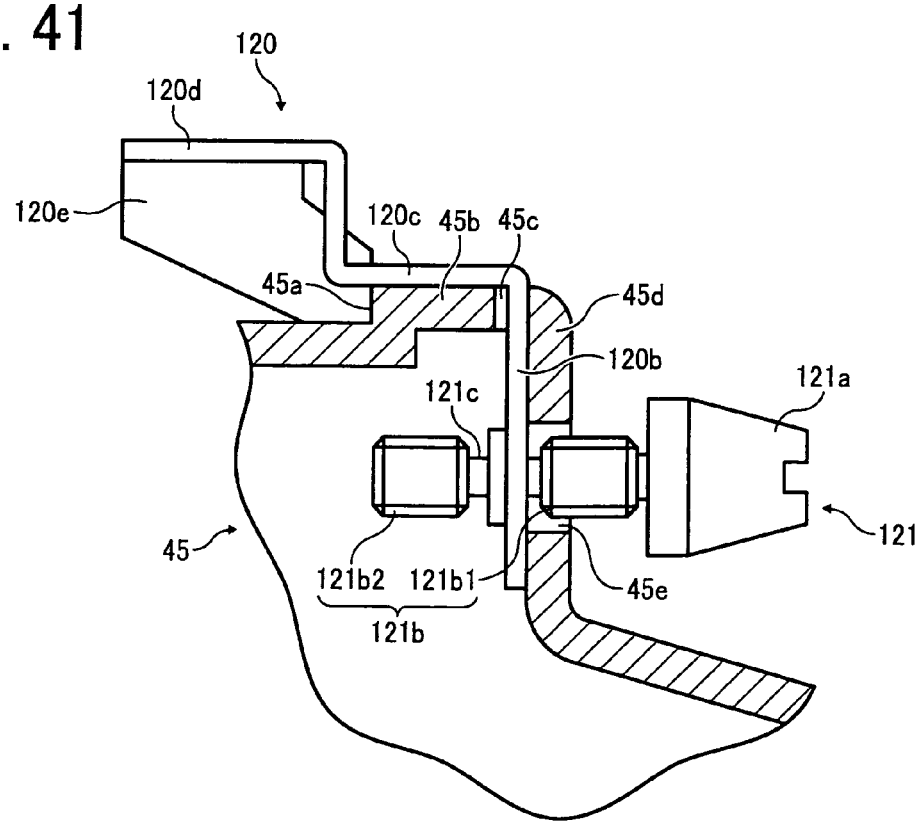
FIG. 41 is a schematic side view of the stopper attached to the front unit holder as depicted in FIG. 40 with the retainer loose.

FIGS. 39 to 41 are schematic views for explaining fixation of the stopper 120 with a retainer according to another modification. The retainer according to this modification is also referred to as "retainer 121". FIG. 39 is a schematic side view of the stopper 120 and the retainer 121. FIG. 40 depicts the stopper 120 that has been attached to the front unit holder 45 with the retainer 121 fastened. FIG. 41 depicts the stopper 120 attached to the front unit holder 45 as depicted in FIG. 40 with the retainer 121 loose.

As in the stopper 120 described above, the stopper 120 according this modification is formed by bending a metal plate, and includes the attaching plate portion 120*b* in which the threaded hole 120*a* is defined, the mount plate portion 120*c*, and the stopper plate portion 120*d*. The mount plate portion 120*c* extends from an end of the attaching plate portion 120*b* to form the right angle therewith. The stopper plate portion 120*d*, which is L-shaped, extends from the mount plate portion 120*c* to form the right angle therewith and then extends parallel to the mount plate portion 120*c*. The side plate portion 120*e* extends downward from one side of the stopper plate portion 120*d*.

When it is premised that replacement of the fixing unit 35 is performed by a user, a thumb screw can be used as the retainer 121. The retainer 121 includes the truncated-cone-shaped knob portion 121*a* and the threaded portion 121*b*. The threaded portion 121*b* axially extends from the radial center of a larger-diameter end surface of the knob portion 121*a*. The retainer 121 includes a portion, which is also referred to as the "unthreaded shaft portion 121*c*", that extends coaxially with the threaded portion 121*b*. The unthreaded shaft portion 121*c* is positioned at a substantially longitudinal center of the threaded portion 121*b* to divide the threaded portion 121*b* into a first threaded portion 121*b*1 and a second threaded portion 121*b*2.

The unthreaded shaft portion 121*c* can be a circular or rectangular column whose diameter or diagonal size is smaller than the diameter of the threaded hole 120*a* of the stopper 120. A length L3 of the unthreaded shaft portion 121*c* between the first threaded portion 121*b*1 and the second threaded portion 121*b*2 is larger than the thickness L1 of the stopper 120 at the hole base portion 120*f* where the threaded hole 120*a* is defined.

As in the above-described example, the stopper 120 is attached to the front unit holder 45 as follows. The attaching plate portion 120*b* is inserted from the front side into the insertion groove 45*c* such that the attaching plate portion 120*b* is positioned on the interior side relative to the edge member portion 45*d*. At this time, the mount plate portion 120*c* is placed on the mount base portion 45*b*, the stopper plate portion 120*d* is positioned at the entrance of the primary groove 47, and the side plate portion 120*e* abuts, at the one side surface of its lower end portion, on the step portion 45*a*.

By inserting the threaded portion 121*b* into the retainer-receiving groove 45*e* through the threaded hole 120*a*, the stopper 120 can be securely fixed to the front unit holder 45 with the retainer 121 as depicted in FIG. 40.

When the retainer 121 fastened to the threaded hole 120*a* in this manner is loosened, as depicted in FIG. 41, the unthreaded shaft portion 121*c* is caught by the hole base portion 120*f* of the attaching plate portion 120*b*. In this state, the second threaded portion 121*b*2 prevents accidental detaching of the retainer 121 from the threaded hole 120*a* even when the retainer 121 is not screwed into the threaded hole 120*a* in the hole base portion 120*f*. The stopper 120 in this state can be detached together with the retainer 121 from the retainer-receiving groove 45*e* of the front unit holder 45.

In this manner, the second threaded portion 121*b*2 prevents accidental detaching of the retainer 121 from the threaded hole 120*a* in the stopper 120. Accordingly, the retainer 121 is prevented from being lost due to carelessness of a user.

In the example depicted in FIGS. 37 to 41, the retainer 121 with which the stopper 120 is to be attached to the front unit holder 45 has been described. The retainer 123 with which the stopper 122 is to be attached to the rear unit holder 46 can have the similar configuration as that of the retainer 121.

According to an aspect of the present invention, an image forming apparatus that is simple in structure and easy to assemble is provided.

Furthermore, because position adjustment of a unit holder can be performed easily by moving the unit holder, parallelism between recording-medium conveying devices can be adjusted accurately, permitting forming a high-quality image. A detachable unit can be moved for the position adjustment stably and in balance without being unintentionally inclined.

According to another aspect of the invention, serviceability of the image forming apparatus is improved because maintenance operation of the image forming apparatus to be performed by an end-user is facilitated. In addition, the maintenance operation can be performed conveniently and reliably.

According to still another aspect of the invention, a second upright panel of a structure frame of the image forming apparatus can be manufactured relatively easily and inexpensively by constructing a second unit holder that supports the detachable unit separately from the second upright panel.

According to still another aspect of the invention, a first engaging member can be formed relatively inexpensively. In addition, when attaching the unit holder to a first upright panel, an operator can visually check how the first engaging member and the second engaging member engage with each other through an opening in any one of the first engaging member and the second engaging member. This improves operability.

According to still another aspect of the invention, because only a vertical load is applied on the unit holder, the unit holder can be moved in a first (vertical) direction smoothly.

According to still another aspect of the invention, parallelism between a fixing nip of a fixing unit and a conveying roller of a recording-medium feed device can be adjusted accurately by using a position adjusting member. This prevents skew of a recording medium or an abnormal image such as a trapezoidal image distortion, causing quality of an image to be improved.

According to still another aspect of the invention, the unit holder is moved by the position adjusting member only in a direction in which the recording medium passes through the fixing nip. This permits the parallelism between the conveying roller and the fixing nip to be achieved more accurately, causing quality of an image to be further improved.

According to still another aspect of the invention, because a fixing member does not include a heat source, the fixing member is prevented from being burnt due to waste heat of the heat source. A fire that would otherwise be caused by a recording medium that is sticking to and around the fixing member and accidentally comes into contact with the heat source is also prevented. From another point of view, because additional protecting means against these burning and fire is not required, it is possible to avoid undesirable increase in complexity, size, and cost.

According to still another aspect of the invention, because a heating width of the fixing member can be adjusted depending on a size of a recording medium, it is possible to prevent end portions of the fixing member from being heated to high temperature.

According to still another aspect of the invention, because an IH device is cooled during operation of the IH device, reduction in efficiency of heat generation by an IH layer in the fixing device due to heat from an energized heating coil can be prevented.

According to still another aspect of the invention, because a distance between a unit body of the fixing unit and the IH device is kept constant, the IH layer can generate heat efficiently without fail.

According to still another aspect of the invention, during operation of the IH device, a cooling device cools the heating coil and a relay by causing air to flow efficiently such that one of air flows passes inside a casing of the IH device and the other one passes outside the same. Accordingly, reduction in efficiency in heat generation by the IH layer and malfunctioning of the relay are prevented.

According to still another aspect of the invention, an air flow path can be formed without adding a dedicated duct member. This leads to cost reduction.

According to still another aspect of the invention, it is possible to select a suction fan as a cooling fan of the cooling device depending on a thermal condition inside the casing of the IH device or the image forming apparatus.

According to still another aspect of the invention, it is possible to select an exhaust fan as the cooling fan depending on a thermal condition inside the casing or the image forming apparatus.

According to still another aspect of the invention, the IH device can be cooled more efficiently by introducing and exhausting air with the cooling fans.

According to still another aspect of the invention, position of the unit holder can be finely adjusted by pivoting the position adjusting member.

According to still another aspect of the invention, the unit holder can be moved smoothly by aligning a moving direction of an eccentric shaft of the position adjusting member with a direction in which the unit holder is moved.

According to still another aspect of the invention, because the fixing unit is prevented from unintentionally being pulled out from the image forming apparatus, an inconvenience of returning the fixing unit having been unintentionally pulled out back into the image forming apparatus would not occur. Furthermore, because an external surface of the image forming apparatus does not partially obstruct removal of a jammed recording medium, the jammed recording medium can be removed easily and safely without fear of touching hot surfaces of the fixing unit, a portion of a structure frame, a recording-medium conveying unit, a conveying roller, and the like.

According to still another aspect of the invention, a distance between an installed position of the fixing unit and a jam-removing position at which a jammed recording medium is to be removed from the fixing unit is relatively short. This facilitates removal of a jammed recording medium.

According to still another aspect of the invention, the fixing unit can be pulled out to the jam-removing position more easily.

According to still another aspect of the invention, it is possible to reliably block the fixing unit that has been pulled out to the jam-removing position from further traveling outward with a simple configuration. Accordingly, an inconvenience of returning the fixing unit that has been unintentionally pulled out back into the image forming apparatus would not occur.

According to still another aspect of the invention, a stopper and a protrusion are less easily deformed by abutting on each other. Accordingly, the stopper and the protrusion are relatively resistant to impacts that can be imparted on the stopper and the protrusion when the fixing unit is pulled out with a relatively large force.

According to still another aspect of the invention, because an operator can detach a retainer from the stopper easily, the fixing unit can be pulled out easily.

According to still another aspect of the invention, because the retainer can be detached from the stopper easily, the fixing unit can be pulled out easily.

According to still another aspect of the invention, the unit holder can be formed only from resin. Furthermore, the need of inserting a metal member into the unit holder is eliminated. By virtue of this simple structure, the unit holder can be manufactured relatively easily and inexpensively. Eliminating the need of removing the inserted metal member from the unit holder also facilitates recycling of the unit holder.

According to still another aspect of the invention, one of different types of the retainer can be used depending on whether replacement of the fixing unit is performed by a user or a service person. Accordingly, it is possible to facilitate the replacement when it is performed by the user and to avoid unnecessary additional cost when the replacement is performed by a service person.

According to still another aspect of the invention, it is more recognizable to a user that the user can replace the fixing unit by himself/herself.

According to still another aspect of the invention, even when the retainer is loosened, accidental detaching of the retainer from a threaded hole in the stopper is prevented. Accordingly, the retainer is prevented from being lost due to carelessness of a user.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a structure frame that includes a first upright panel and a second upright panel, the structure frame forming a skeleton of the image forming apparatus;

a first unit holder that is attached to the first upright panel;

a plurality of first engaging members that extends in a first direction and provided on any one of the first unit holder and the first upright panel;

a plurality of second engaging members that engages with the plurality of first engaging members with substantially no play in a second direction other than the first direction and provided on other one of the first unit holder and the first upright panel;

a detachable unit that is positioned and held by the first unit holder between the first upright panel and the second upright panel; and a position adjusting member that engages with the first unit holder at an engaging position and that is to be operated to move the first unit holder in the first direction relative to the structure frame for position adjustment, the engaging position being on a vertical line extending through a center of mass of the detachable unit, wherein the center of mass of the detachable unit lies on a plane corresponding to:

a first vertical line defined by an upper engaging member and a lower engaging member, both set of engaging members being provided on the first upright panel; and a second vertical line defined by an upper engaging member and a lower engaging member, both set of engaging members being provided on the second upright panel.

2. The image forming apparatus according to claim 1, wherein an operator operates the image forming apparatus from a first side that is toward the first upright panel, and the detachable unit receives a drive force from a second side that is toward the second upright panel.

3. The image forming apparatus according to claim 2, further comprising a second unit holder that is attached to the second upright panel and supports the detachable unit on the second side.

4. The image forming apparatus according to claim 1, wherein the plurality of first engaging member is a protrusion that is formed integrally with the first upright panel by drawing process, and the plurality of second engaging member is a guide groove or an elongated hole formed in the first unit holder so as to engage with the protrusion.

5. The image forming apparatus according to claim 1, wherein the detachable unit is a fixing unit that includes a fixing member and a pressure member, and that fixes an image onto the recording medium by causing the recording medium to pass through a fixing nip formed between the fixing member and the pressure member.

6. The image forming apparatus according claim 1, wherein when the recording medium passes through the fixing nip, the recording medium travels in the first direction in which the first unit holder is moved for the position adjustment.

7. The image forming apparatus according to claim 5, wherein the fixing member includes an induction heating device that includes an induction heating layer and a heating coil, and the induction heating device heats the fixing unit by energizing the heating coil to cause the induction heating layer to generate heat by electromagnetic induction.

8. The image forming apparatus according to claim 7, wherein the induction heating device further includes:

a demagnetizing coil within which an electrical current induced by the heating coil through electromagnetic induction flows, the electrical current reducing magnetic flux generated by the heating coil; and a relay with which on-off control of the electrical current that flows within the demagnetizing coil is performed.

9. The image forming apparatus according to claim 7, further comprising a cooling device that cools the induction heating device of the fixing unit.

10. The image forming apparatus according to claim 9, wherein the cooling device includes a cooling fan that is supported by the first unit holder.

11. The image forming apparatus according to claim 9, wherein the induction heating device further includes:

a first passage through which a medium that cools the heating coil and the demagnetizing coil flows; and a second passage through which a medium that cools the relay flows.

12. The image forming apparatus according to claim 1, wherein the position adjusting member is an eccentric cam that includes a pivot shaft that is to be rotatably fitted into the first upright panel into engagement therewith and an eccentric shaft that is to be rotatably fitted into the first unit holder into engagement therewith.

13. A method of supporting a fixing unit in an image forming apparatus, the image forming apparatus including a structure frame that forms a skeleton of the image forming apparatus, a unit holder that positions and holds a fixing unit in the structure frame, and a position adjusting member that adjusts a position of the unit holder relative to the structure frame, the method of supporting the fixing unit comprising:

forming a plurality of first engaging members on any one of the unit holder and the structure frame, the first engaging member extending in a first direction;

forming a plurality of second engaging members on other one of the unit holder and the structure frame;

bringing the plurality of second engaging members into engagement with the first engaging members with substantially no play in a second direction other than the first direction such that the unit holder is movable in the first direction relative to the structure frame for position adjustment; and arranging an eccentric cam, which is the position adjusting member, on a vertical line that extends through a center of mass of the fixing unit, the eccentric cam including a pivot shaft that is to be rotatably fitted into the structure frame into engagement therewith and an eccentric shaft that is to be rotatably fitted into the unit holder into engagement therewith, wherein the center of mass of the fixing unit lies on a plane corresponding to:

a first vertical line defined by an upper engaging member and a lower engaging member, both set of engaging members being provided on the first upright panel; and a second vertical line defined by an upper engaging member and a lower engaging member, both set of engaging members being provided on the second upright panel.

14. A method of adjusting the position of the fixing unit according to the method of claim 13, comprising pivoting the position adjusting member to move the unit holder in the first direction relative to the structure frame.

* * * * *